US007748464B2

(12) United States Patent
Bhat et al.

(10) Patent No.: US 7,748,464 B2
(45) Date of Patent: Jul. 6, 2010

(54) SUBSEA WELL COMMUNICATIONS APPARATUS AND METHOD USING VARIABLE TENSION LARGE OFFSET RISERS

(75) Inventors: Shankar U. Bhat, Houston, TX (US); John Christian Hartley Mungall, Houston, TX (US); David Brian Andersen, Houston, TX (US); Kevin Gerard Haverty, Houston, TX (US); Sean K. Barr, Magnolia, TX (US); Davinder Manku, Perth (GB)

(73) Assignee: Kellogg Brown & Root LLC, Houston, TX (US)

( * ) Notice: Subject to any disclaimer, the term of this patent is extended or adjusted under 35 U.S.C. 154(b) by 5 days.

(21) Appl. No.: 12/118,937

(22) Filed: May 12, 2008

(65) Prior Publication Data

US 2008/0210433 A1 Sep. 4, 2008

Related U.S. Application Data

(63) Continuation of application No. 11/162,141, filed on Aug. 30, 2005, now Pat. No. 7,416,025.

(51) Int. Cl.
*E21B 29/12* (2006.01)

(52) U.S. Cl. ..... 166/355; 166/350; 166/367; 405/224.4

(58) Field of Classification Search ..... 405/158.1, 405/171, 172, 195.1, 224.2–224.4; 166/350, 166/351, 356, 357, 338, 341; 114/230
See application file for complete search history.

(56) References Cited

U.S. PATENT DOCUMENTS 4,216,834 A * 8/1980 Wardlaw ..... 175/7
4,363,566 A * 12/1982 Morton ..... 405/169
4,377,354 A * 3/1983 Morton ..... 405/171
4,436,451 A * 3/1984 Anderson ..... 405/224.2
4,459,065 A * 7/1984 Morton ..... 405/169
4,685,521 A * 8/1987 Raulins ..... 166/341
4,730,677 A * 3/1988 Pearce et al. ..... 166/345
4,848,970 A * 7/1989 Hunter et al. ..... 405/224
6,682,266 B2 * 1/2004 Karal et al. ..... 405/223.1
6,764,365 B2 * 7/2004 Quigley et al. ..... 441/133
6,837,311 B1 * 1/2005 Sele et al. ..... 166/353
6,843,321 B2 * 1/2005 Carlsen ..... 166/355
7,140,807 B2 * 11/2006 Liao et al. ..... 405/224
7,191,836 B2 * 3/2007 Bhat et al. ..... 166/355
7,311,151 B2 * 12/2007 Chitwood et al. ..... 166/367
7,416,025 B2 * 8/2008 Bhat et al. ..... 166/355
7,520,331 B2 * 4/2009 Bhat et al. ..... 166/367
2004/0134662 A1 * 7/2004 Chitwood et al. ..... 166/367
2005/0063788 A1 * 3/2005 Clausen ..... 405/224.2
2006/0021756 A1 * 2/2006 Bhat et al. ..... 166/352
2007/0048093 A1 * 3/2007 Bhat et al. ..... 405/224.2
2007/0107906 A1 * 5/2007 Bhat et al. ..... 166/355
2008/0210433 A1 * 9/2008 Bhat et al. ..... 166/345

* cited by examiner

*Primary Examiner*—Tara Mayo-Pinnock
(74) *Attorney, Agent, or Firm*—KBR IP Legal

(57) ABSTRACT

The current subject matter relates to compliant variable tension risers to connect deep-water subsea wellheads to a single floating platform in wet tree or dry try systems. The variable tension risers allow several subsea wellheads, in water depths from 1220 to 3050 meters, at lateral offsets from one-tenth to twice the depth or more, to tie back to a single floating platform. Also, the current subject matter relates to methods to counter buoyancy and install variable tension risers using a weighted chain ballast line.

14 Claims, 44 Drawing Sheets

FIG. 4A A

SUBSEA WELL COMMUNICATIONS APPARATUS AND METHOD USING VARIABLE TENSION LARGE OFFSET RISERS

CROSS-REFERENCE TO RELATED APPLICATIONS

This application is a continuation of U.S. patent application Ser. No. 11/162,141 filed on Aug. 30, 2005 now U.S. Pat. No. 7,416,025, the entirety of which is incorporated by reference herein.

BACKGROUND

Field

The present embodiment embodiments generally relates to the production of hydrocarbons from subsea wellheads located in deep to ultra-deep water depths. More particularly, the present invention relates to apparatuses and methods to produce hydrocarbons from a floating platform, supporting a dry tree connected to subsea wellheads located in deep water depths, and/or connected to a deep water wet tree at the subsea wellhead. More particularly still, the present invention relates to apparatuses and methods using compliant variable tension risers to hydraulically connect widely dispersed deep-water subsea wellheads to a floating platform.

A variety of designs exist for the production of hydrocarbons in deep to ultra-deep waters, i.e. depths greater than 1220 meters (4,000 feet). Generally, the preexisting designs fall within one of two types, namely, wet tree or dry tree systems. These systems are primarily distinguished by the location of pressure and reservoir fluid flow control devices. A wet tree system is characterized by locating the trees atop a wellhead on the seafloor whereas a dry tree system locates the trees on the platform in a dry location. These control devices are used to shut in a producing well as part of a routine operation or, in the event of an abnormal circumstance, as part of an emergency procedure.

In wet tree systems, these control devices are located proximate to a subsea wellhead and are therefore submerged. The primary function of the tree is to shut-in the well, in either an emergency or routine operation, in preparation for workover or other major operations.

Dry tree systems, in contrast, place the control devices on a floating platform out of the water, and are therefore relatively dry in nature. Having the production tree constructed as a dry system allows operational and emergency work to be performed with minimal, if any, ROV assistance and with reduced costs and lead-time. The ability to have direct access to a subsea well from a dry tree is highly economically advantageous. The elimination of the need for a separate support vessel for maintenance operations and the potential for increased well productivity through the frequent performance of such operations are beneficial to well operators. Furthermore, the elimination of a dedicated workover riser and the associated deployment costs will also result in a substantial savings to the operator.

Historically, dry tree systems have been installed in conjunction with tension leg platforms or spar-type platforms that float on the surface over the wellhead and have minimal heave motion impact upon the risers. Generically, a riser extending from a tension leg or spar platform is referred to as a top tensioned riser (TTR) as it is either supported directly by the host platform or hull support, or independently by air cans that supply tension to the upper portion. In the case of hull supported TTRs, top tension is supplied via a system of tensioning devices, wherein sufficient tension is applied such that the top tensioned risers remain in tension for all loading conditions. The relative motion between TTRs and the platform in a hull support arrangement is typically accommodated through a stroke biasing action of the tension devices themselves. Therefore, on a spar or tension leg platform, relative movements of the floating platform will be transmitted only minimally through the riser systems because equipment aboard the platform will give and take to accommodate those movements. Particularly, with TTRs, the tension is applied at the top and the tension decreases in a substantially linear profile with depth to the subsea wellhead.

In contrast, vertical riser loads for air can supported TTRs are not carried by the hull of a platform. Instead, the air can supported TTRs ascend from subsea wellheads through an aperture in the work deck known as a moonpool. The TTRs extend through the moonpool and connect to dry trees located on the tops of air cans in the bay area of the platform. Using this construction, each air can supported TTR is permitted to move vertically relative to the hull of the platform through the moonpool. This vertical movement of the TTR relative to the platform is a function of the magnitude of platform offset and set-down, first-order vessel motions, air can area and friction forces between the hull structure and the air cans. The fluid path between the dry tree on the air can and the processing facility on the vessel is usually accomplished by means of a non-bonded flexible jumper.

Regardless of particular configuration, the tension within a TTR system creates a characteristic shape that is substantially linear and in a near vertical configuration. Since TTR curvatures and capabilities for compliance are relatively small, multiple subsea wells connected to a single tension leg or spar platform by TTRs are required to be closely spaced to one another on the ocean floor. Typically, the maximum distance between the most remote subsea wells in a cluster to be serviced by a single platform via TTRs is 90 meters (300 feet). Therefore, dry tree platforms, as deployed with currently available technology, require relatively closely spaced subsea wells in order to be feasible. Unfortunately, the placement of subsea wellheads within 90 meters (300 feet) of each other is not always feasible or economically desirable. Changes in locations and types of undersea geological formations often dictate that wellheads be spaced apart at distances greatly exceeding 90 meters (300 feet). In these instances, it is often less economically feasible to employ dry tree strategies to service these wells as their spacing would require the installation of several tension leg or spar platforms. In these circumstances, wet tree schemes have typically been used.

A wet tree system or dry tree platform system capable of servicing clusters of subsea wellheads at greater spacing distances would offer practical, economic and other advantages. Furthermore, alternatives to tension leg and spar platforms would also be desirable to those in the field of offshore well servicing. Tension leg and spar platforms are relatively expensive endeavors, particularly because of the amount of anchoring and mooring required to maintain them in a relatively static position in rough waters. A platform system having a wet or dry tree arrangement and utilizing a less restrictive and less costly mooring system would be well received by the industry. The present invention addresses these and other inadequacies of the prior art.

BRIEF DESCRIPTION OF THE DRAWINGS

So that the recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
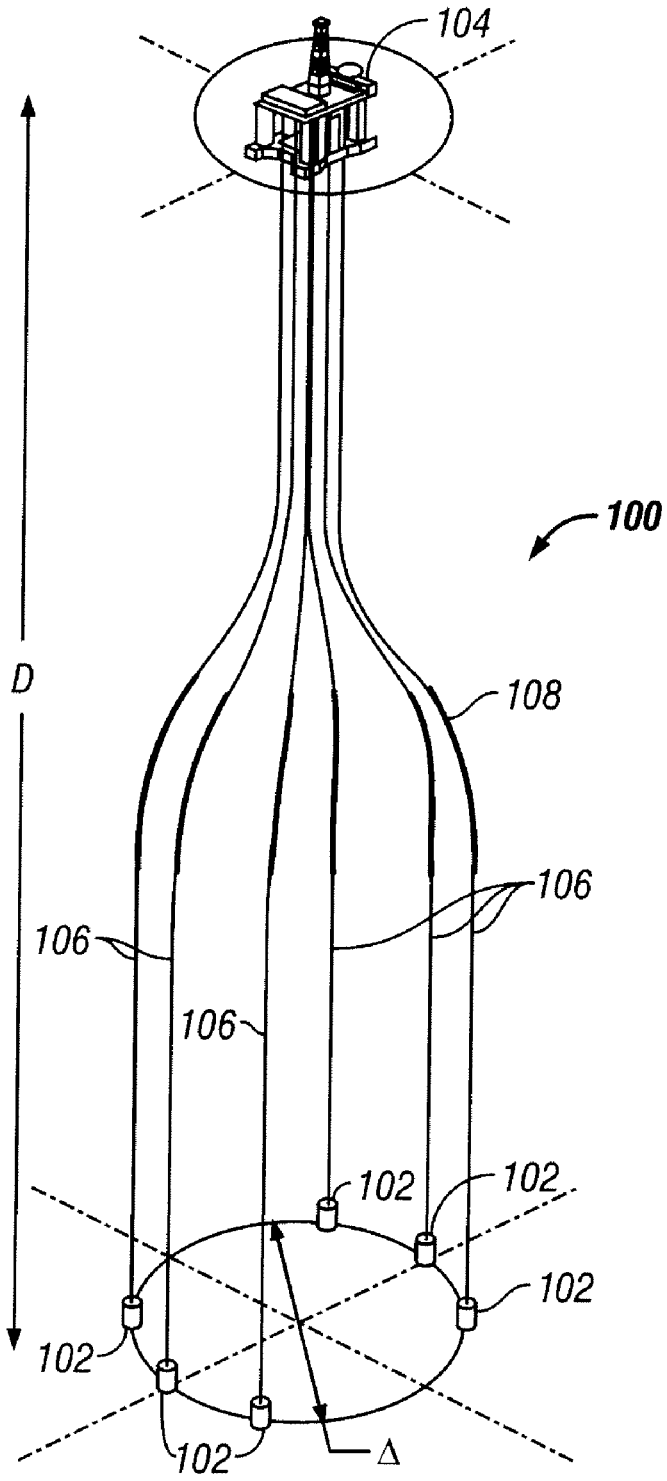
FIG. 1 is an isometric view drawing of a deepwater field development facility in accordance with one embodiment of the present invention.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with publicly available information and technology.

The present invention can provide dry tree functionality to host production facilities with increased motion characteristics relative to spar or tension leg platforms. Such host productions can now be constructed using semi-submersible or mono-hulled platforms including, but not limited to, floating production storage and offloading (FPSO) platforms. Embodiments of the present invention include compliant production riser systems that can accommodate well service and maintenance activities. Embodiments of the present invention are directed to the tieback of subsea wells distantly spaced to a single host production facility having a dry tree.

In one embodiment, an apparatus to communicate with a plurality of subsea wells located at a depth from the surface of a body of water can include a floating platform having a dry tree apparatus configured to communicate with and service the subsea wells. The apparatus can also include a plurality of variable tension risers wherein each of the risers can be configured to extend from one of the wells to the floating platform. The variable tension risers can have a negatively buoyant region, a positively buoyant region, and a neutrally buoyant region between the negatively and positively buoyant regions. The negatively buoyant region is hung from the floating platform and exhibits positive tension. The neutrally buoyant region is characterized by a curved geometry configured to traverse a lateral offset of at least 90 m (300 feet) between the floating platform and the subsea well. The positively buoyant region can be positioned above the subsea well and exhibits positive tension.

The apparatus can be used in water of a sufficient depth to accommodate the curved geometry, e.g. 300 meters (1,000 feet), but will have particular applicability in a depth of water greater than 1220 meters (4,000 feet). The apparatus can be used in water having depths of up to 3050 or 4570 meters (10,000 or 15,000 feet), or more. The plurality of subsea wells can be characterized by a maximum offset, wherein the offset defines the maximum distance on a sea floor of the body of water between the dry tree apparatus and a most distant well of the plurality of subsea wells. The maximum offset can be less than or equal to one half the depth or greater than or equal to one tenth the depth from the surface of the body of water. The plurality of subsea wells can include vertically drilled wells, and can be free of slant and horizontally or partially horizontally drilled wells. The apparatus can include a floating platform that is a spar platform, a tension leg platform, a submersible platform, a semi-submersible platform, well intervention platform, drillship, dedicated floating production facility, and so on.

The variable tension risers can terminate at the dry tree, a distal end, or a pontoon of the floating platform. A spool connection can connect a variable tension riser not terminated at the dry tree to the dry tree. A second neutral buoyancy region proximate to a distal end of the floating platform can be included. The variable tension risers can include a rope and ballast line attachment point or a stress joint proximate to a connection with the subsea well or to the floating platform. The stress joint can be curved or pre-curved.

The apparatus can include a spacer ring configured to make a connection between the neutral buoyancy region and the negatively buoyant region of each variable tension riser. The spacer ring can be configured to restrict relative lateral movement and allow relative axial movement of the variable tension risers. The apparatus can include anchor lines connecting the variable tension risers to a seafloor below the body of water wherein the anchor lines are configured to restrict movement of the variable tension risers. The variable tension risers can include single, coaxial, or multi-axial conduits to communicate with, produce from, or perform work on the subsea well connected to the variable tension riser. Furthermore, each variable tension riser can optionally include a second negatively buoyant region between the positively buoyant region and the subsea well with positive tension in the riser proximate the subsea well.

In another aspect, a method to install a communications riser from a floating platform to a subsea wellhead can include deploying a wellhead connector mounted on a distal end of a first slick section of the communications riser from the floating platform. The method can include attaching a guide and ballast line to a connection to the communications riser, wherein the guide and ballast line are configured to be paid out and taken up from a floating vessel. The method can include deploying a buoyed section of the riser from the floating platform and adjusting the guide and ballast line to counter any positive buoyancy of the buoyed section. The method can include deploying a neutrally buoyant section of the riser from the floating platform. Finally, the method can include manipulating the guide and ballast line with the floating vessel to deflect the communications riser a lateral distance, and lowering the communications riser to engage the wellhead with the wellhead connector.

If desired, the method can include creating a curved section of the communications riser in the neutrally buoyant section of the riser to traverse the lateral distance. Optionally, the guide and ballast line can comprise a heavy ballast chain, such as, for example, a 15.2 centimeter (6-inch) stud-link chain weighing over 90 kilograms per meter of length (200 pounds per foot of length). The guide and ballast line can comprise a fine-tuning ballast chain, such as, for example, a 7.6 centimeters (3-inch) stud-link chain weighing less than 45 kilograms per meter of length (100 pounds per foot of length). Optionally, the method can include paying out and taking up the guide and ballast line to apply axial and lateral loads to guide the communications riser across the lateral distance. The method can also include using remotely operated vehicles to assist in the deflection of the communications riser.

The communications riser can be a variable tension riser. The method can include deploying a transition section of the riser from the floating platform. The neutrally buoyant section of the communications riser can include a heavy case section or a light case section. The floating platform can be a semi-submersible platform. The method can include deploying a plurality of communications risers from the floating platform. The subsea wellhead can be located in water of any sufficient depth below the floating platform, e.g. 300 meters (1,000 feet), but will have particular applicability in a depth of water greater than 1220 meters (4,000 feet) below the floating platform. The subsea wellhead can be located in water having depths of up to 3050 or 4570 meters (10,000 or 15,000 feet), or more.

In another embodiment, a variable tension riser connects a subsea wellhead to a floating platform and traverses a lateral offset of at least 90 meters (300 feet). The variable tension riser can include a first negatively buoyant region, a neutrally buoyant curved region, a positively buoyant region, and a second negatively buoyant region. The first negatively buoyant region hangs below the floating platform exhibiting positive tension. The second negatively buoyant region is positioned above the subsea wellhead. The neutrally buoyant curved region is located between the first negatively buoyant region and the positively buoyant region, which is located above the second negatively buoyant region to create positive tension within the second negatively buoyant region. The variable tension riser can include a communications conduit to allow communications from the floating platform to a wellbore of the subsea wellhead.

The curved region can traverse the lateral offset between the subsea wellhead and the floating platform. The subsea wellhead can be located in water of a sufficient depth to accommodate the curved geometry, e.g. 300 meters (1,000 feet), but the variable tension riser will have particular applicability in a depth of water greater than 1220 meters (4,000 feet) below the floating platform. The variable tension riser can be used in water having depths of up to 3050 or 4570 meters (10,000 or 15,000 feet), or more. The lateral offset can be less than or equal to one half of the depth of the subsea wellhead below the floating platform and more than one tenth of the depth. Furthermore, the variable tension riser can optionally include a second neutrally buoyant region proximate to the floating platform. The variable tension riser can include a stress joint proximate to the subsea wellhead. The communications conduit can allow for the communication with, production from, and the performance of work on the subsea wellhead from the floating platform. The variable tension riser can further include an anchor line extending to a seafloor mooring configured to restrict movement of the variable tension riser. The variable tension riser can further include a linking member connecting the variable tension riser to a second variable tension riser. Finally, the positively buoyant region can have a positive tension.

In another embodiment, a variable tension riser connects a subsea wellhead, a subsea flow line end termination (FLET), or a subsea pipe line end termination (PLET) to a floating platform. The riser can include a negatively buoyant region, a weighted region, a variably buoyant region terminating at a positively buoyant region, and a tensioned upright region. The negatively buoyant and weighted regions can hang below the floating platform. The weighted region can be intermediate the negatively buoyant and variably buoyant regions. The variably buoyant region can be located between the weighted and tensioned upright regions. The positively buoyant region can be positioned between the variably buoyant region and the tensioned upright region to create positive tension in the tensioned upright region. The tensioned upright region can be connected to the FLET, PLET, or the wellhead. The riser can also include a communications conduit to allow communications from the floating platform to a wellbore of the subsea wellhead, FLET, or PLET.

The variable tension riser can include a slick pipe region intermediate the weighted region and the variably buoyant region. The variably buoyant region can include two or more sections of varying buoyancy per unit length. The variably buoyant region can include a plurality of distinct regions of increasing buoyancy. The variably buoyant region can be curved, and can include a section deviating at least 40 degrees from vertical.

In one embodiment at least a portion of the tensioned upright region is positively buoyant. In another embodiment, at least a portion of the tensioned upright region is negatively buoyant. The positively buoyant region can include a segment of maximum buoyancy below one or more segments of lesser buoyancy. The weighted region can include two or more sections of varying weighting per unit length.

In another embodiment, the variably buoyant region can be at a depth greater than one half of a depth of the subsea wellhead, FLET, or PLET below the floating platform. The variable tension riser can traverse a lateral offset from the platform to the wellhead, FLET, or PLET. The lateral offset can be less than or equal to one half of a depth of the subsea wellhead, FLET, or PLET below the floating platform and more than one tenth of the depth; less than or equal to the depth in other embodiments, less than or equal to twice the depth in further embodiments, or greater than twice the depth.

The variable tension riser can include an anchor line extending to a seafloor mooring to restrict movement of the variable tension riser. In other embodiments, the variable tension riser can include a linking member connecting the variable tension riser to a second variable tension riser.

The positively buoyant region can positively tension the riser at the subsea wellhead, FLET, or PLET connection. The weighted region can positively tension the riser at the platform.

The variable tension riser can include a mud-line package attachable to a wellhead. The variable tension riser can be connected to the FLET or PLET at a connection free of jumpers.

The variable tension riser can include a stress joint and ballast weight proximate a lowermost end of the tensioned upright region. The variable tension riser can include a stress joint proximate to a distal end of the floating platform. The stress joint can be connected to one or more keel joints guided with a keel guide connected to the distal end of the floating platform. The keel guide can be selected from an open guide with non-zero gap, an open guide with zero gap; a hinged closed guide with non-zero gap, a hinged closed guide with zero gap, or combinations thereof.

In other embodiments, an apparatus to communicate with a plurality of subsea wells located at a depth from the surface of a body of water, the apparatus can include a floating platform configured to communicate with the subsea wells and a plurality of the variable tension risers as described above.

The plurality of subsea wells can be characterized by a maximum offset less than or equal to one half the depth from the surface of the body of water; a maximum offset less than or equal to the depth, twice the depth, or greater than twice the depth in other embodiments.

The floating platform can be selected from spar platforms, tension leg platforms, submersible platforms, semi-submersible platforms, well intervention platforms, and drillships. The apparatus can have a center-to-center spacing measured at the platform between two variable tension risers of between 2 and 12 meters (7 and 40 feet). The center-to-center spacing can be less than 4.9 meters (16 feet) in other embodiments.

One or more of the variable tension risers in the apparatus can have a second negatively buoyant region including a vertical section proximate the buoyant region, a second curved section, and a horizontal section configured to lie on a seabed from the second curved section to the wellhead.

In another embodiment, an apparatus to communicate with and workover a plurality of subsea wells is provided. The apparatus can include a floating platform capable of communicating with and workover of the subsea wells. The communication between the platform and the wells can include one or more production risers connected to PLETs or FLETs in fluid communication with manifolds which can be in fluid communication with two or more subsea wells. The workover capabilities can include a variable tension riser as described above which is removably attached to a subsea well selected for well access and workover. When workover operations are completed, the workover riser can be disconnected and the lower end moved for attachment to another subsea well. The production riser can be an SCR or can also be a variable tension riser as described above and used for well production.

In another embodiment, a method to install a communications riser from a floating platform to a subsea wellhead or a pipe line end termination (PLET) connected to a wet tree of a subsea wellhead is provided. The method can include: deploying a connector mounted on a distal end of a first slick section of the communications riser; attaching to the communications riser a guide and ballast line to be paid out and taken up from a floating vessel; deploying one or more buoyed sections of the communications riser; adjusting the guide and ballast line to counter any positive buoyancy of the buoyed section; deploying a weighted section of the communication riser; deploying a second slick section of the riser; manipulating the guide and ballast line to deflect the communications riser a lateral distance; and lowering the communications riser to engage the wellhead or PLET with the connector. As used herein, slick or bare pipe sections can include insulation, but do not include added weighting or buoyancy.

The connector, buoyed sections, weighted section, and second slick line section can be deployed from the floating platform; the guide and ballast line can be manipulated with the floating vessel. The guide and ballast line can include a ballast attachment rope connecting a heavy ballast chain to the connector and an installation rope connecting the heavy ballast chain to the floating vessel.

In another embodiment, the method can include parking the heavy ballast chain on a seabed proximate the wellhead or PLET. The parking can include: lowering the connector to a point intermediate the wellhead or PLET and the distal end; manipulating the guide and ballast line to lay the heavy ballast chain on the seabed without contacting the wellhead or riser with the heavy ballast chain; disconnecting and recovering the installation rope from the heavy ballast chain.

In another embodiment, the attachment point can include a reel having excess ballast attachment rope and the parking can include reeling out the excess ballast attachment rope; manipulating the guide and ballast line to lie the heavy ballast chain on the seabed without contacting the wellhead or riser with the heavy ballast chain; disconnecting and recovering the installation rope from the heavy ballast chain.

Referring initially to FIG. 1, a subsea well management system 100 is shown. Management system 100 can include a plurality of subsea wellheads 102 connected to a floating platform 104 through a plurality of variable tension risers 106. Subsea management system 100 can be designed and constructed to function in deepwater environments wherein the total water depth is greater than or equal to 300 meters (1,000 feet), but will have particular applicability at depths greater than or equal to 1220 meters (4,000 feet) up to 3050 or 4570 meters (10,000 or 15,000 feet), or more. Desirably, for the system 100 shown in FIG. 1, the water depth D between platform 104 and wellheads 102 should be between 1525 to 3050 meters (5,000 to 10,000 feet).

Variable tension risers 106 can be constructed as lengths of rigid pipe that become relatively compliant when extended over long lengths. For instance, while the materials of variable tension risers 106 may seem highly rigid at short lengths, e.g. 30 meters (100 feet), they become highly flexible over longer lengths, e.g. from 1525 to 3050 meters (5,000 to 10,000 feet). The variable tension risers 106 can include various regions of differing buoyancy relative to the seawater in which they reside. Neutral buoyancy regions 108 can be located along the length of variable tension risers 106 to assist in forming and maintaining the s-curve thereof shown in FIG. 1. Neutral buoyancy regions 108 combined with the relative compliance of variable tension risers 106 create a riser extending from subsea wellheads 102 to platform 104 with more lateral and vertical give than with risers available in the prior art.

Furthermore, because servicing each subsea wellhead 102 with its own platform 104 would be economically infeasible, subsea management system 100 is capable of servicing multiple wellheads 102 with a single floating platform 104 and numerous variable tension risers 106. Formerly, the rigid nature of vertical risers and the mooring and anchoring demands of the servicing platforms required that wellheads be located relatively close to one another for them to be serviceable with a single platform. Often, decisions regarding the type, depth, and number of subsea wells were dictated by these design constraints. These constraints often limit the exploration and production of subsea reservoirs because they dictate where wells must be located rather than allow placement more favorable to the efficient exploitation of the trapped hydrocarbons.

Referring still to FIG. 1, subsea wellheads 102 are shown located within a circle generally having a diameter of Δ. This diameter Δ characterizes a vessel watch circle, wherein the maximum offset from the center of the circle would be the radius or one half of the diameter Δ. The value of Δ will be the largest distance between any two wellheads 102 within the group and represents the amount of spacing generally within a group of subsea wellheads 102. Formerly, using pre-existing technology, wellhead offsets only less than or equal to 10% of the water depth D were feasible. Using systems (e.g. 100 of FIG. 1) in accordance with the present invention, wellhead offsets up to 25%, 50%, 75%, 100%, or even greater than 100% of the water depth D are feasible. This broader and more dispersed spacing for wellheads 102 allows a subsea geological formation to be more thoroughly and effectively explored. Using systems of the present invention, wells no longer need to be drilled and serviced by a single platform. Instead, a drill ship can drill production wells throughout the field that can all be tied back to a single floating platform for production and maintenance.

Figure 2:
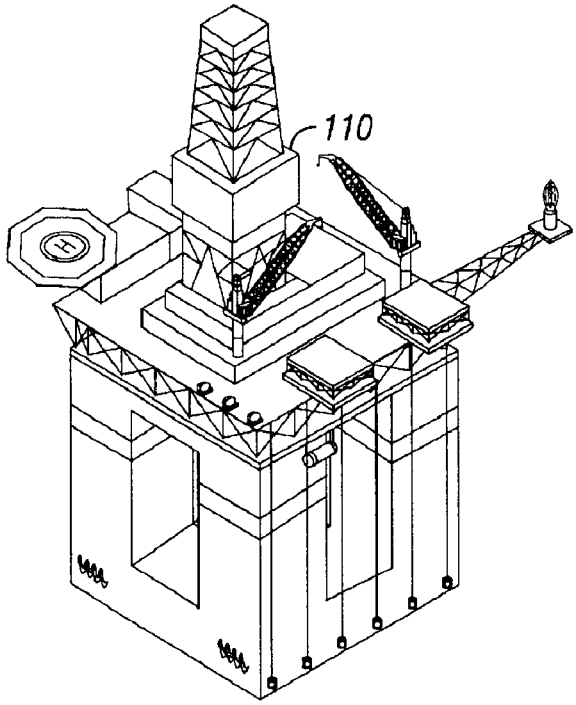
FIG. 2 is an isometric view sketch of a semi-submersible floating production facility used in conjunction with one embodiment of the present invention.
Figure 3:
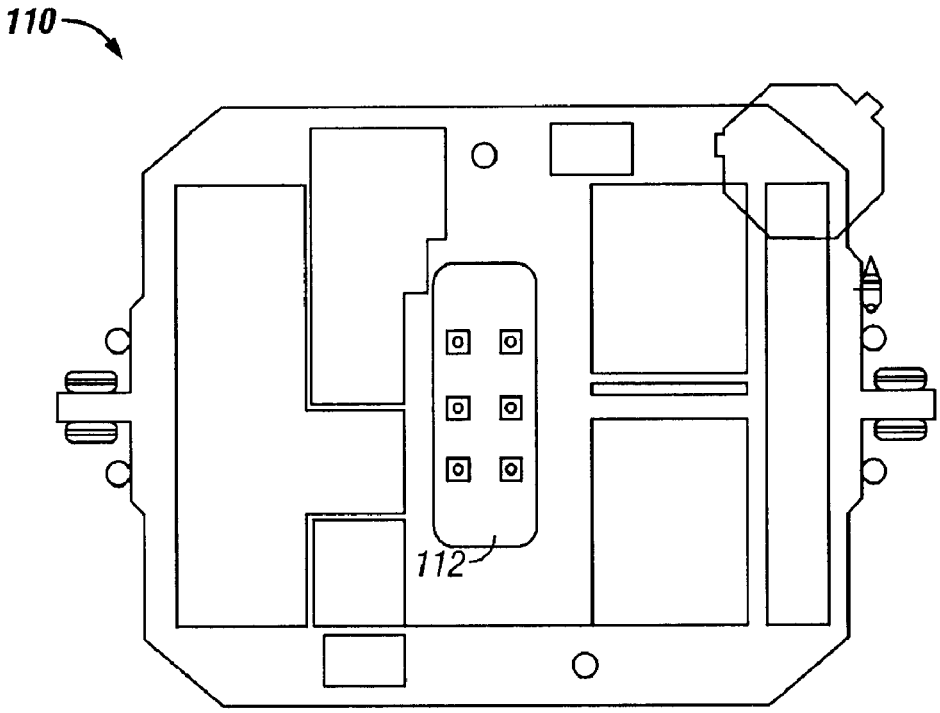
FIG. 3 is top view drawing of the semi-submersible floating production facility of FIG. 2.

Referring briefly to FIGS. 2 and 3, a semi-submersible platform 110 for use with the present invention is shown. Semi-submersible platform is capable of being used as the floating platform 104 of FIG. 1 to service and maintain a plurality of subsea wellheads 102 through variable tension risers 106. Formerly, semi-submersible platforms 110 were not useable with deepwater dry tree production systems because they are not easily maintainable in a position stationary enough to be used with top tensioned risers. Therefore, the displacements and heaving experienced by a semi-submersible platform 110 were not considered feasible. A dry tree assembly 112 located upon a semi-submersible platform 110 will be able to service multiple deep water wellheads 102 without significant concern for maintaining the semi-submersible 110 in an absolute position. Additionally, special purpose floating platforms may also be used for platform 104 to communicate a dry tree assembly 112 with subsea wellheads.

Figure 4A:
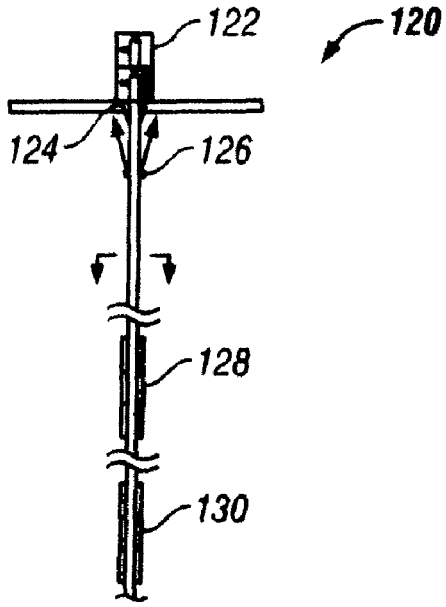
FIGS. 4A and 4B are a schematic side view drawing of a variable tension riser in accordance with one embodiment of the present invention and FIG. 4AA is a section view of different slick joints used to construct a variable tension riser in accordance with various embodiments of the present invention.
Figure 4B:
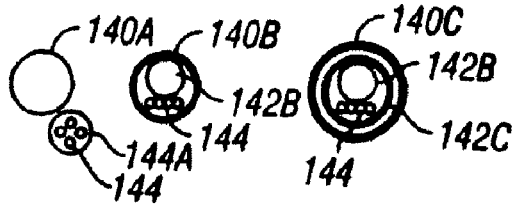
Figure 4B:
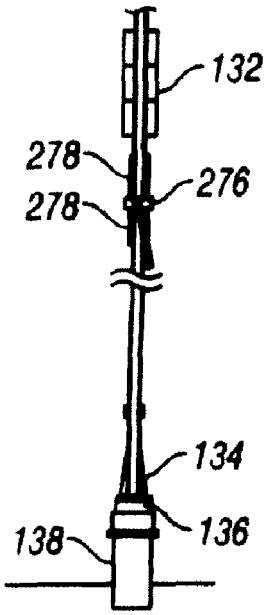

Referring now to FIGS. 4A, 4AA, and 4B, a variable tension riser 120 in accordance with an embodiment of the present invention is shown. FIG. 4A details the upper portion of variable tension riser 120 from a surface tree 122 on the floating platform to a middle buoyancy region 130, and FIG. 4B the lower portion extending from a bottom buoyancy region 132 to the subsea wellhead 138. Variable tension riser 120 can be constructed extending from a surface tree 122, to a flex joint 124, an optional tension ring 126, a top buoyant region 128, the middle buoyant region 130, the bottom buoyant region 132, a stress joint 134, a tieback connector 136, and to the wellhead 138. As detailed in FIG. 4AA, variable tension riser 120 can be constructed from slick joints that include: (a) a tubing riser comprising a single string of production tubing 140A, which can also include control lines 144 in an umbilical 144A wrapped around the tubing 140A; (b) a single casing riser comprising a string of casing 140B that houses at least one string of production tubing 142B and various control lines 144; (c) a dual casing riser comprising a string of outer casing 140C, inner casing 142C, one or more production tubing strings 142B and control lines 144, or any combination of these configurations can be used for various ones of the variable tension riser 120. Variable tension riser 120 can also include an artificial lift system, such as, for example, electric or hydraulic pumps, gas lift or the like. Also, subsea shear rams or other blowout preventers can be provided proximate the connection to the subsea well. Artificial lift systems and blowout prevention devices are well known in the art.

By carefully selecting the configuration and design for buoyancy regions 128, 130, and 132, the variable tension riser 120 can be positioned in an s-curved shape that involves varying amounts of tension throughout its length. Principally, tension in variable tension riser 120 will be greatest at flex joint 124 near the floating platform and just below lowermost buoyancy region 132 at the top of the lower slick pipe region above wellhead 138, due to the weight of the negatively buoyant riser hanging below these points. Tension decreases linearly from these points, generally to about neutral at the buoyancy region 128 but desirably remains above zero or positive at the wellhead 138. Stress joints 124, 134 are used to accommodate lateral displacements of the variable tension riser 120 in these high tensile locations. At all points in between, tension can be varied through the use of buoyancy regions 128, 130, and 132 and through the use of ballast and weighting chains (not shown) attached to attachment point 276 and stress relief sub 278 (discussed in detail below in relation to FIG. 23).

Figure 5:
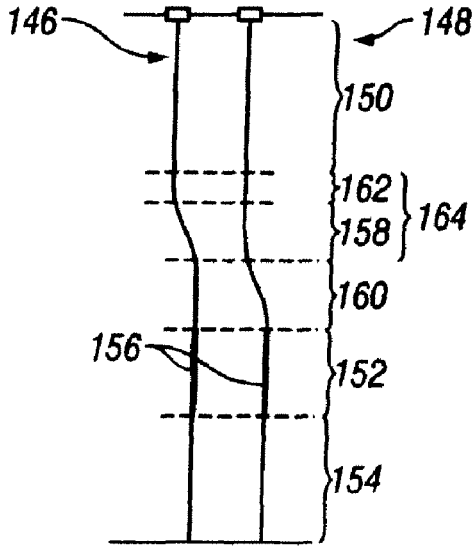
FIG. 5 is a schematic side view drawing of a variable tension riser showing buoyancy regions in accordance with an embodiment of the present invention.

Referring to FIG. 5, the buoyancy regions for two different variable tension risers 146, 148 are shown. Variable tension riser 146 is shown schematically as a light case where the fluid density in the riser string is relatively low and the and the weight of the riser is string is thus less than the heavy case variable tension riser shown by item 148 representing a relatively high fluid density. In the heavy case the Generally, the wall thickness and weight of variable tension riser 146, 148 can be designed using various parameters including the overall length of variable tension riser 146, 148, how much curvature is desired, i.e. the wellhead spacing, and the expected inside and outside pressure conditions.

Referring to light case 146 and heavy case 148 variable tension riser strings together, various buoyancy regions are shown in common. First, a top slick pipe region 150 is present at the uppermost section of risers 146, 148. Top region 150 experiences tension as it extends down from the floating platform located on the water surface. The weight of the pipe in the top region 150 creates this tensile condition. Next, a bottom buoyancy region 152 creates tensile conditions within lower portions 154 of variable tension risers 146, 148 extending from wellheads on the seabed. Particularly, buoyancy devices known to one skilled in the art, shown schematically at 156, are placed upon risers 146, 148 to counteract the weight of the slick pipe of risers 146, 148 and upwardly buoy sections 154. This results in a positively tensioned region 154 for variable tension risers 146, 148.

Next, neutrally buoyant and transitional regions exist along the length of risers 146, 148 somewhere between region 150 and regions 152, 154, due to the negative buoyancy at region 150 and positive buoyancy at region 152. As the loading conditions within risers 146 and 148 range from negative buoyancy to positive buoyancy, the laws of physics dictate that there must be a zero or neutrally buoyant portion somewhere between the differently tensioned regions. For light case variable tension riser 146, the neutral buoyancy region is indicated at 158. For heavy case variable tension riser 148, the neutral buoyancy region is indicated at 160. Furthermore, transitional regions 162, 164 exist between tensile region 150 and respective neutrally buoyant regions 158, 160.

Figure 6:
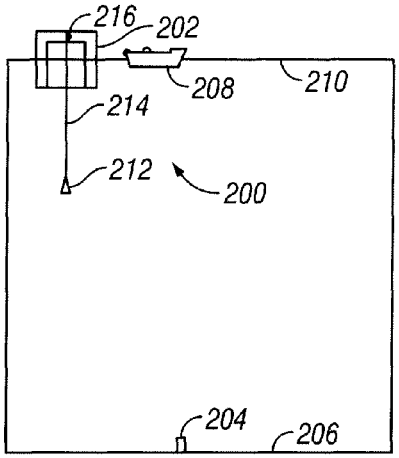
FIGS. 6-22 are schematic side view drawings showing the steps to install a variable tension riser from a floating production facility in accordance with an embodiment of the present invention.
Figure 7:
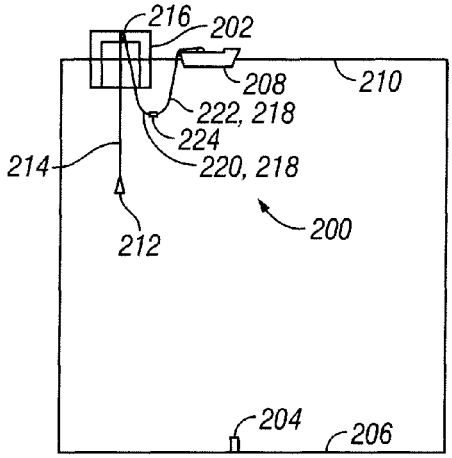

Referring collectively to FIGS. 6-22, an installation process for a variable tension riser assembly 200 is depicted. Referring initially to FIG. 6, a variable tension riser assembly 200 is shown being run from a floating work facility 202 to a wellhead 204 on the ocean floor 206. A workboat 208 is available on the surface 210 of the water to assist in the installation process, if necessary. At this point, variable tension riser 200 includes a stress joint 212, a length of slick pipe 214, and a ballast line attachment point 216. Referring now to FIG. 7, a tension line or rope 218 is connected from the workboat 208 to ballast line attachment point 216. Rope 218 can be a keel-haul synthetic line rope, such as, for example, 15 centimeter (6-inch) diameter polyester, but may be of any style and type known to one of ordinary skill in the art. Optionally, rope 218 can be constructed as multiple sections, for example, the two segments 220, 222 as shown, having a connector 224 between the adjacent segments, which can also help weight down rope 218.

Figure 8:
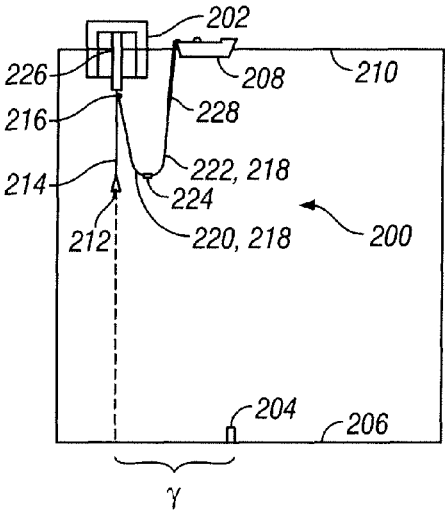

Referring now to FIG. 8, variable tension riser 200 continues to be deployed from floating platform 202 towards wellhead 204. Following deployment of the lower section of slick pipe 214, the lower buoyancy region 226 is deployed. As buoyancy region 226 is deployed, main ballast chain 228 is paid out from workboat 208. Ballast chain 228 can be, for example, a 15 centimeter (6-inch) stud link chain approximately 200 meters (650 feet) long and weighing about 8200 kilograms (180,000 pounds) in water. Ballast chain 228 is connected to the end of rope line 218 and serves to both ballast and direct the position of variable tension riser assembly 200, offsetting the buoyancy of section 226 and thereby enabling variable tension riser assembly 200 to be sunk into position atop wellhead 204. In addition to providing downward force, ballast chain 228 also provides lateral force to help displace variable tension riser assembly 200 a distance $\gamma$ from the position of platform 202 to wellhead 204. This lateral deflection is accomplished through the manipulation of ballast chain 228 and rope line 218 from workboat 208. By selectively adjusting the tension and amount of line paid out, workboat 208 can adjust the amount of lateral load on variable tension riser 200 and deflect it into the desired shape as it is deployed.

Figure 9:
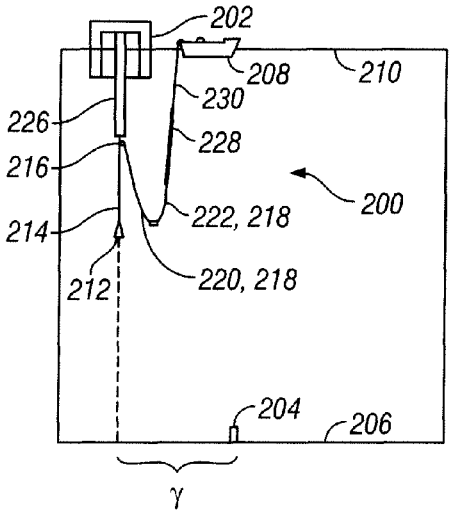

Referring now to FIG. 9, a fine tuning ballast chain 230 is deployed as more of buoyancy region 226 is deployed from floating platform 202. Fine tuning ballast chain 230 can be, for example, a 7.6 centimeter (3-inch) stud-link chain approximately 150 meters (500 feet) long and weighing 18200 kilograms (40,000 pounds) in water. Because of the smaller weight than main ballast chain 228, fine-tuning chain 230 allows more precise adjustments in deflection $\gamma$ to be accomplished by workboat 208. The more accurately workboat 208 can make the positioning and deflection of variable tension riser assembly 200, the less assistance from remotely operated vehicles (ROVs) that is necessary. Furthermore, while specified sizes, weights, and lengths for ballast chains 228, 230 are given, it should be understood by one of ordinary skill in the art that the exact sizes, lengths, and weights depend on the amount of deflection $\gamma$ needed, the total depth of water traversed, and the construction and material properties of the variable tension riser assembly 200 itself.

Figure 10:
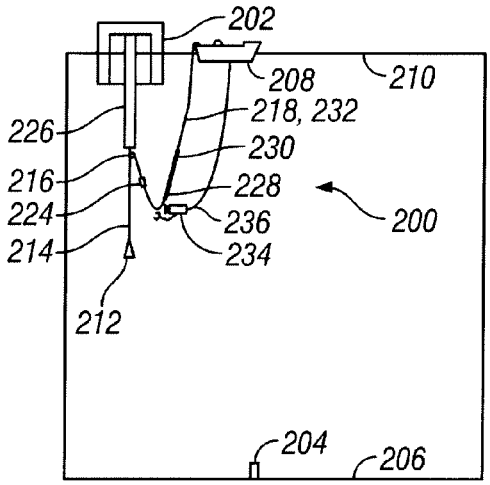
Figure 11:
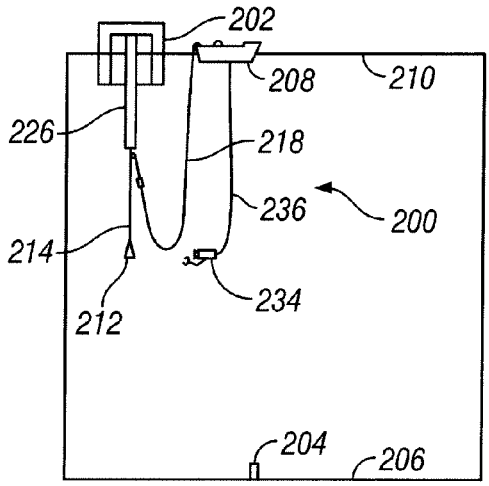

Referring now to FIG. 10, the installation and deployment of variable tension riser assembly 200 continues. As buoyant section 226 continues to be paid out, ballast chains 228 and 230 are paid out until their entire lengths are deployed, at which time another section 232 of rope line 218 is paid out from workboat 208. Furthermore, as seen, ROV 234 can be deployed to assist in the guidance of variable tension riser assembly 200 toward its target wellhead 204. A communications line 236 connects ROV 234 to workboat 208 so that an operator can manipulate and control ROV 234. FIG. 10 details an example of the step where the ballast weight from chains 228 and 230 is still being paid out, while keeping the lateral load upon variable tension riser assembly 200 to a minimum. Referring to FIG. 11, the ballast chains 228, 230 are shown fully deployed upon rope line 218 so as to continue to sink ballast sections 226 deeper into the water.

Figure 12:
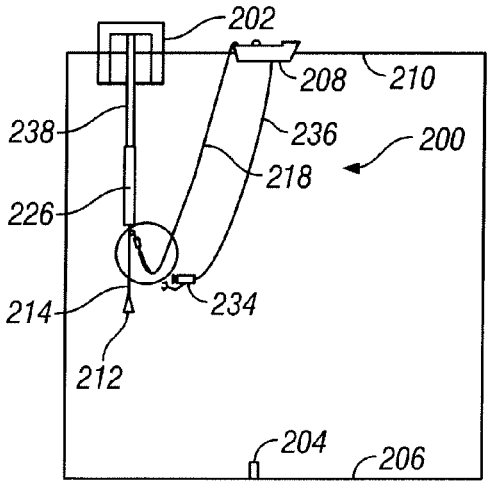
Figure 12A:
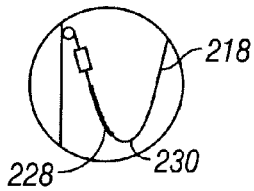

Referring now to FIG. 12, a heavy case neutral buoyancy region 238 is deployed from floating platform 202 atop buoyancy section 226. As can be seen in FIG. 12A, the amount of rope line 218 paid out or taken in by workboat 208 can be used to determine how much weight from ballast chains 228, 230 acts on variable tension riser assembly. Having too much or too little downward ballast force on riser assembly 200 can cause the riser to be too heavy or too buoyant to facilitate deployment.

Figure 13:
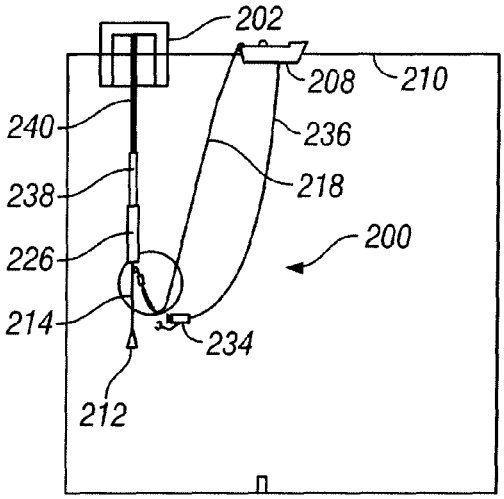

Referring to FIG. 13, a light case neutrally buoyant region 240 is paid out from floating platform 202. Like heavy case region 238 deployed in FIG. 12, light case region 240 does not require much, if any, manipulation of ballast chains 228, 230 as the neutrally buoyant characteristics of the casing does not add significant weight to the variable tension riser assembly 200 in the water.

Figure 14:
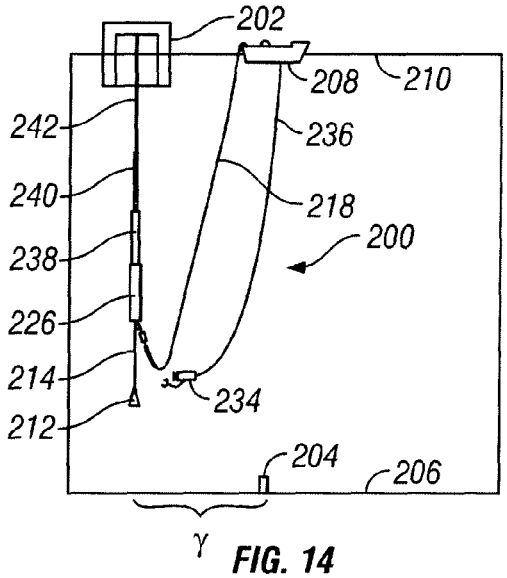

Referring to FIG. 14, a buoyancy transition region 242 is paid out from floating platform 202 while ballast 228, 230 is adjusted and maintained by workboat 208. As before, an ROV is able to assist with fine-tuning of the ballast amount and the directing of variable tension riser assembly 200. As before, variable tension riser assembly 200 is still deployed substantially vertically from floating platform so that deflection distance $\gamma$ is still present. Water currents and other conditions affecting installation may necessitate that more than one set of guides, ballast lines, or surface work-vessels can be used during riser installation. A separate vessel can be used for ROV deployment and operation.

Figure 15:
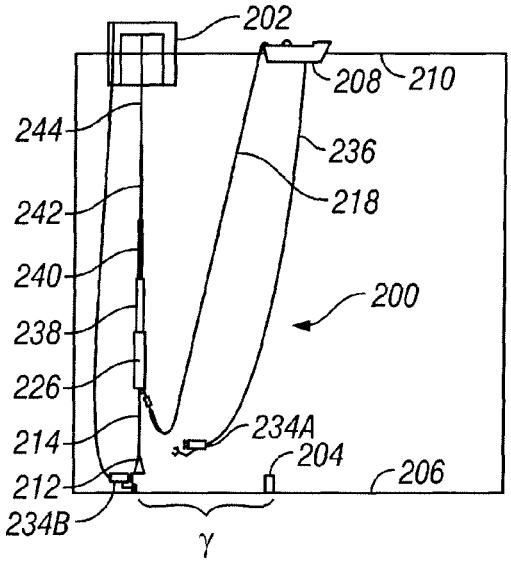

Referring to FIG. 15, an upper length of slick pipe 244 is lowered from floating platform 202. At this point, a second ROV 234B can be deployed to assist first ROV 234A in the manipulation and direction of variable tension riser assembly 200 and ballast line 218, including chains 228 and 230. As before, variable tension riser assembly 200 is deployed from floating platform 202 substantially vertical, being offset from wellhead 204 at ocean floor 206 by a deflection distance $\gamma$. In FIG. 15, the variable tension riser assembly 200 is deployed enough such that stress joint and wellhead connector 212 is at approximately the same depth as wellhead 204, separated only by deflection distance $\gamma$.

Figure 16:
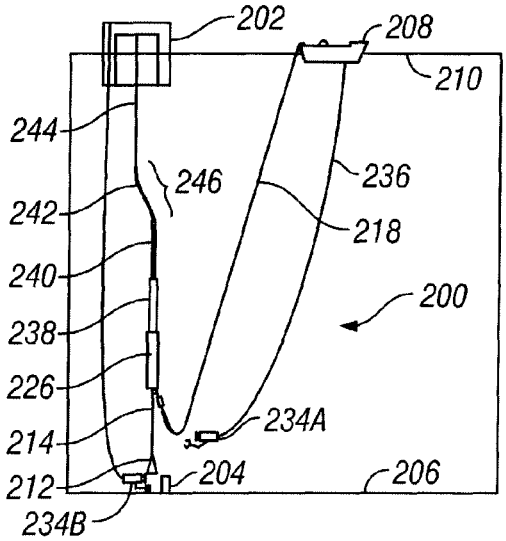

Referring to FIG. 16, the lateral traversal of variable tension riser assembly 200 is undertaken. Workboat 208, through traversal across ocean surface 210 and through selectively paying out and taking up rope line 218 is able to laterally load variable tension riser assembly 200 to the lower end thereof toward wellhead 204 at ocean bottom. Furthermore, ROVs 234A, 234B provide thrusting and direction assistance to direct stress joint 212 at the end of variable tension riser assembly 200 to wellhead. During this displacement, transitional region 242 of variable tension riser assembly 200 begins to form an s-curve region 246 to accommodate the lateral translation thereof. Slick pipe 244 is paid out from floating platform 202 to accommodate in the transitional region 242 any reduction in overall length of variable tension riser 200 resulting from the creation of the s-curve region 246.

Figure 17:
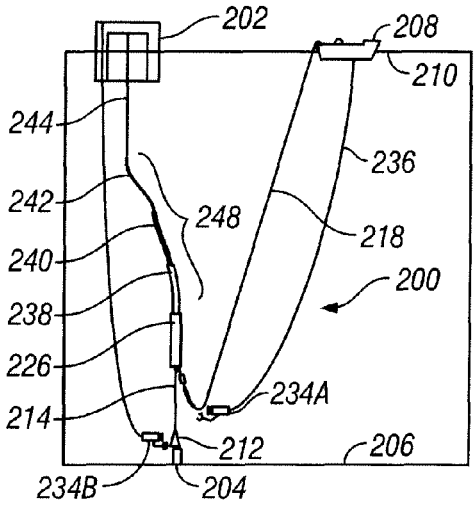

Referring to FIG. 17, the lateral translation of variable tension riser assembly 200 from a position under floating platform 202 to wellhead 204 proceeds with further assistance and direction from ROVs 234A, 234B, and workboat 208 and ballast line 218 (including chains 228, 230). As workboat 208 and ROVs 234A, 234B work together to direct stress joint 212 of variable tension riser assembly 200 toward wellhead 204, the s-curve begins to extend from the transitional section 242, to the light and heavy case sections 240, 238 to form a larger, more graduated s-curve region 248. As before, slick line 244 is paid out from floating platform 202 as needed to maintain the depth of the lower end of the variable tension riser 200.

Figure 18:
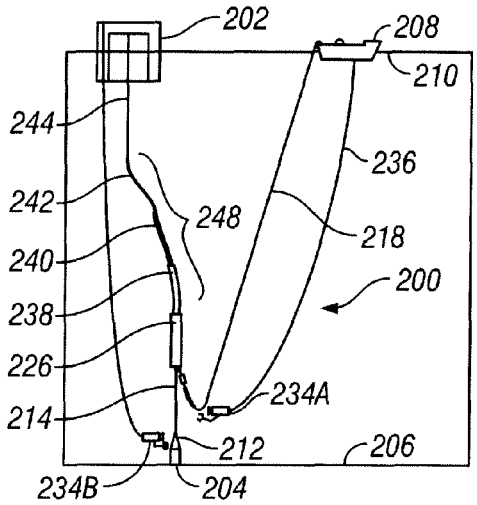

Referring now to FIG. 18, with the stress joint 212 of the variable tension riser assembly 200 properly positioned over wellhead 204, the topmost section of slick pipe 244 is lowered from floating platform 202 to allow a conventional wellhead connector (not shown), such as, for example a collet connector, at a distal end of stress joint 212 to engage with a corresponding socket at the top of wellhead 204. While slick pipe 244 is lowered from floating platform, ROVs 234A, 234B, in conjunction with workboat 208 and ballast line 218, assist in guiding the wellhead connector of variable tension riser assembly 200 into engagement with wellhead 204.

Figure 19:
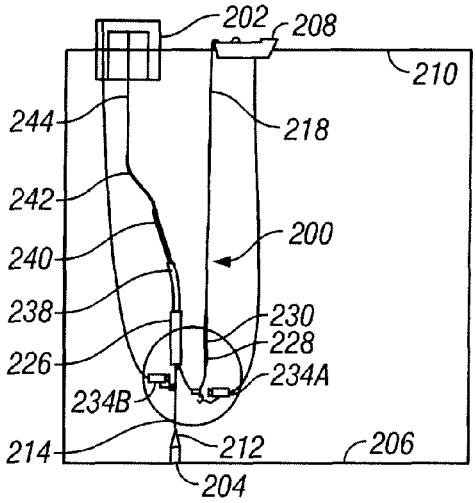
Figure 19A:
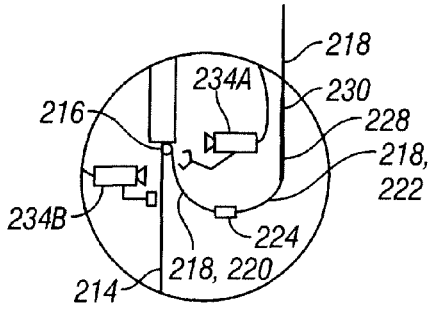
Figure 20:
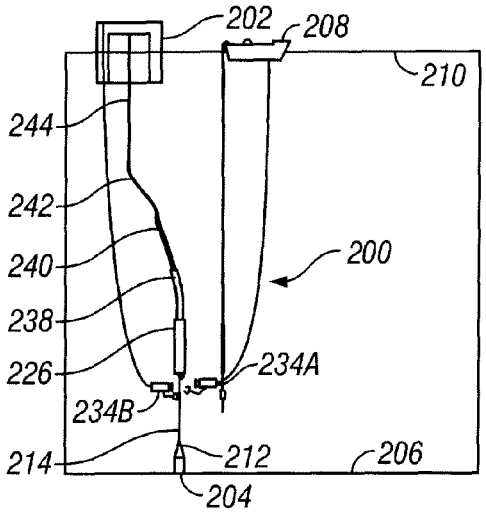
Figure 21:
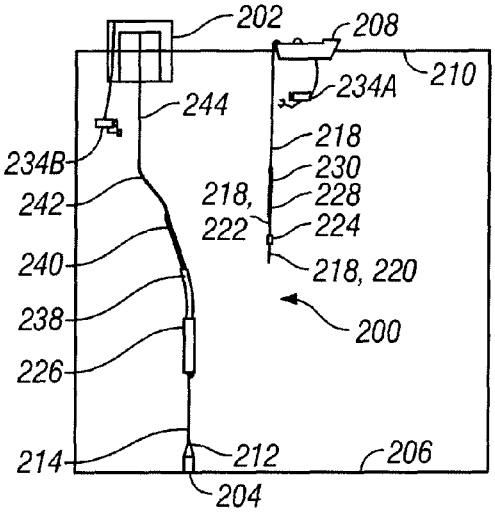

Referring to FIG. 19, workboat 208 positions itself over wellhead 204 and takes in ballast line 218 with attached ballast chains 228, 230. While ROVs 234A, 234B monitor the connection of ballast line 218 with variable tension riser assembly 200, workboat 208 takes in enough of ballast line 218 to remove the weight from chains 228, 230 from riser assembly 200. With the weight of ballast chains 228, 230 removed, buoyant section 226 of variable tension riser assembly is free to act upon slick pipe section 214 and wellhead connector 204, thereby placing the portion of variable tension riser assembly in tension, as designed.

Figure 22:
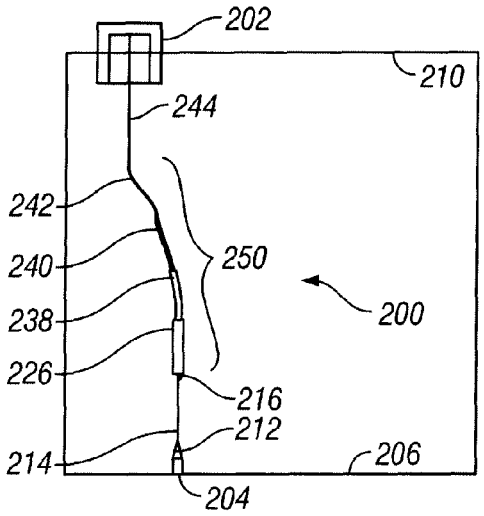

Referring to FIGS. 19A through 21, ROVs 234A, 234B disconnect rope ballast line 218 with attached chains 228, 230 from attachment point 216 so that it may be retrieved by a winch mounted aboard workboat 208. Referring briefly to FIG. 22, tension in top slick pipe section 244 is adjusted to its final value, resulting in final desired s-curve geometry 250 for sections 238, 240, and 242 of variable tension riser assembly 200.

Referring to FIGS. 19A through 21 again, the ROVs 234A, 234B can disconnect rope ballast line 218, 220 from attachment point 216 for retrieval. Alternatively, the operator can "park" the ballast chains 228, 230 on seabed 206 to simplify future relocation or retrieval of riser 200. The need for controlled vertical force applied to riser 200 until the base of riser 200 is mechanically connected to wellhead 204 can complicate the parking process. To park chain 228 on seabed 206, in one embodiment, ballast attachment point 216 can be lowered, or alternatively a means to reel out additional ballast rope 220 can be employed. Ballast chains 228, 230 are not in contact with the seabed at the completion of riser installation due to the height of attachment point 216 from seabed 206. Chain 228 can be simply lowered to seabed 206, remaining attached at attachment point 216, if a variable force continuously applied to riser 200 at ballast chain attachment point 216 and any adverse affect on the in-place behavior of riser 200 throughout its operational life can be tolerated. Adjusting the overall length of attachment rope 220 such that chain 228 can be lowered to seabed 206 without resulting in a variable force is also an option if a simple installation process is not required.

As illustrated in FIGS. 35 through 40, additional components and steps can be used to park the ballast chain 228. The length and weight of ballast attachment rope line 220 and ballast chain 228 are selected so that installation and deployment of variable tension riser 200 can be accomplished substantially as described above with respect to FIGS. 6-18. In this embodiment, rope line 220 can be a light weight ballast attachment rope.

Figure 35:
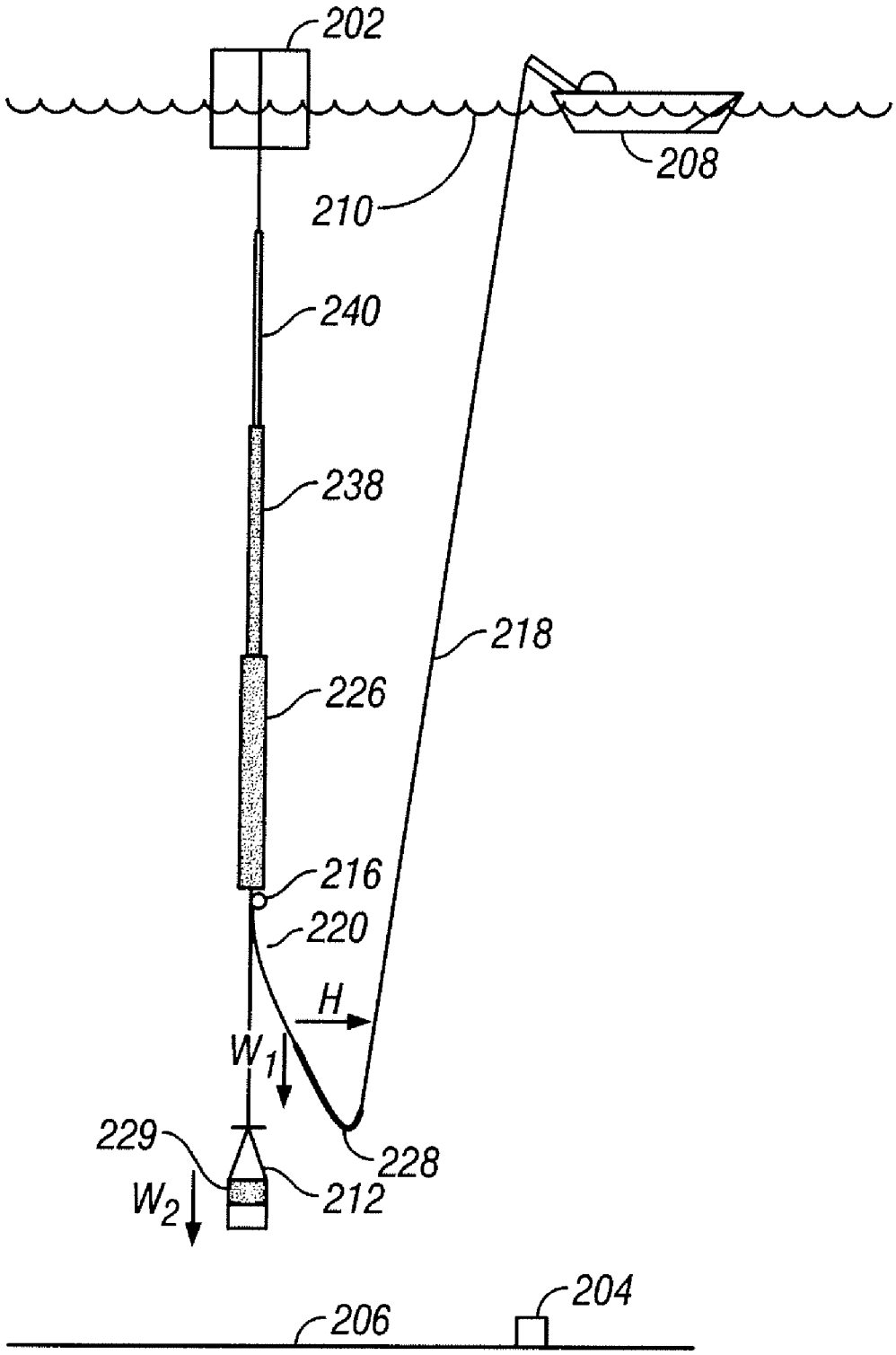
FIGS. 35-40 are schematic side view drawings showing additional steps to park the ballast chain used to install a variable tension riser from a floating production facility on the seabed in accordance with an embodiment of the present invention.

Nearing the end of the installation process, and referring now to FIG. 35, light ballast attachment rope 220 is attached to attachment point 216 on riser 200 just below buoyancy module 226. Chain 228 is shown in its typical catenary configuration; at the upper end of chain 228 there is a horizontal force component H which can move the base of riser 200 laterally, and a downward vertical component W1. Force W1, combined with vertical force W2 from added ballast weight or clump weight 229 at the base of riser 200, can offset the effect of the buoyancy modules 226, 238, 240 above attachment point 216. The result is that, at any time, the base of riser 200 can be maintained at the desired coordinates.

Figure 36:
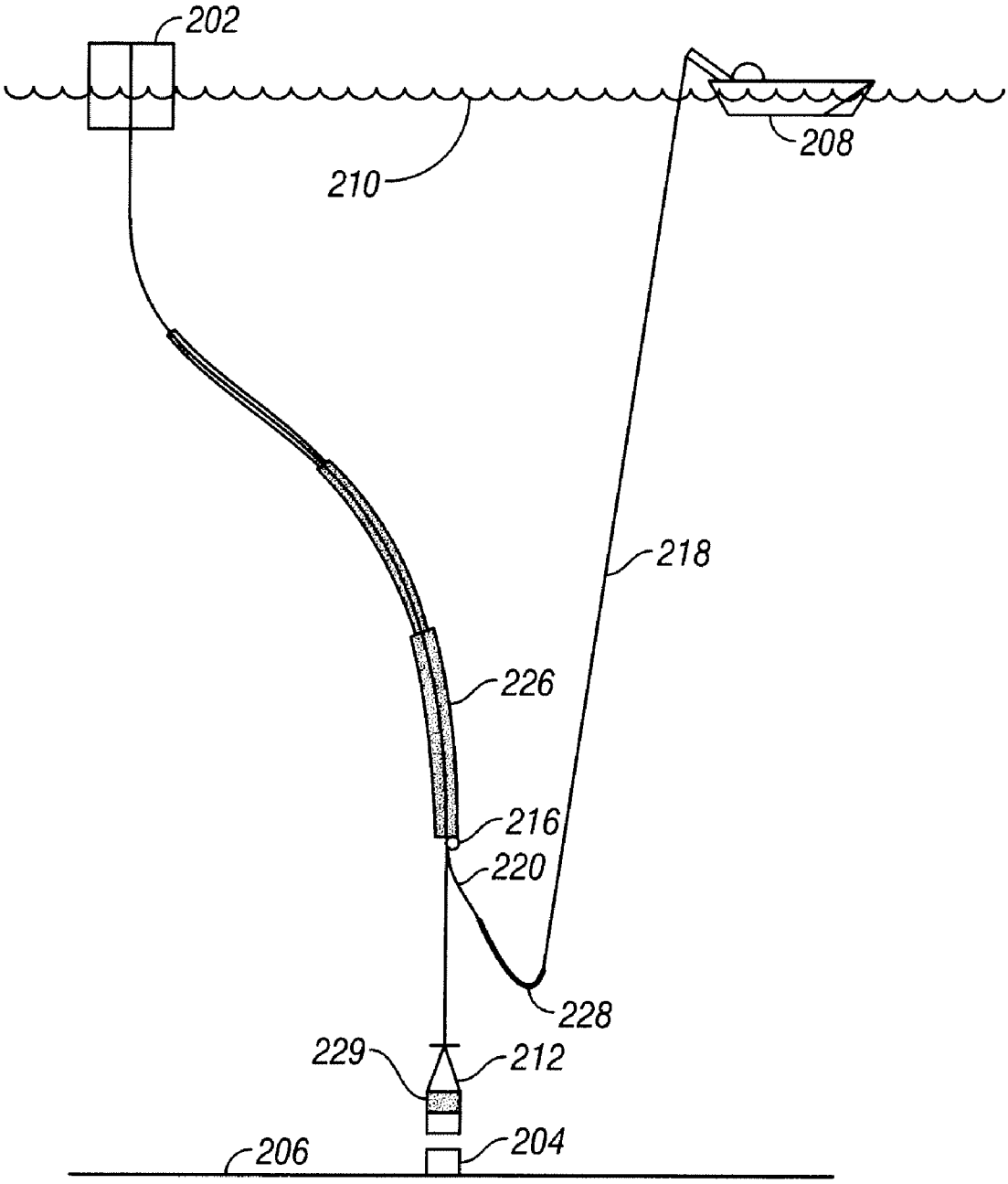

Referring now to FIG. 36, riser 200 is shown just prior to making the final connection to wellhead 204, and the s-curve in riser 200 is now pronounced. The "sag bend" of ballast chain 228 can be hundreds or thousands of meters above seabed 206. After the final connection is made, the process to park chain 228 on seabed 206 in this embodiment can commence, and begins by lowering attachment point 216 (or reeling out light attachment rope 220). If attachment point 220 is lowered only a hundred or thousand meters or so (a few hundred or thousand feet), care should be taken to avoid ballast chain 228 contacting wellhead 204 or variable tension riser 200 when ballast chain 228 is disconnected from rope 218.

Figure 37:
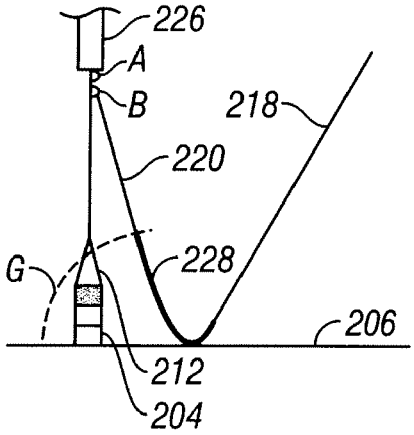

Referring now to FIG. 37, connection point 216 can be lowered from point A to point B along riser 200, allowing the sag bend of chain 228 to rest on seabed 206. At this point, if the top of ballast attachment rope 220 is lowered or reeled out, care should again be taken that ballast chain 228 does not come into contact with wellhead 204, as illustrated by the arc line G.

Figure 38:
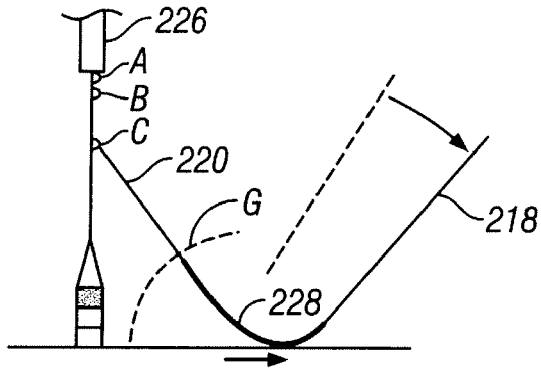
Figure 39:
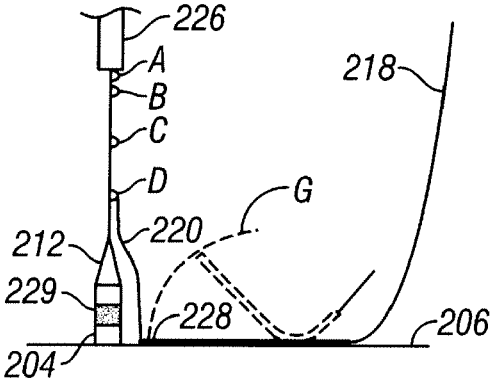
Figure 40:
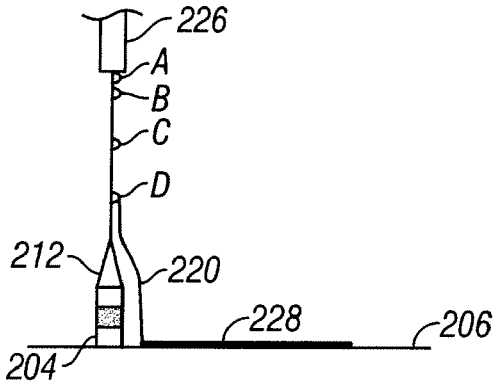

Referring now to FIGS. 38-40, through a combination of further reeling out ballast attachment rope 220 or further lowering ballast attachment point 216 and movement of installation vessel 208, ballast chain 228 can be moved away from wellhead 204. The distance that chain 228 is moved can be sufficient for the end of chain 228 to avoid contacting the wellhead 204. Ballast attachment point 216 can be further lowered (or rope 220 reeled out) so that the end of ballast chain 228 has been placed on seabed 206 and ballast attachment rope 220 is slack. Sufficient rope 218 can be reeled out from the installation vessel 208 such that the entire chain 228 rests on seabed 206. The bottom end of the installation rope 218 can be detached and retrieved, the installation system locked in place, and any external devices used during the installation of riser 200 can be removed. Riser 200 can now move unhindered by the installation attachment rope 220 or ballast chain 228, and ballast chain 228 is conveniently parked for future use when moving or retrieving variable tension riser 200.

Figure 23:
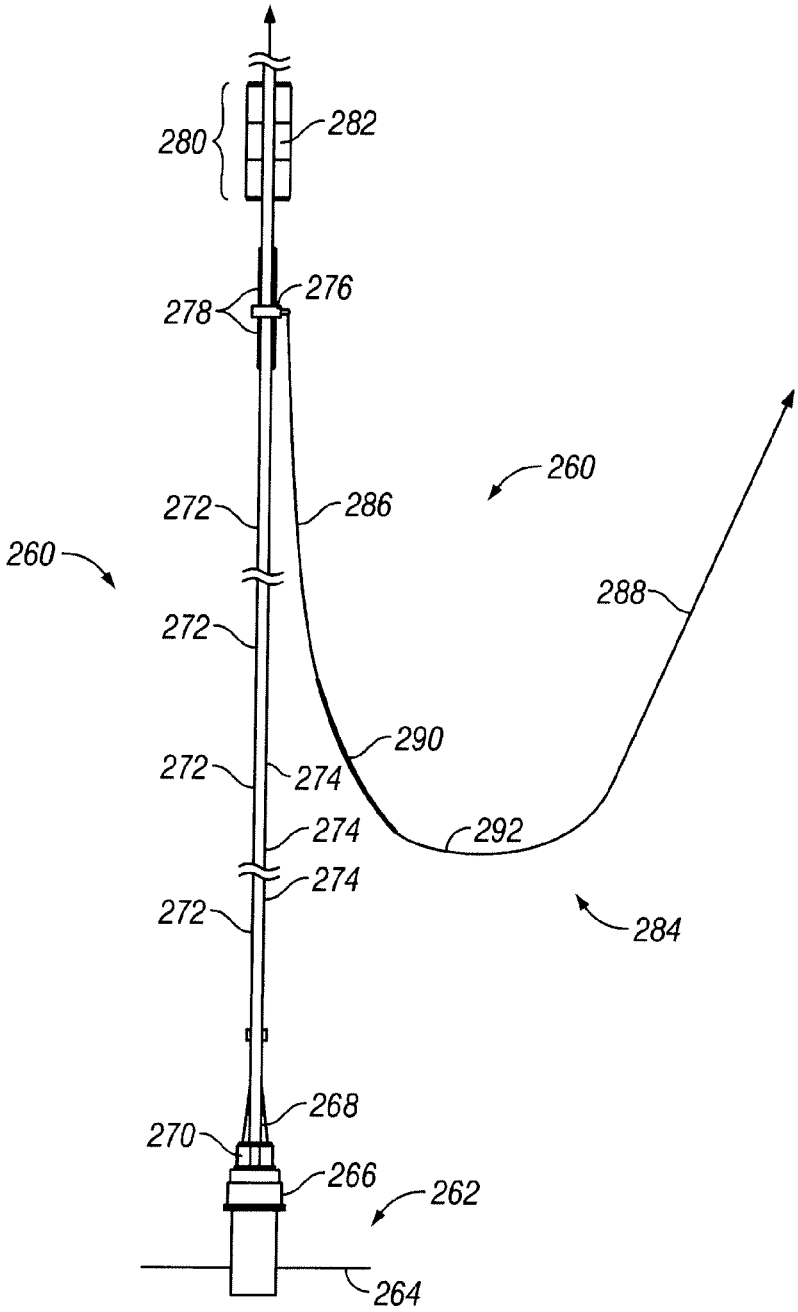
FIG. 23 is a schematic side view drawing showing components of a ballast installation chain in accordance with an embodiment of the present invention.

Referring now to FIG. 23, an installed variable tension riser assembly 260 is more clearly visible. Variable tension riser assembly 260 extends upward from a wellhead assembly 262. Wellhead assembly 262 extends from the mud line 264 on the sea floor and includes a tieback connector 266. Variable tension riser 260 can include a stress joint 268 at its lower end for connection to wellhead assembly 262. Optionally, a ballast weight 270 can be located at a distal end of stress joint 268 to assist in the seating of variable tension riser assembly 260 upon wellhead 262. Extending upward from stress joint 268, variable tension riser 260 can include a bottom region of slick pipe sections 272 connected together by pipe connections 274. Variable tension riser 260 can include a pad-eye connection point 276 where a tension line can be attached. Stress-relief subs 278 can be located above and below connection point 276 to prevent damage to variable tension riser assembly 260 when loads are applied. Furthermore, the lowermost buoyancy region 280 of variable tension riser assembly 260 can be located above connection point 276 and stress relief subs 278. Buoyancy region 280 can be constructed as a string of pipe joints with attached buoy members 282 known to one of skill in the art.

Extending from connection point 276, a ballast and tension line assembly 284 is attached. Ballast and tension line assembly 284 can include sections of synthetic line 286, 288, a main, heavy, ballast chain 290, and a fine-tuning, light, ballast chain 292. Synthetic line sections 286 can conveniently be constructed as a 15 cm (6-inch) diameter polyester rope, but can be of any style and type known to one of ordinary skill in the art. Heavy main ballast chain 290 is conveniently constructed as a 15 cm (6-inch) stud-link chain approximately 200 m (650 feet) long and weighing about 82000 kg (180,000 pounds) in water. Fine-tuning ballast chain 292 is conveniently constructed as a 7.6 cm (3-inch) stud-link chain approximately 150 meters (500 feet) long and weighing 18200 kg (40,000 pounds) in water.

Figure 24:
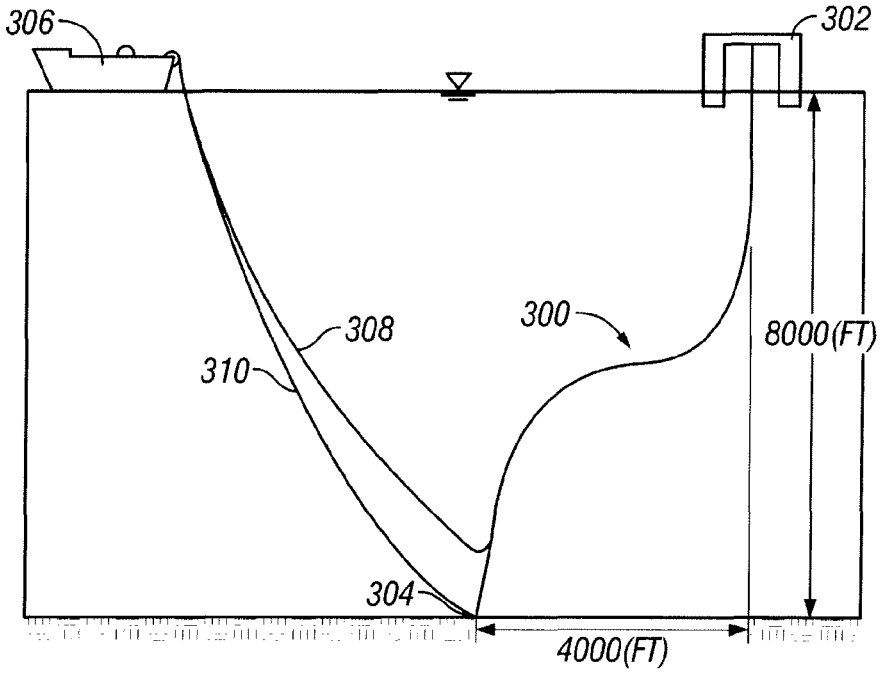
FIG. 24 is a schematic side view drawing illustrating the deployment of ballast line and control line as part of a variable tension riser installation procedure in accordance with an embodiment of the present invention.

Referring now to FIG. 24, a variable tension riser 300 extends from a floating platform 302 to a subsea wellhead 304. A workboat 306 assists in the installation of riser 300 by supplying a pair of tension and control lines 308, 310. Weight control line 308 typically counteracts any buoyancy in variable tension riser 300 while it is deployed from floating platform 302 by employing rope line and various ballast chains as described above. Angle control line 310 helps manipulate the connection end of variable tension riser 300 so that it will properly mate up with a tieback connector (not shown) of wellhead 304. Optionally, angle control line 310 may be supplemented or replaced by one or more subsea ROVs to help guide variable tension riser 300.

Furthermore, examples for various depths and geometries are apparent in FIG. 24. While the numbers shown are representative of one embodiment of the present invention, they are by no means limiting. Deeper and shallower depths for variable tension riser 300 are feasible and the specific geometries for each installation are unique and depend on a variety of factors. Particularly, wellhead 304 is shown at a depth of 2440 m (8,000 feet) of water and displaced 1220 m (4,000 feet) away from platform 302. For this particular installation, weight control line 308 is located above a distal end of variable tension riser 300. While the absolute limits of embodiments of the present invention are not known, it is expected that water depths from 1525 to 3050 m (5,000 feet to 10,000 feet) are easily feasible with wellhead deviations within one half of the vertical depth, and may be feasible with wellhead deviations up to or even greater than the vertical depth. For example, for a 3050 m (10,000 feet) deep cluster of subsea wellheads, embodiments of the present invention can be used to tie back multiple subsea wellheads to a single floating platform, provided that the farthest wellhead from the floating platform is 1525 m (5,000 feet) or closer for a 50% deviation. In other embodiments, where the deviation is equal to the vertical depth, for a 3050 m (10,000 feet) deep cluster of subsea wellheads, embodiments of the present invention can be used to tie back multiple subsea wellheads to a single floating platform where the farthest wellhead from the floating platform can be 3050 m (10,000 feet) or more.

Figure 25:
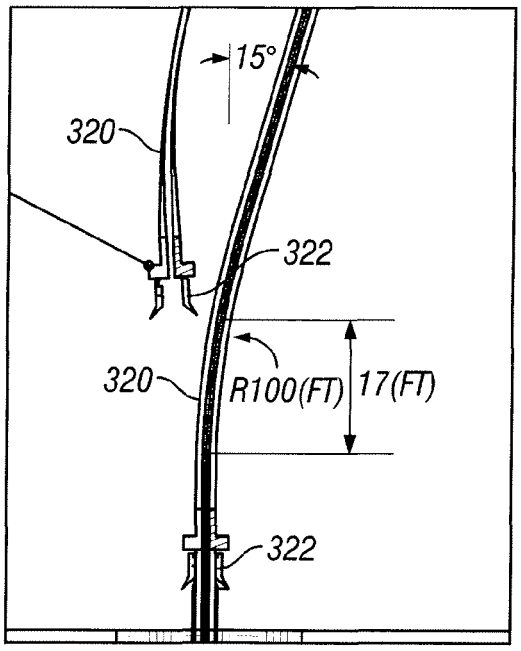
FIG. 25 is a schematic side view drawing of a variable tension riser having a tapered stress joint mounted thereupon in accordance with an embodiment of the present invention.
Figure 26:
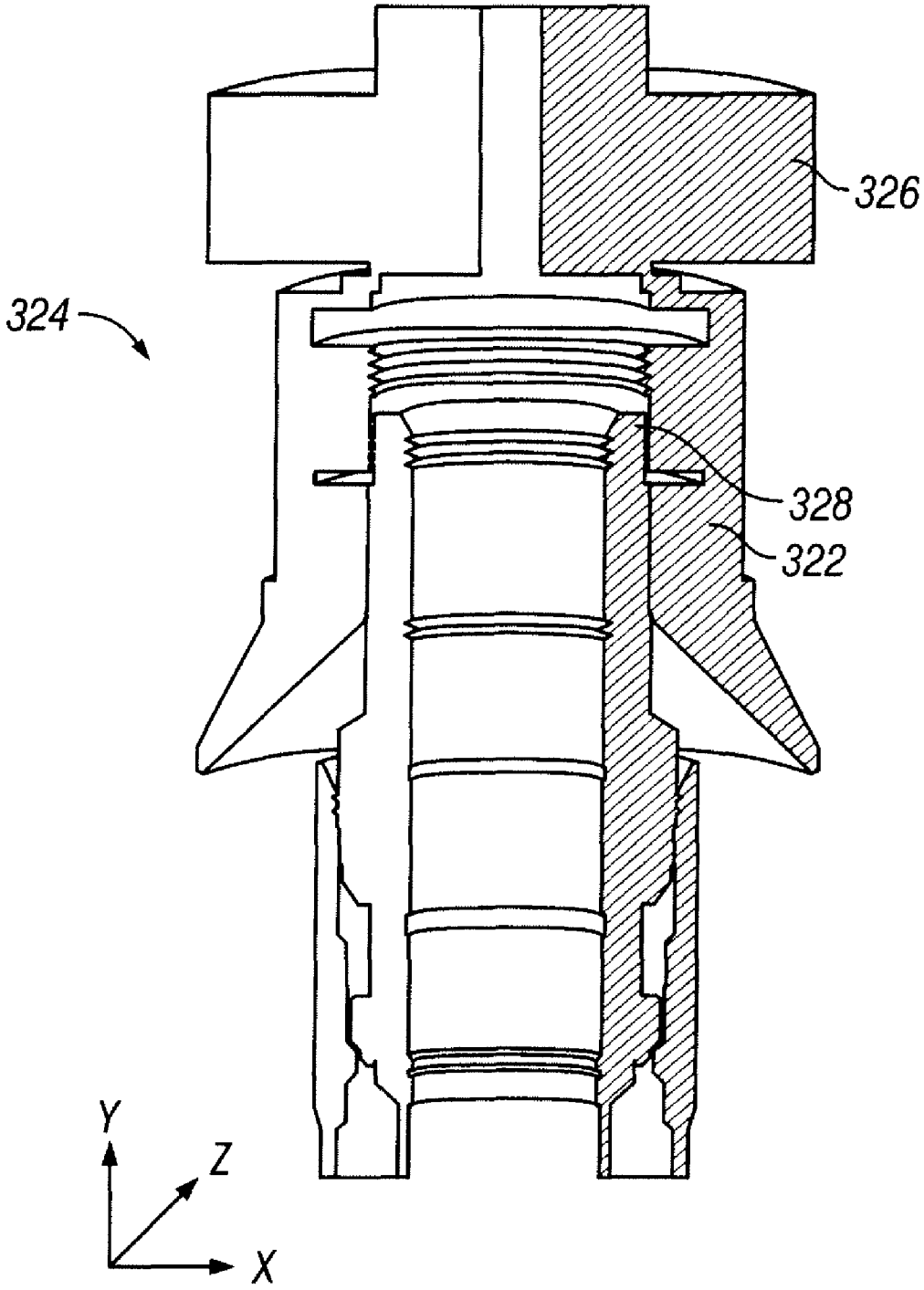
FIG. 26 is a section view drawing of a subsea wellhead having a wellhead connector and a tapered stress joint in accordance with an embodiment of the present invention.

Referring collectively to FIGS. 25 and 26, a tapered stress joint 320 and a wellhead connector 322 for a variable tension riser are shown. Tapered stress joint 320 can be constructed to allow bending and deflection of a variable tension riser. Depending on wellhead location, tapered stress joint 320 can be constructed as a pre-curved member, thereby further reducing the amount of stress experienced by tapered stress joint 320 when the variable tension riser assembly is displaced. FIG. 25 details a tapered stress joint 322 that is curved at a slight radius of approximately 30 m (100 feet) at a distance approximately 5.2 m (17 feet) above a wellhead connector 322. This slight radius, shown for example only and not intended to limit any embodiment of the present invention to a particular geometry, is used so that stress may be removed from wellhead connector 322 while still allowing the passage of relatively rigid tools and servicing equipment. Following the curved radius portion, the remainder of the variable tension riser assembly is shown deflected away from wellhead at a representative angle of approximately 15° from vertical. Referring now to FIG. 26, wellhead assembly 324 includes wellhead connector 322 disposed at a distal end 326 of the variable tension riser and a wellhead tieback connector 328. Wellhead connector 322 is designed to engage wellhead tieback connector 328 to form a rigid, sealed connection to facilitate communication (hydraulic, electrical, mechanical, etc.) between the variable tension riser and the wellhead. While one specific design for wellhead assembly 324 is shown, it will be understood by one skilled in the art that various future and current designs for wellhead assembly 324 and its components can be used without departing from the spirit of the embodiments of the present invention.

Figure 41:
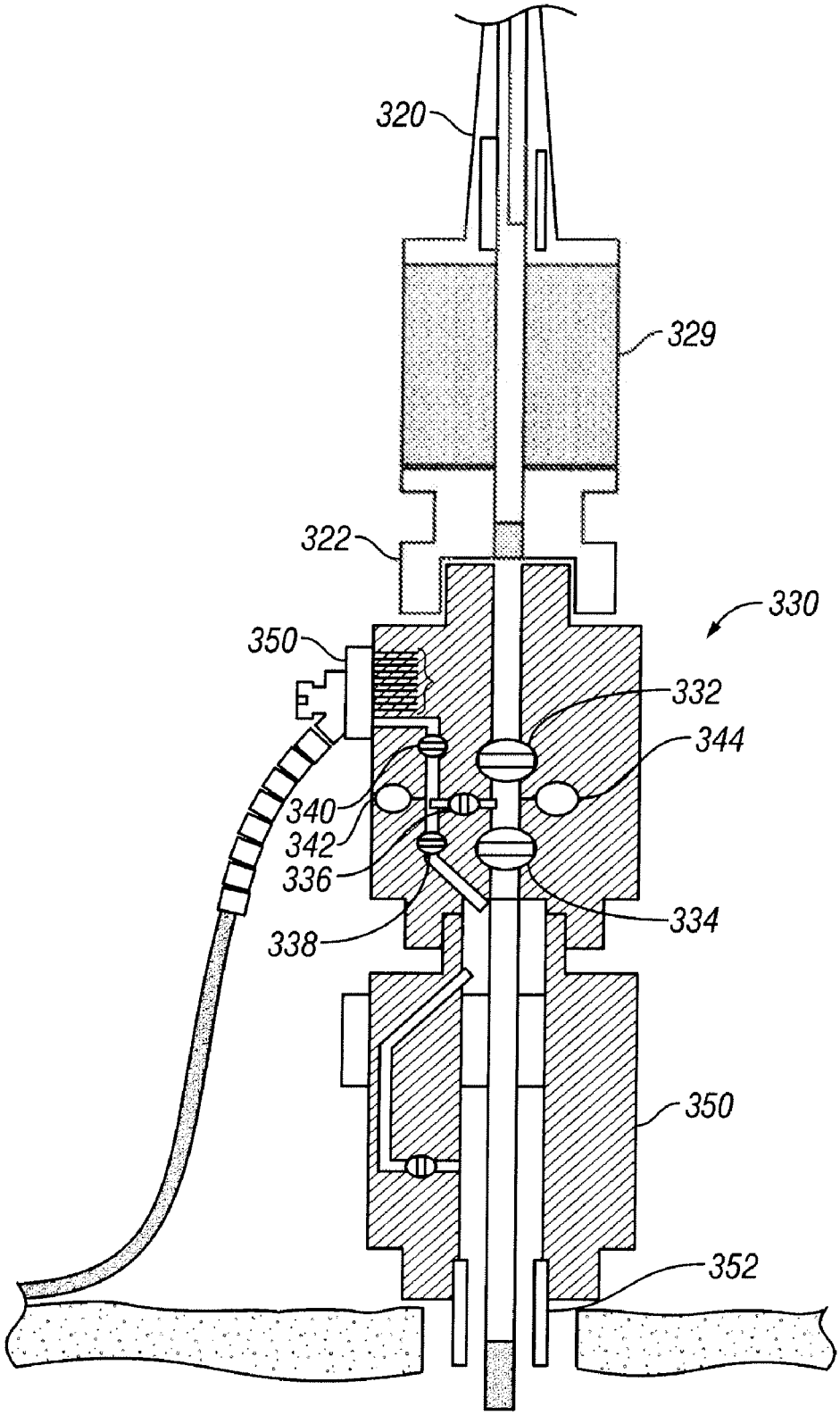
FIG. 41 illustrates a mud-line package connected to the wellhead according to an embodiment of the present invention.
Figure 42:
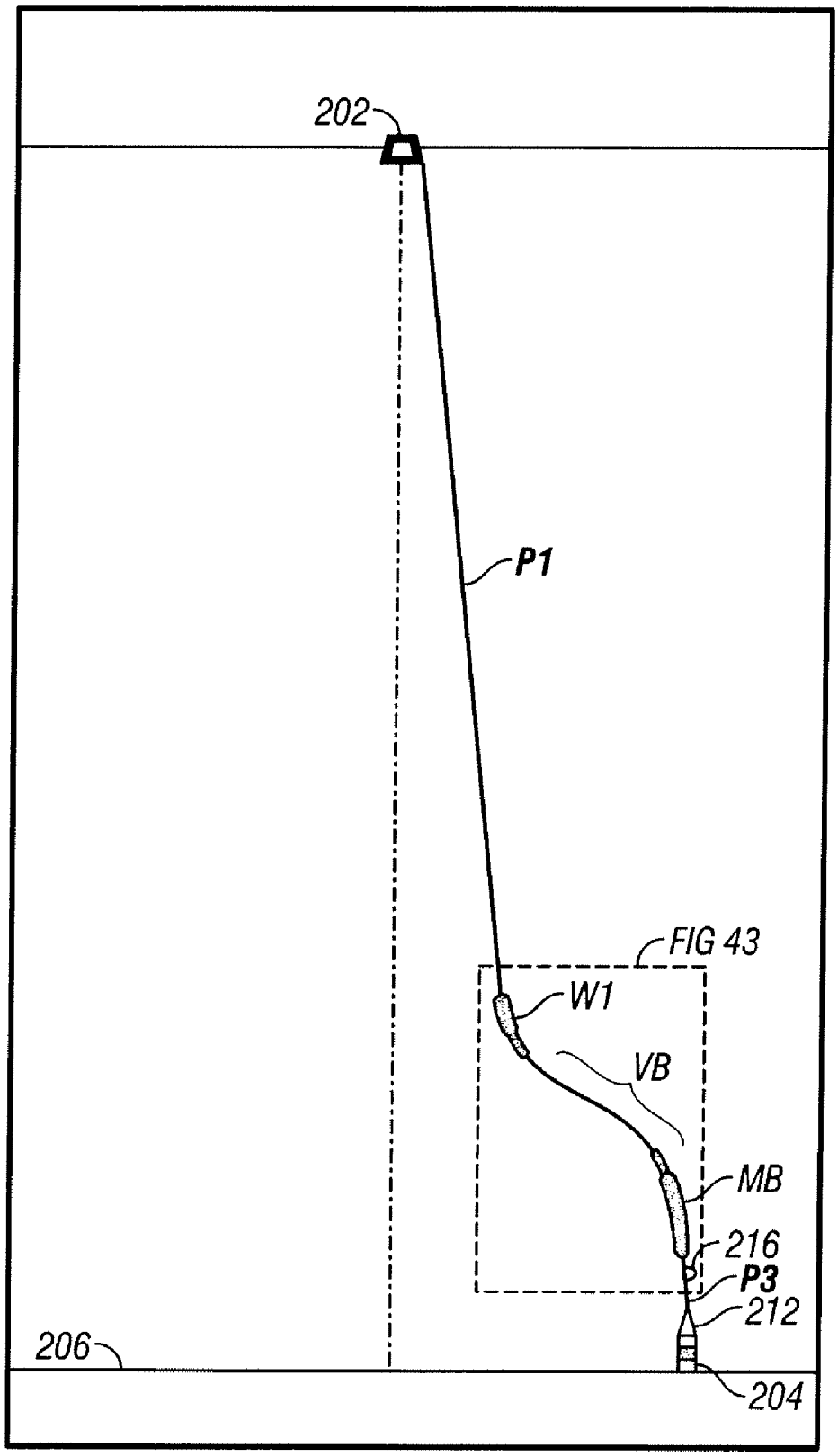
FIGS. 42-46 illustrate a weighted and buoyed variable tension riser according to an embodiment of the present invention.
Figure 43:
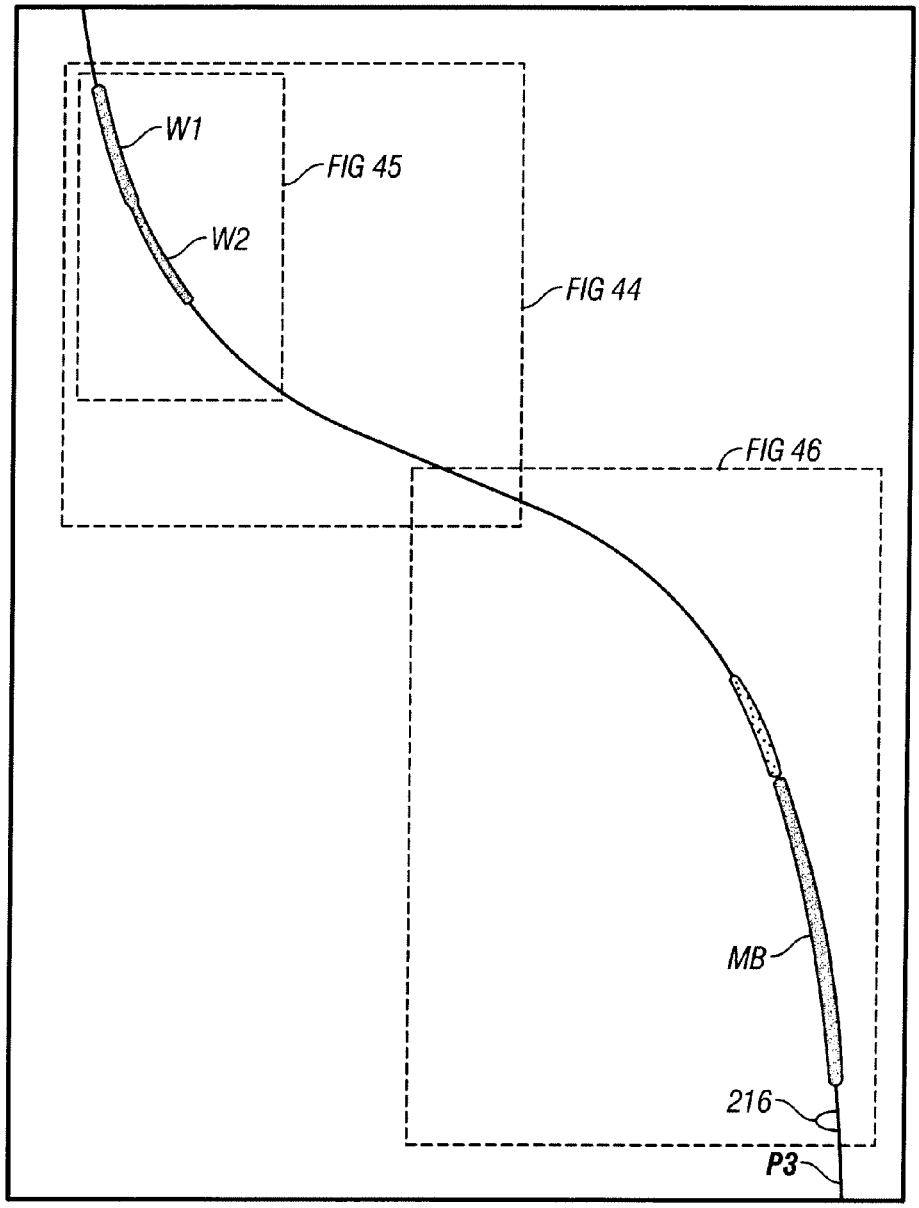
Figure 44:
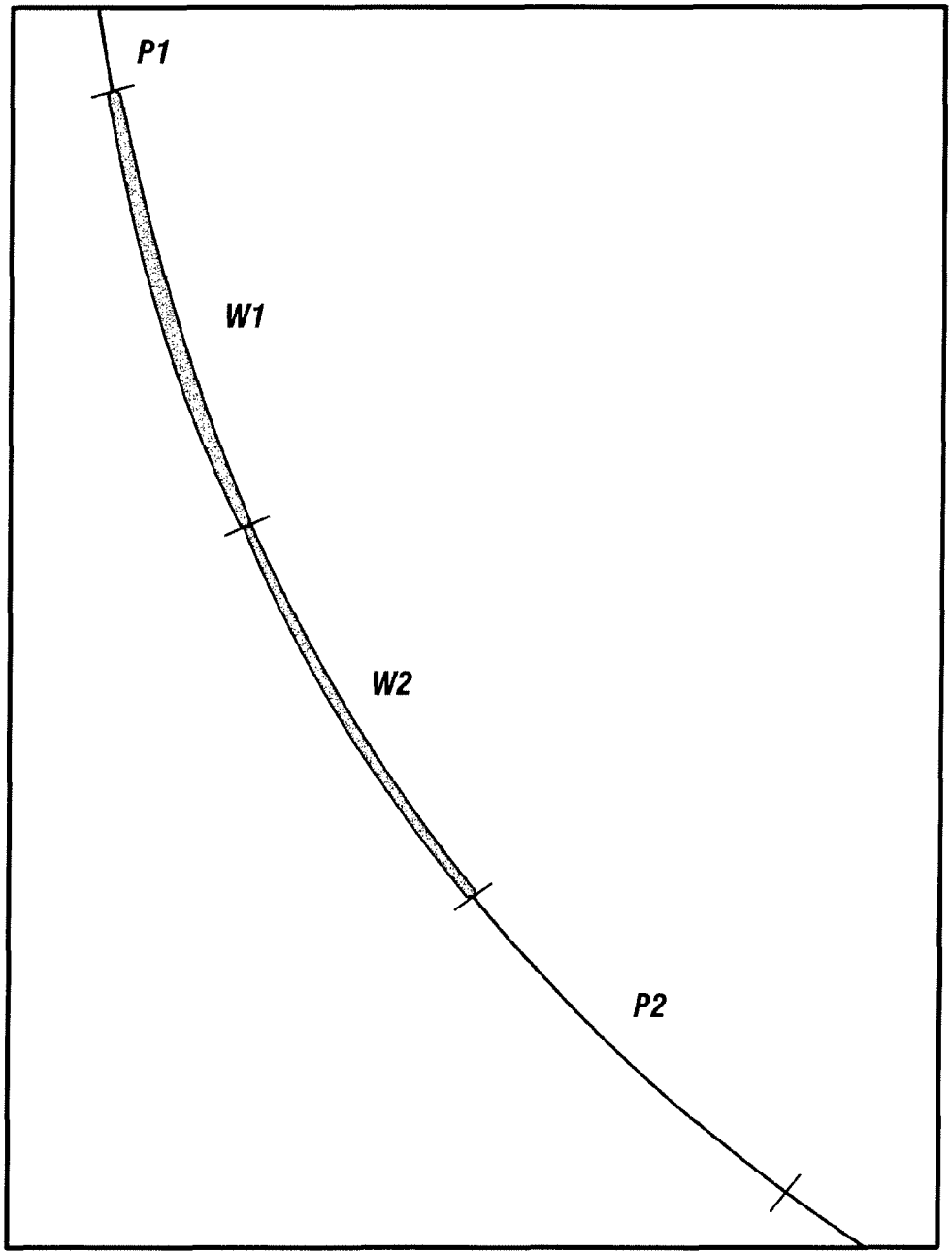
Figure 45:
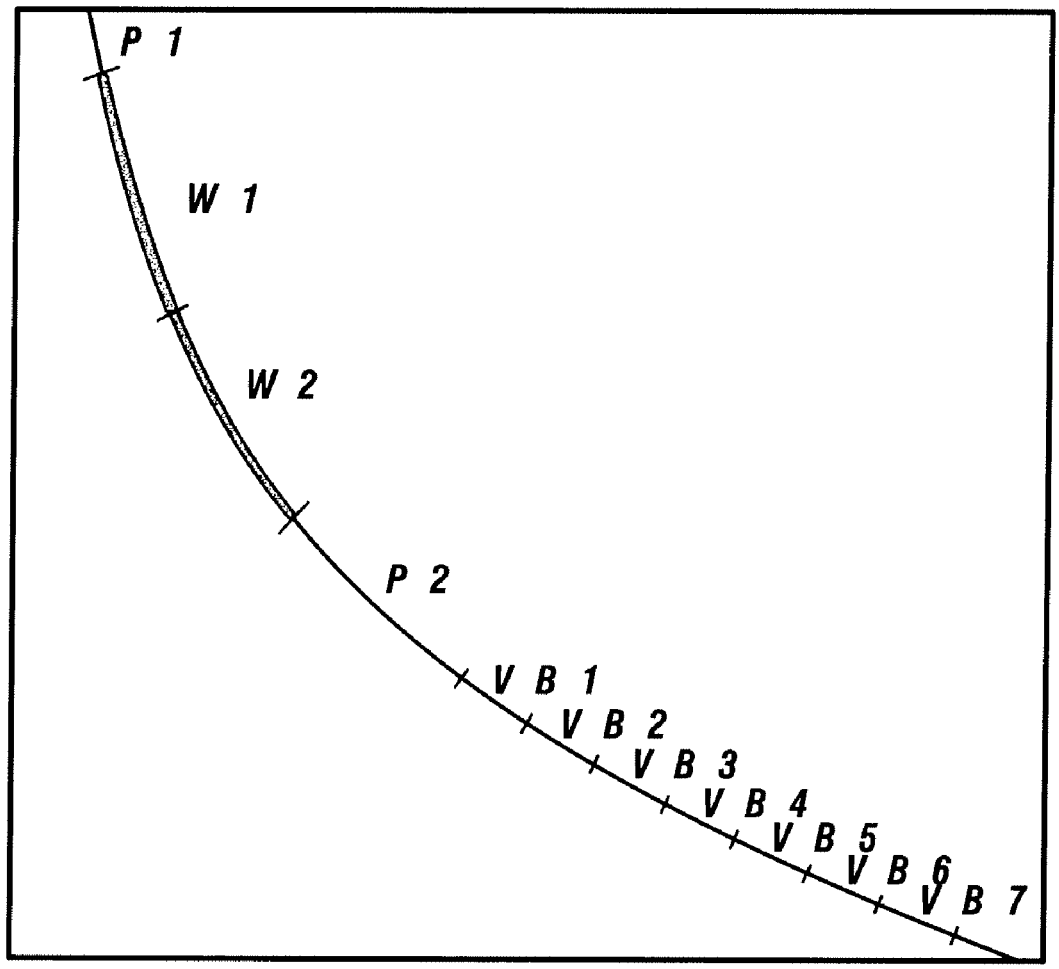
Figure 46:
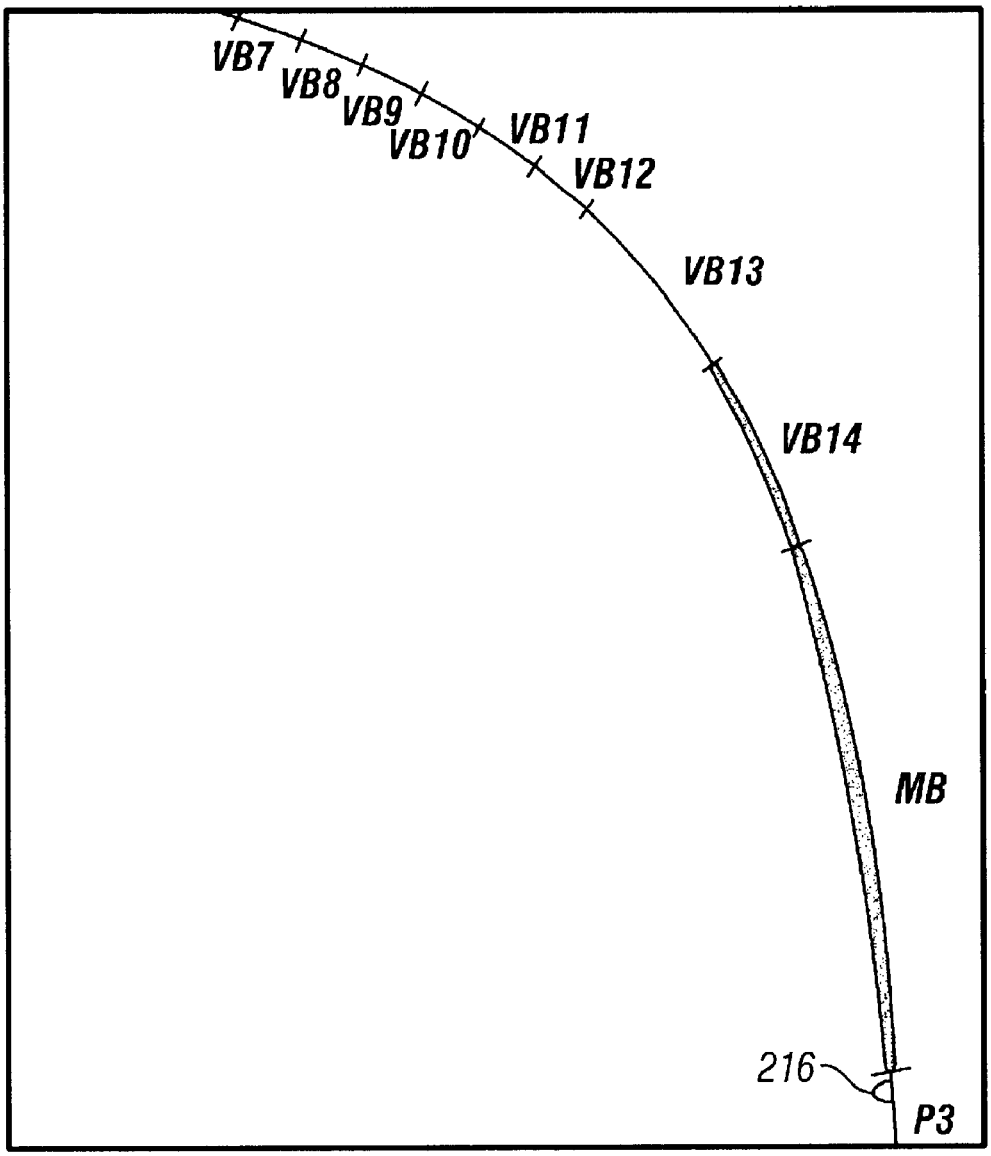

As illustrated in FIG. 41, connection of the riser to the wellhead or to a manual isolation valve located at the top of the wellhead system can also include ballast weight 329 or equipment such as mud-line package 330, which can limit or prevent undesired hydrocarbon releases due to downstream equipment failure. Ballast weight 329 can decrease or eliminate the need for ballast chains connected to the riser, requiring use of the guide rope only for directing or guiding the riser during placement. Stress joint 320 can be connected to mud-line package 330 having upper and lower master valves 332, 334, cross over valve 336, annulus master valve 338, wing valve 340, annular pressure sensor 342, production line pressure-temperature sensor 344, chemical injection valves (not shown), and so on. Mud-line package 330 can be connected to a tubing spool and tubing hanger 346 attached to wellhead 348. Mud-line package 330 can also include electrical connections, a hydraulic flying lead or an umbilical J-plate 350, providing annulus access, to allow chemical injection, or to cooperate with surface controlled subsurface safety valves (not shown). The release protection obtained by use of mud-line package 330 can enable the riser to be a tubing riser, eliminating the need for pipe-in-pipe installation, further decreasing installation costs. An operator can perform minor workover operations through mud-line package 330. Major workover operations can be performed by relocating the riser and mud-line package to a parking stump. Alternatively, the riser can be relocated to a parking stump, and the mud-line package can be retrieved prior to workover operations. The mudline package can be configured to include lift pumps, which can increase the cost effectiveness of the development of ultra-deepwater oil reserves. A Coiled Tubing Deployed Electric Submersible Pump (CTDESP) can also be used for deep and ultra-deepwater wells. A CTDESP deployed into a subsea well through the variable tension riser of the present invention can allow low cost maintenance of the Electric Submersible Pump (ESP) as the ESP can be retrieved through the variable tension riser to the surface for maintenance.

Figure 27:
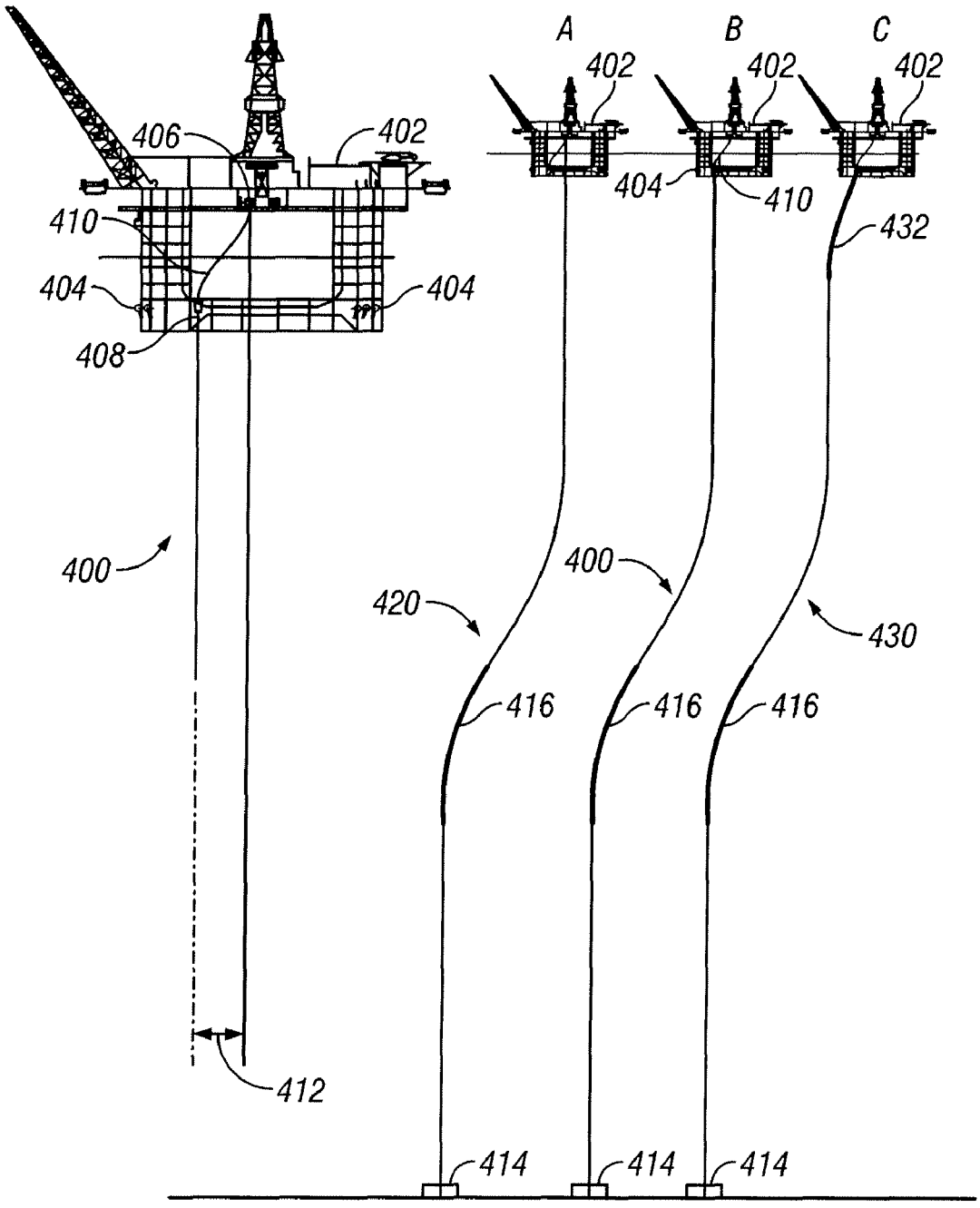
FIG. 27 is a schematic side view drawing of a floating platform with a variable tension riser extending therefrom in accordance with an embodiment of the present invention.

Referring to FIG. 27, variable tension riser assembly 400 extends from floating platform 402 to a subsea wellhead (not shown). Floating platform 402 can include flotation pontoons 404 and a dry tree 406. Dry tree 406 includes the valves and controls necessary to control and service the subsea wellhead at the end of variable tension riser 400. Variable tension riser 400 differs from other illustrated embodiments of the present invention in that the uppermost end 408 of variable tension riser 400 is terminated at pontoon 404 of platform 402 rather than at dry tree 406. Variable tension riser 400 thus can include a rigid curved spool connection 410 to connect dry tree 404 with the upper end of variable tension riser 400 terminated at pontoon 406. The benefit of terminating riser 400 at pontoon 406 is that an offset 412 from the center of platform 402 can be created. Offset 412 is beneficial in that it helps mitigate the potential for riser-to-riser contact when multiple risers are tied back to the floating production facility.

Referring briefly to FIG. 27B, variable tension riser assembly 400 is visible along its entire length from platform 402 to wellhead 414. Variable tension riser 400 includes an s-curve region 416 and is terminated at pontoon 404 with spool connection 410 to dry tree 406. In contrast, FIG. 27A shows a variable tension riser assembly 420 of previous embodiments, whereby riser 420 extends from wellhead 414 to the dry tree without the use of a termination at pontoon 404 or a spool connection 410. Furthermore, another alternative variable tension riser 430 is shown in FIG. 27C wherein variable riser 430 terminates at pontoon 404 with a spool connection 410 making the connection to dry tree 406. However, variable tension riser 430 includes an additional curved section 432 extending from pontoon 404 to just below platform 402. This additional curved section 432 helps reduce any stress that may result from terminating variable tension riser 430 at pontoon 404 of platform 402.

Figure 28:
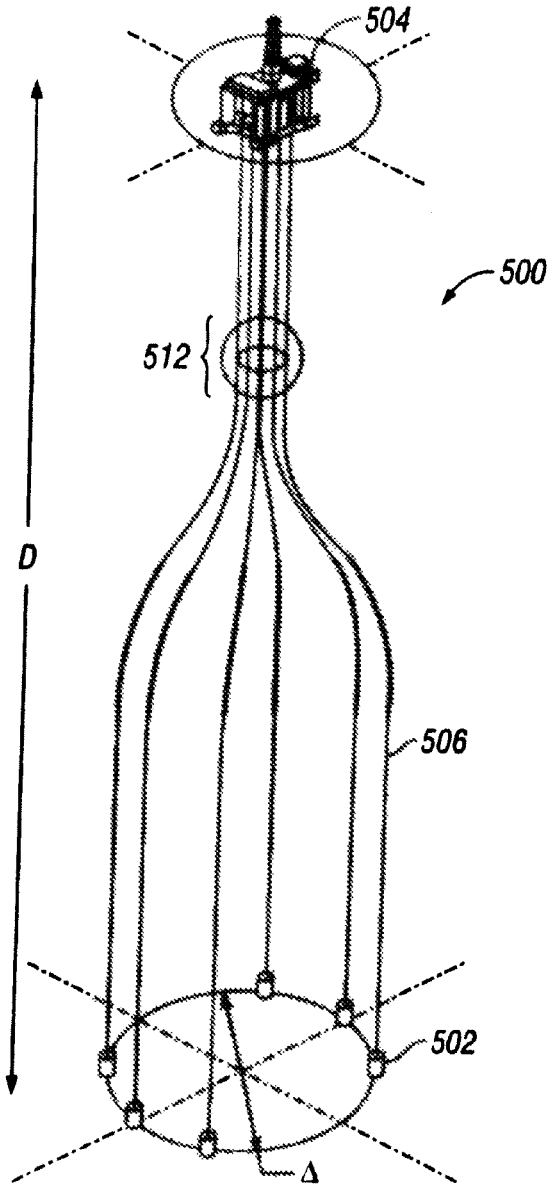
FIGS. 28 and 28A are schematic side view drawings of a floating platform with a plurality of variable tension risers interconnected at one location in accordance with an embodiment of the present invention.
Figure 28A:
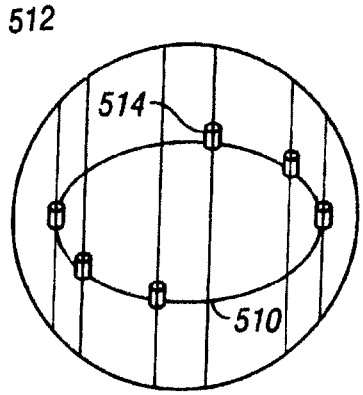

Referring to FIGS. 28 and 28A, an alternative subsea well management system 500 can include a plurality of subsea wellheads 502 connected to a floating platform 504 through a plurality of variable tension risers 506 across a water depth D. Variable tension risers 506 can include neutral buoyancy regions 508. Wellheads 502 are located within a grouping characterized by diameter A. However, well management system 500 also includes a spacer ring assembly 510 located at a lower end of the upper slick pipe region 512 of variable tension risers 506. While shown schematically as a circular ring, spacer ring assembly 510 can be constructed as any rigid geometry or shape design as desired and as construction permits. The spacer ring can include axial journals 514 connecting each variable tension riser 506 to ring 510. Axial journals 514 operate to allow relative axial movement between risers 506 and ring 510. Using spacer ring 510, some movement and compliance of risers 506 is permitted while still maintaining radial spacing of each riser 506. The goal of spacer ring 510 is to maintain clearance between variable tension risers 506 during all anticipated loading and turbulence conditions.

Figures 29, 29A:
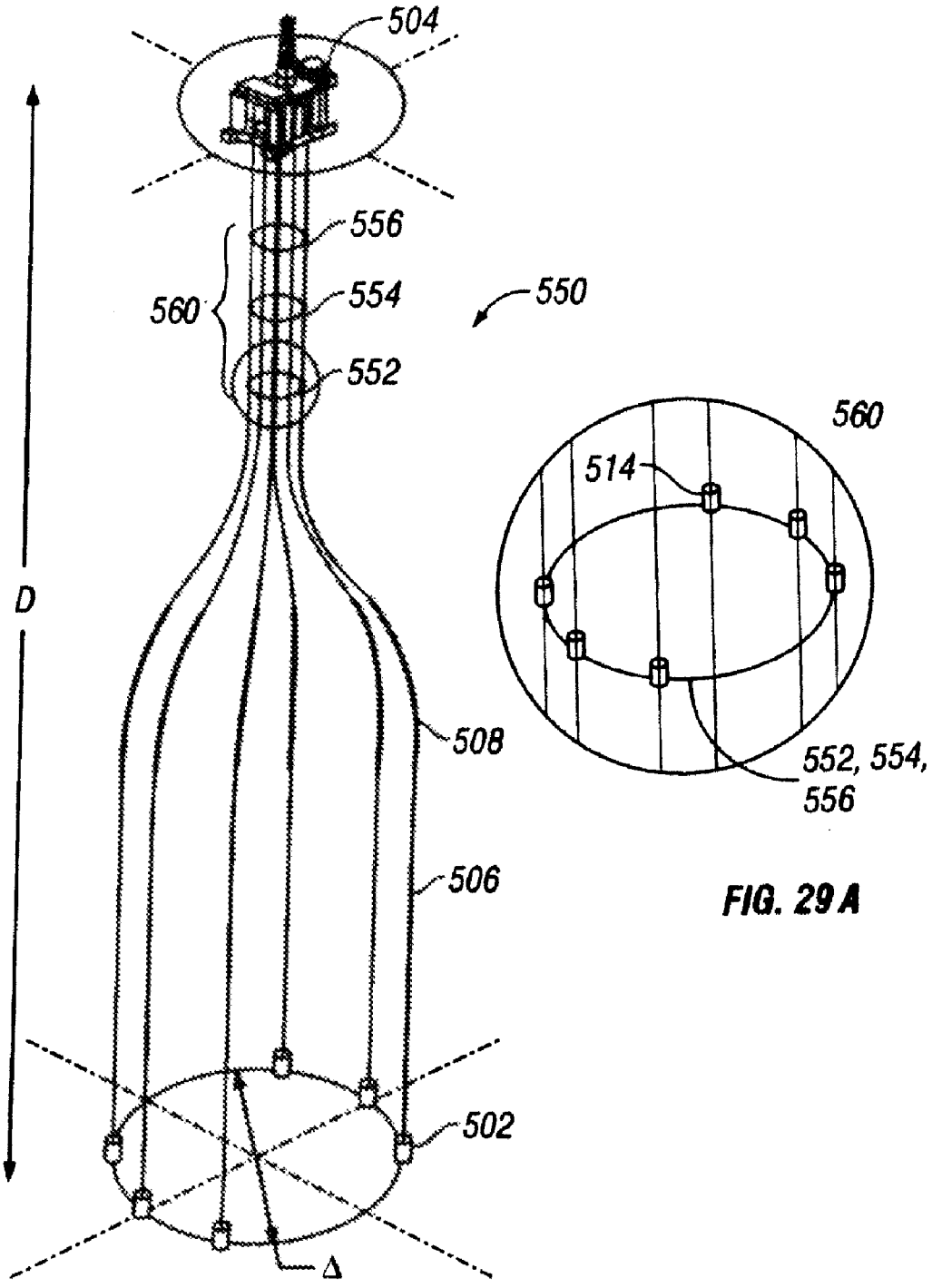
FIGS. 29 and 29A are schematic side view drawings of a floating platform with a plurality of variable tension risers interconnected at multiple locations in accordance with an embodiment of the present invention.

Referring briefly to FIGS. 29 and 29A, another alternative embodiment for a subsea well management system 550 is shown. Like management system 500 of FIG. 28, management system 550 includes a plurality of spacer rings 552, 554, 556 to maintain spacing between adjacent variable tension risers 506. This arrangement 550 is designed to maintain the spacing of risers 506 across a longer portion 560 of their length.

Figure 30:
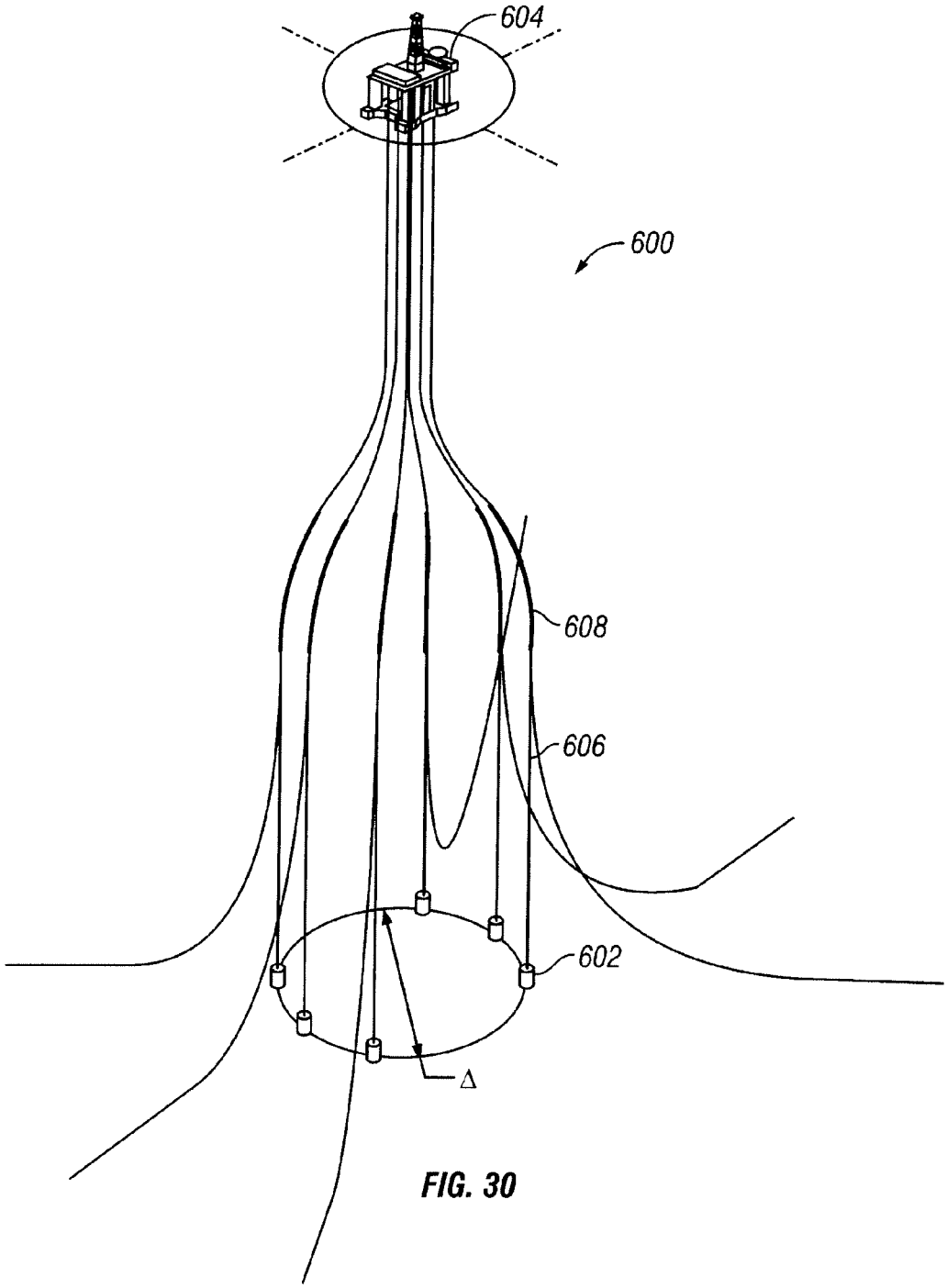
FIG. 30 is a schematic side view drawing of a floating platform with a plurality of variable tension risers including supplemental anchor lines in accordance with an embodiment of the present invention.

Referring now to FIG. 30, another alternative embodiment for a subsea well management system 600 is shown. Subsea well management system 600 can include a plurality of variable tension risers 606 extending from a group A of subsea wellheads 602 to a floating platform 604. Variable tension risers 606 can include neutral buoyancy regions 608 to form an s-curve to make variable tension risers 606 more compliant along their length. Subsea well management system 600 further includes a plurality of anchor lines 610 extending from each variable tension riser 606 to the sea floor. Anchor lines 610 are intended to maintain clearance between individual risers 606 during all anticipated loading conditions. Anchor lines 610 reduce horizontal loading on wellheads 602 and can enable larger diameter A groupings between wellheads 602.

Another embodiment of the present invention could include, for a near-field well offset scenario, terminating variable tension risers at support springs on the deck of a floating platform or production facility. Therefore, tension would not be applied to the risers directly other than to support the direct loads from the hanging of the risers themselves. The deck spring supports would be designed to reduce wave frequency loading on the variable tension risers that result from vertical motions of the production vessel or floating platform experiencing wave action.

Figure 31:
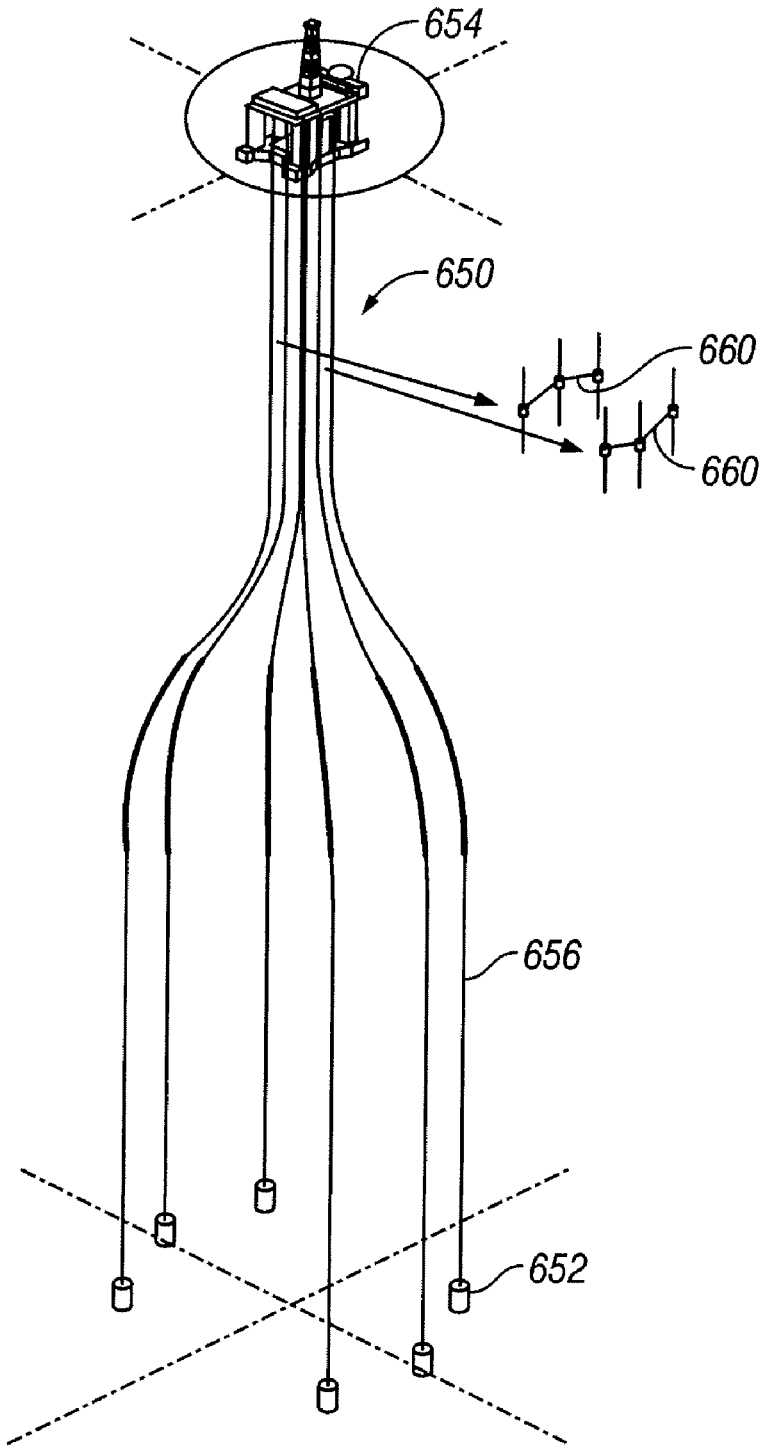
FIG. 31 is a schematic side view drawing of a floating platform with a plurality of variable tension risers including linkages to adjacent variable tension risers.

Referring to FIG. 31, another alternative embodiment for a subsea well management system 650 is shown. Subsea well management system 650 can include a plurality of variable tension risers 656 extending from a plurality of subsea wellheads 652 to a floating platform 654. Linking members 660 are shown linking adjacent variable tension risers 656 to one another to maintain spacing therebetween and to prevent deflection from anticipated loading conditions. Linking members 650 can be flexible or rigid.

Figure 32:
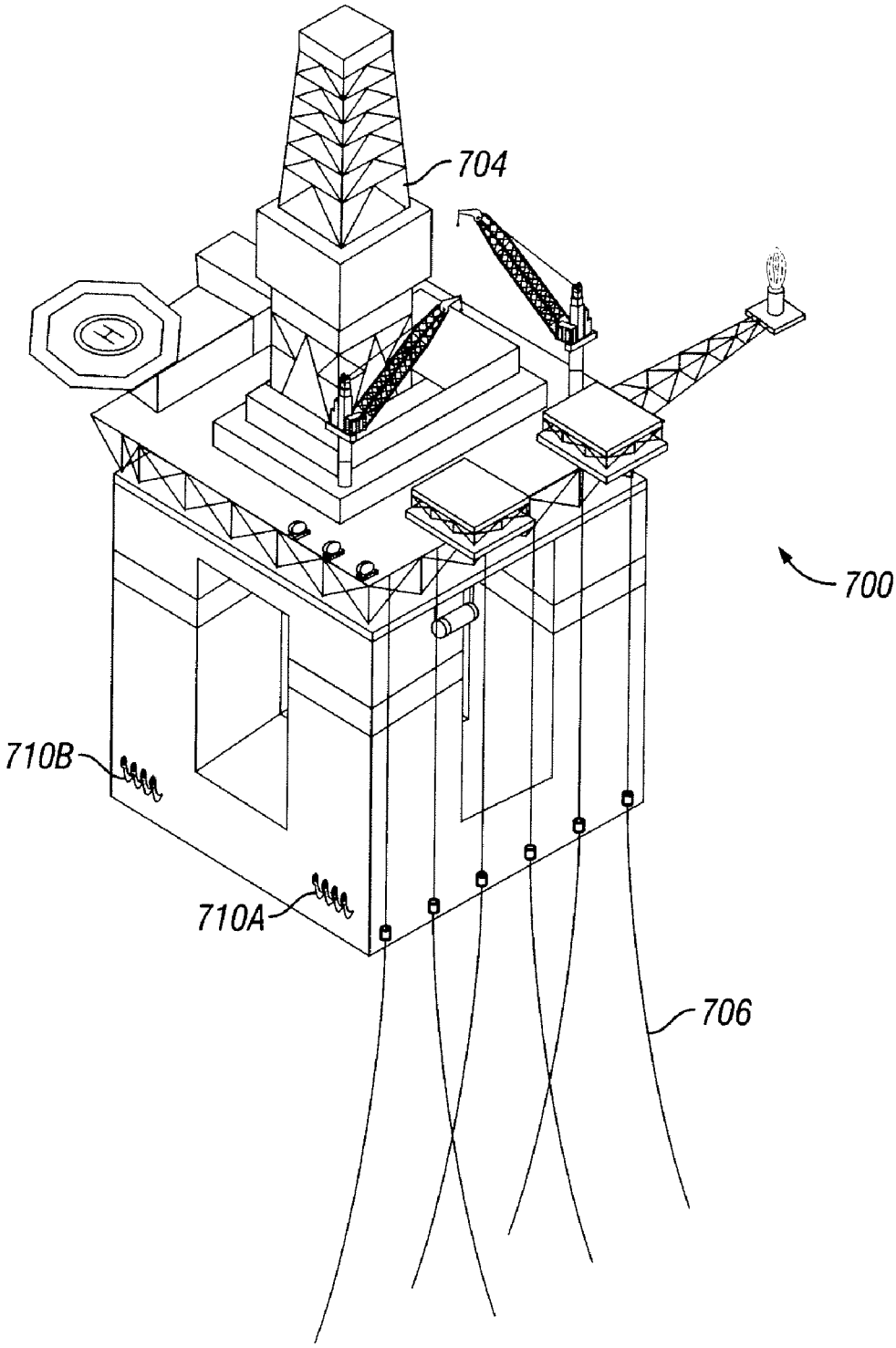
FIG. 32 is a schematic side view drawing of a floating platform with a plurality of variable tension risers extending from a single side thereof.

Referring to FIG. 32, another alternative embodiment for a subsea well management system 700 is shown. Subsea wellhead management system 700 can include a plurality of variable tension risers 706 extending from subsea wellheads (not shown) to a floating platform 704. Floating platform 704 includes pontoon assemblies 710A, 710B from which all variable tension risers 706 extend. As shown in FIG. 32, all variable tension risers 706 can extend from a single pontoon assembly 710A on one side of floating platform 704. This configuration may prove to be beneficial in that it allows a less cluttered layout for floating platform 704 and that floating platform can be configured to minimize motions from anticipated loading conditions at a single end. Furthermore, with the risers 706 terminated at the pontoon 710A level, the need for water ballast to be carried by the floating platform 704 can be reduced.

Figure 33:
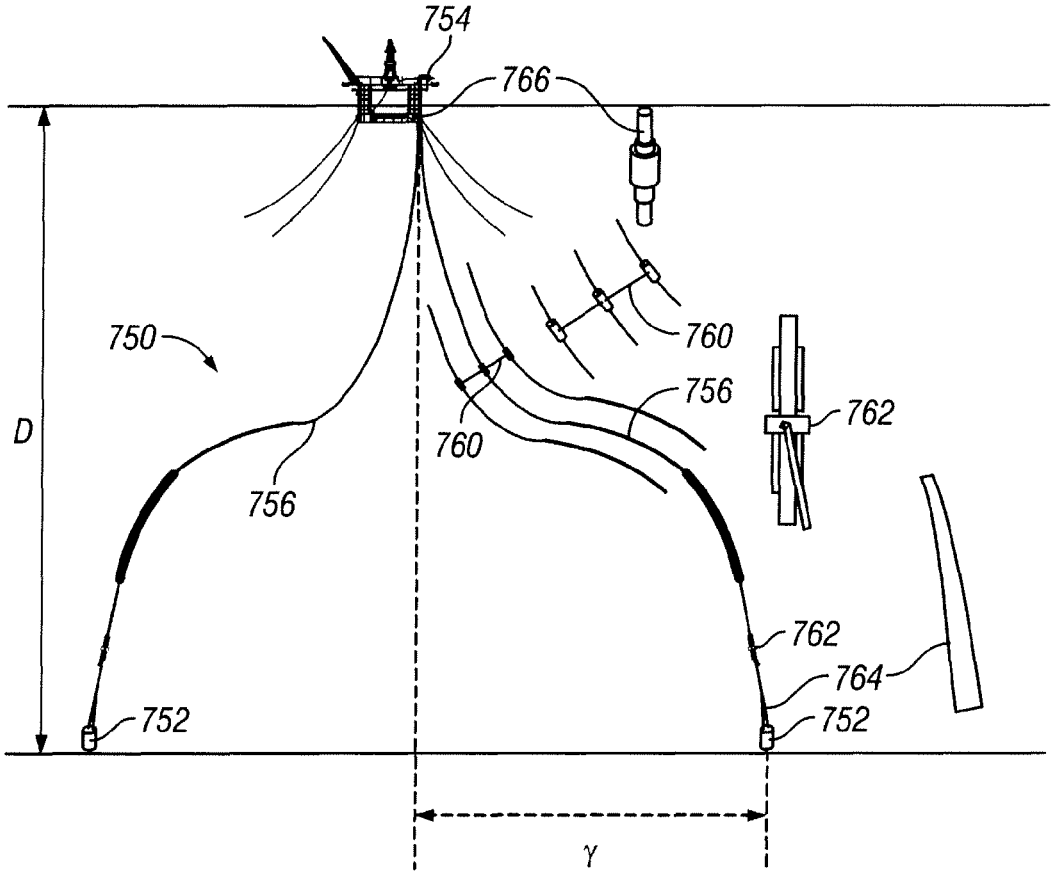
FIG. 33 is a schematic side view drawing of a floating platform with a plurality of variable tension risers extending therefrom in accordance with an embodiment of the present invention.

Referring to FIG. 33, a combined embodiment of a subsea well management system 750 is shown. System 750 includes a plurality of variable tension risers 756 connecting subsea wellheads 752 to a floating platform 754. Subsea wellhead 752 is shown located at a depth D and at a lateral offset γ from platform 754. Depth D can range from 300 to 4570 m (1,000 to 15,000 feet) or more, desirably from 1220 to 3050 m (4,000 to 10,000 feet) of water depth, with offset γ typically being less than or equal to one-half the depth D. However, offsets equal to or greater than the depth D are feasible. Furthermore, optional linkage 760, attachment points 762, and stress joints 764, 766 are shown. Linkage or weighted rope 760 is optionally used to connect adjacent variable tension risers 756 together to prevent excessive displacement. Attachment point 762 is desirably used to attach ballast lines and chains (e.g. 218, 228, and 230 of FIGS. 7-21) to variable tension riser 756 during installation. Stress joints, 764,766 are optionally installed at proximate and distal ends of variable tension riser 756 to reduce the magnitude of bending stresses on riser 756. Lower stress joint 756 can be a curved and tapered design to permit greater flexibility in the layout of wellheads 752 on the sea floor and upper stress joint 766 can be of any type, including keel or curved types, known in the art to improve the behavior of system 750.

Figure 34:
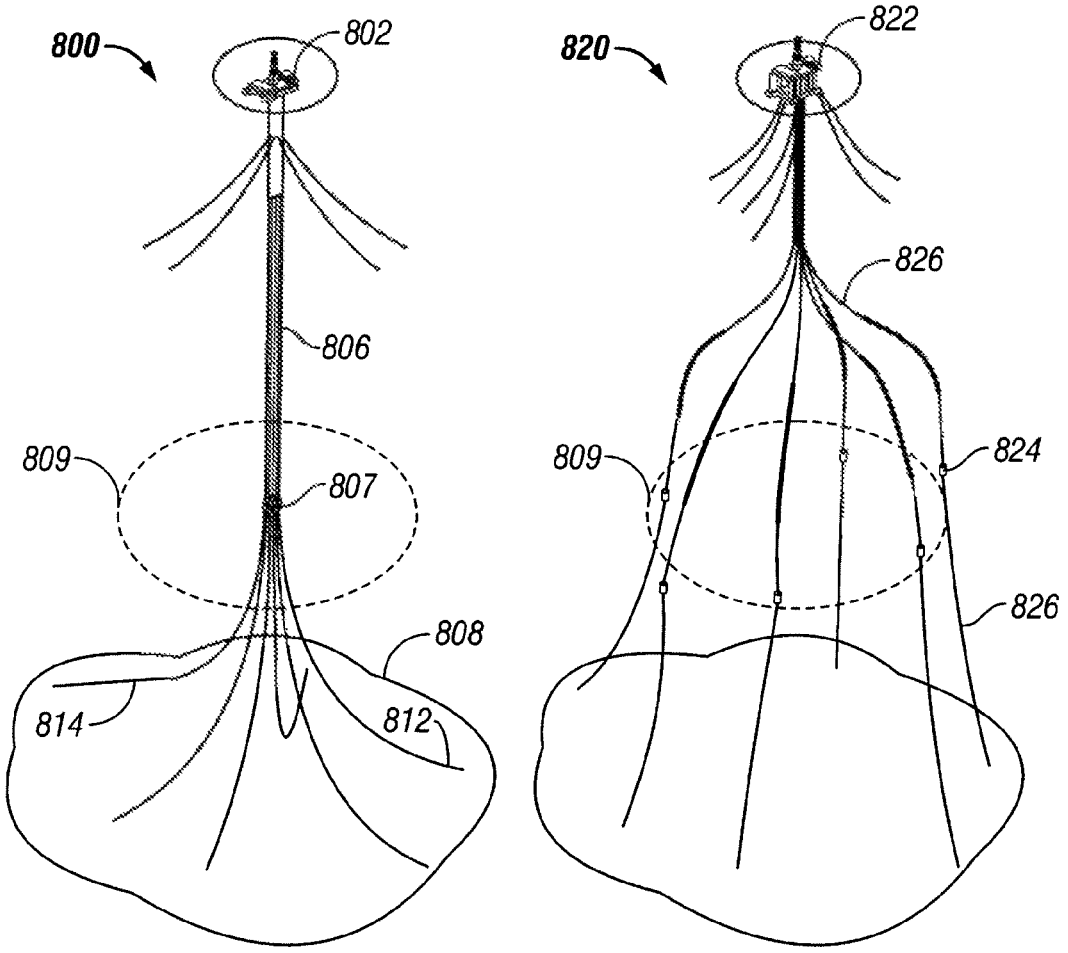
FIG. 34 is a schematic isometric view drawing of floating platforms depicting benefits of embodiments of the present invention over prior art systems.

Referring finally to FIG. 34, a comparison of a traditional dry tree well management system 800 with an improved well management system in accordance with the present invention 820 is shown. Traditional well management system 800 required the deployment of a more stable positioned platform like the tension leg platform (TLP), or the SPAR platform 802 shown. Risers 806 extending therefrom to subsea wellheads 807 at the mudline 809 above a reservoir 808 to be explored or produced were closely bundled together. This generally required completion in the reservoir 808 via slant wells 812 and/or horizontal or partially horizontal wells 814, which are less directionally accurate, more expensive, and not always feasible depending on formation characteristics.

In contrast, improved well management system 820 uses variable tension risers 826 to investigate reservoir 808, thereby allowing a more scattered placement of wellheads 824 therein. Furthermore, because system 820 is less constrictive on the movement of risers 826, less rigidly positioned platforms 822 can be used. Particularly, semi-submersible, and other floating production platforms that are not capable of the positional stability of tension leg and SPAR platforms can be used and a wider placement of wellheads 824 within reservoir 808 is possible. This permits the wells 826 to be drilled more closely to vertical with improved directional accuracy and lower cost. The benefit is particularly significant compared to shallow zone type wells 814 previously completed via partially horizontal drilling.

Another embodiment of the variable tension riser system of the present invention, installed in a manner similar to that as described above in relation to FIGS. 6-21, is illustrated in FIGS. 42-46. In this embodiment, the variable tension riser can similarly contain a stress joint 212, a desired length of lower slick pipe P3, a desired length of upper slick pipe P1, and a ballast line attachment point 216. A segment of buoyant pipe MB can be installed above ballast line attachment point 216. Buoyant pipe MB can then be connected to a variable buoyancy section VB, which can be a series of segments, single or multiple pipe joints, having varying buoyancy. As illustrated, for example, the variable buoyancy section can consist of 14 segments VB1-VB14, where VB1 can have the lowest buoyancy and VB14 can have the highest buoyancy, but is less buoyant than segment MB.

Slick pipe P2 can be connected to VB1 and to weighted pipe segments W1 and W2, which are installed below the upper slick pipe P1. W1 can be of greater weight than W2. P2 can provide for a transition between the weighted segment W2 and the first buoyed segment VB1.

Table 1 illustrates several key features of one embodiment of the weighted and buoyed riser of the present invention and of its hardware. The length and diameter of the riser segments, the thickness of the weight or buoyancy added to the segment, and fractional mass change are presented in the middle four columns. The weights of each segment containing three operational fluids of varying density (lightest, mean, and maximum density) are presented in the last three columns on the right. For each operating fluid, the riser is neutrally buoyant in the middle of the tapered buoyancy section (VB7 or VB8).

TABLE 1

Segment details for one embodiment of the weighted riser.

| Segment Name | | Length m (ft) | Buoyancy or Weight ID cm (in) | Buoyancy or Weight Thickness cm (in) | Unit Weight in Water kg/m (lb/ft) Light[1] | Mean[2] | Heavy[3] | Fractional Mass Change[4] |
|---|---|---|---|---|---|---|---|---|
| Upper Slick Pipe, straked | P1 | 1691.6 (5550) | 27 (10.625) | 2.54 (1.0) | 6.97 (50.3) | 7.28 (52.6) | 8.91 (64.3) | 0.000 |
| Weighted Segment 1 | W1 | 57.6 (189) | 27 (10.625) | 5.1 (2.0) | 39.51 (282.9) | 39.51 (285.3) | 41.12 (296.8) | 2.302 |
| Weighted Segment 2 | W2 | 57.6 (189) | 27 (10.625) | 2.03 (0.8) | 18.44 (133.1) | 18.76 (135.4) | 20.38 (147.1) | 0.479 |
| Transition Slick Pipe | P2 | 57.6 (189) | 27 (10.625) | 0.0 (0.0) | 6.68 (48.2) | 7.00 (50.5) | 8.60 (62.1) | 0.521 |
| Variable Buoyant 1 | VB1 | 19.2 (63) | 27 (10.625) | 5.1 (2.0) | 4.39 (31.7) | 4.71 (34.0) | 6.31 (45.6) | 0.208 |
| Variable Buoyant 2 | VB2 | 19.2 (63) | 27 (10.625) | 6.35 (2.5) | 3.70 (26.7) | 4.01 (29.0) | 5.64 (40.7) | 0.052 |
| Variable Buoyant 3 | VB3 | 19.2 (63) | 27 (10.625) | 7.87 (3.1) | 2.83 (20.4) | 3.13 (22.6) | 4.75 (34.3) | 0.063 |
| Variable Buoyant 4 | VB4 | 19.2 (63) | 27 (10.625) | 9.14 (3.6) | 2.34 (16.9) | 2.66 (19.2) | 4.26 (30.8) | 0.071 |
| Variable Buoyant 5 | VB5 | 19.2 (63) | 27 (10.625) | 10.67 (4.2) | 1.41 (10.2) | 1.71 (12.4) | 3.34 (24.1) | 0.067 |
| Variable Buoyant 6 | VB6 | 19.2 (63) | 27 (10.625) | 12.19 (4.8) | 0.42 (3.0) | 0.73 (5.3) | 2.34 (16.9) | 0.067 |
| Variable Buoyant 7 | VB7 | 19.2 (63) | 27 (10.625) | 13.97 (5.5) | −0.83 (−6.0) | −0.51 (−3.7) | 1.11 (8.0) | 0.078 |
| Variable Buoyant 8 | VB8 | 19.2 (63) | 27 (10.625) | 15.75 (6.2) | −2.15 (−15.5) | −1.83 (−13.2) | −0.22 (−1.6) | 0.077 |
| Variable Buoyant 9 | VB9 | 19.2 (63) | 27 (10.625) | 17.53 (6.9) | −3.56 (−25.7) | −3.24 (−23.4) | −1.62 (−11.7) | 0.076 |
| Variable Buoyant 10 | VB10 | 19.2 (63) | 27 (10.625) | 19.3 (7.6) | −5.04 (−36.4) | −4.72 (−34.1) | −3.11 (−22.5) | 0.075 |
| Variable Buoyant 11 | VB11 | 19.2 (63) | 27 (10.625) | 21.08 (8.3) | −6.61 (−47.7) | −6.30 (−45.5) | −4.68 (−33.8) | 0.073 |
| Variable Buoyant 12 | VB12 | 19.2 (63) | 27 (10.625) | 24.13 (9.5) | −9.50 (−68.6) | −9.19 (−66.3) | −7.57 (−54.7) | 0.126 |
| Variable Buoyant 13 | VB13 | 19.2 (63) | 27 (10.625) | 27.94 (11.0) | −13.45 (−97.1) | −13.13 (−94.8) | −11.52 (−83.2) | 0.153 |
| Variable Buoyant 14 | VB14 | 57.6 (189) | 27 (10.625) | 33.02 (13.0) | −19.31 (−139.4) | −18.99 (−137.1) | −17.39 (−125.5) | 0.197 |
| Maximum Buoyancy Segment | MB | 57.6 (189) | 27 (10.625) | 50.8 (20.0) | −45.17 (−326.0) | −44.85 (−323.7) | −43.22 (−312.0) | 0.724 |
| Bottom Slick Pipe | P3 | 230.4 (756) | 27 (10.625) | 0.0 (0.0) | 6.67 (48.2) | 7.00 (50.5) | 8.59 (62.1) | 0.843 |
| Tapered Pipe | TP | 7.3 (24) | 27 (10.625) | | | | | |

a) Pipe full of lightest operational density fluid.
b) Pipe full of mean operational density fluid
c) Pipe full of well kill density fluid (mud).
d) Fractional mass change = $[Mi - M_{i-1}]/M_{i-1}$ (with pipe full of mean operational density fluid).

The two weighted segments W1 and W2 can be located at least half-way down the riser. The segments can be weighted by added external weight either by strapping to them steel half shells, by coating the pipe, or similar methods. The weighting used can have a weight per unit length several times the weight per unit length of the slick pipe used in the riser, e.g. 5 or more times the weight per unit length of the slick pipe. The weight can be attached to the slick pipe in a manner that does not increase the bending or axial stiffness of the pipe. The purpose of the weighted segments is two-fold: first, to help keep the top half of the riser as close to vertical as possible; second, to help dampen the transmission of compressive waves from the top slick pipe region to the buoyant region of the riser. Keeping the top half of the riser as close to the vertical as possible maximizes the horizontal separation between the two ends of the buoyant region, increasing riser compliancy.

Figure 47:
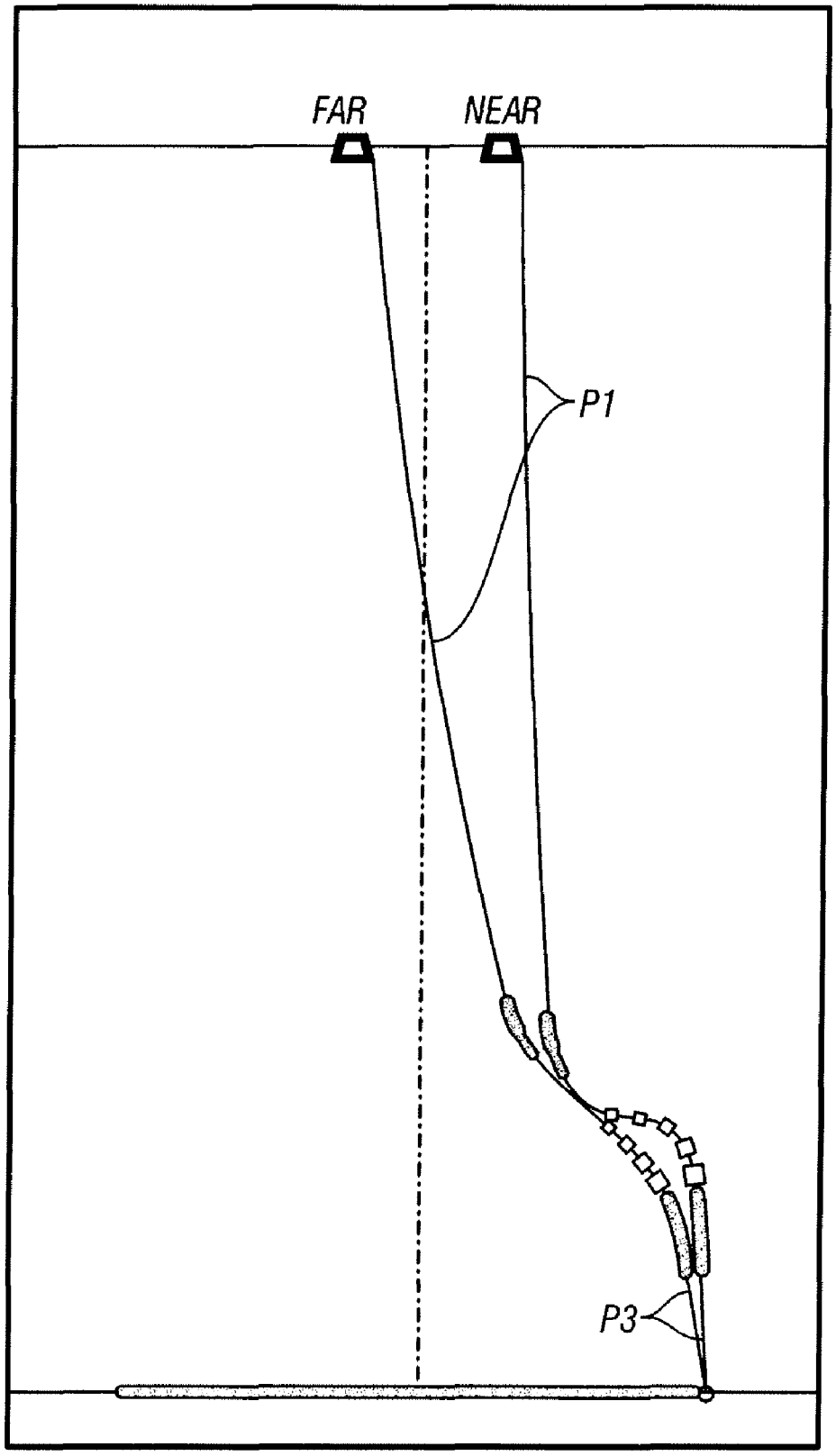
FIG. 47 illustrates the simulated performance results for a weighted and buoyed variable tension riser according to an embodiment of the present invention in the NEAR and FAR positions.

Maximum buoyancy segment MB and two tapered buoyant segments VB13, VB14 can be located above the bottom pipe section P3. The purpose of these buoyed segments is to help keep the bottom part of the riser as close to the vertical as possible. This can protect the bottom of the riser from over-bending, and also contribute to the maximization of the horizontal separation between the two ends of the buoyant region. FIG. 47 illustrates the change in pipe configuration for a weighted and buoyed riser attached to a vessel in FAR and NEAR positions, illustrating how the weighted and buoyant sections help maintain the upper and lower pipe sections P1 and P3 as close to vertical as possible in this embodiment.

In certain embodiments, slick pipe means bare pipe or pipe with insulation (no additional weighting or buoyancy). Adjusting the buoyancy of lower slick pipe P3, such as with buoyancy, can affect the stresses and dynamic stress ranges encountered during riser during operation. In certain embodiments, lower slick pipe P3 can be positively buoyant. In other embodiments, lower slick pipe P3 can be negatively buoyant.

Risers can be designed with substantially long regions of pipe that are neutrally buoyant, such as illustrated in Table 1 above and Table 2 below. In the configuration selected for the risers of Table 3, the total length of the neutrally buoyant region is short, on the order of 60 m (200 feet) as opposed to 300 m (1000 feet) or more in other designs. This can simplify the design of the riser, reduce static stresses, and improve the dynamic response of the riser.

The transition from the maximum buoyancy region MB to the weighted section W1 is difficult to analyze numerically. As a result, each riser joint in the buoyancy region can have its own, specifically selected, net buoyancy, determined on a trial and error basis. In particular, the buoyancy of each intervening joint can be selected on the basis of minimizing the greatest change in fractional mass per unit length between any two joints. This minimization is desirable because the amount by which a wave (of any type) is reflected at a discontinuity in the transmission medium depends on the impedance mismatch at that discontinuity. In the case of risers, the impedance mismatch can be related directly to the change in mass. Although there can be a discontinuity in the fractional mass change at the start of weighted segment W1, this does not appear to cause untoward stress.

The dynamic response of risers with relatively long buoyant segments is presented by way of an example. Table 2 shows segment lengths for an exemplary variable tension riser having relatively long individual buoyed segments. The segments are such that the net buoyancies each make the pipe neutrally buoyant in water for values of the operational fluid equal to the lightest, mean, and heaviest operational and kill fluid cases. The remaining lower segments can have buoyancies that ultimately provide an appropriate bottom tension to the riser.

TABLE 2

Segment Length for a variable tension riser configuration without Weighted Segments.

| Segment Name | Segment Length (Feet) | Segment Length (meters) |
|---|---|---|
| Top Slick | 4055 | 1236 |
| Variable Buoyancy 1 | 315 | 96 |
| Variable Buoyancy 2 | 315 | 96 |
| Variable Buoyancy 3 | 315 | 96 |
| Variable Buoyancy 4 | 315 | 96 |
| Variable Buoyancy 5 | 315 | 96 |
| Variable Buoyancy 6 | 315 | 96 |
| Variable Buoyancy 7 | 315 | 96 |
| Variable Buoyancy 8 | 315 | 96 |
| Variable Buoyancy 9 | 315 | 96 |
| Maximum Buoyancy | 693 | 211 |
| Bottom Slick | 1008 | 308 |
| Taper joint section 4 (top) | 8 | 2.4 |
| Taper joint section 3 | 8 | 2.4 |
| Taper joint section 2 | 8 | 2.4 |
| Taper joint section 1 (bottom) | 8 | 2.4 |

Figure 48:
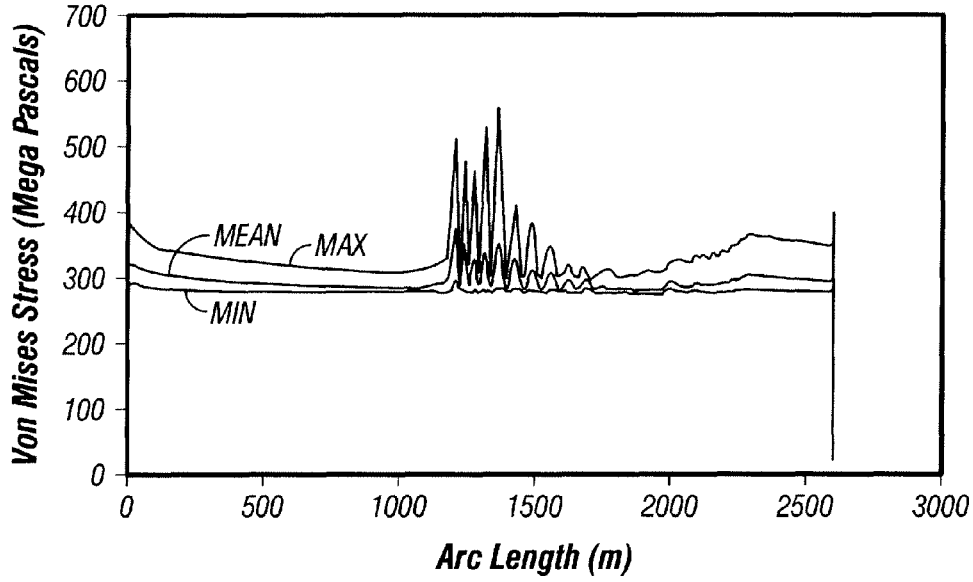
FIG. 48 is a graphical representation of von Mises stresses and effective tension as a function of length for a variable tension riser according to an embodiment of the present invention.
Figure 48:
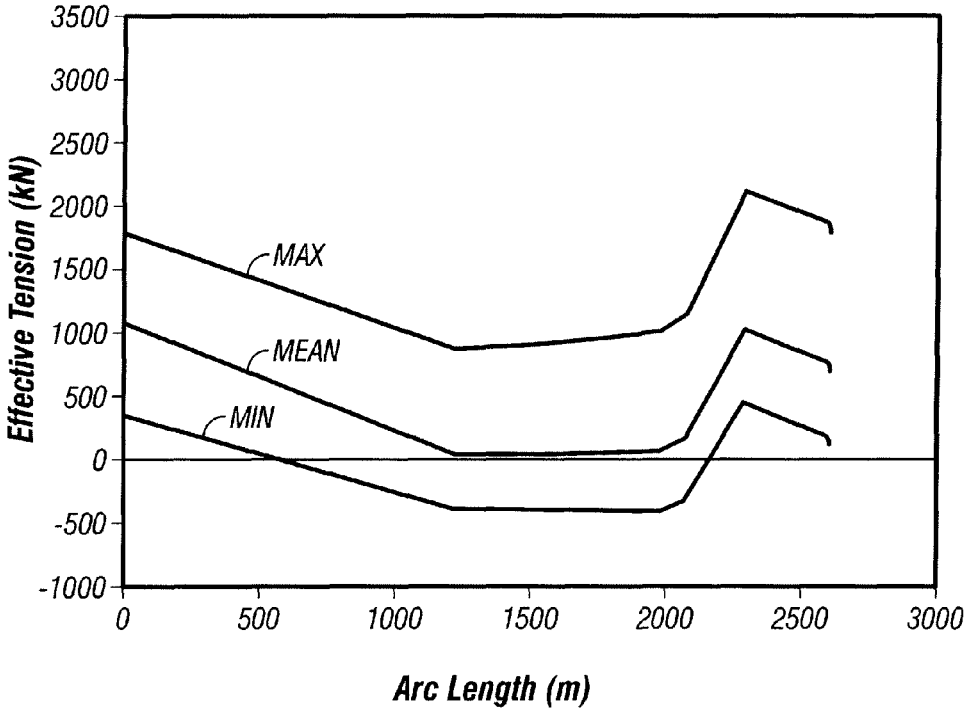

Using the riser configuration and lengths specified in Table 2, a plot of the variation in von Mises stress range (MPa) with arc length (m) from the top of the riser for the configuration was generated and is presented in FIG. 48. While the stresses are acceptable, there is a fair amount of noise in the variation of dynamic stresses. The noise extends over a region some 600 m (2000 feet) in length. Effective tension as a function of arc length is also presented in FIG. 48. Dynamic compression occurs over a region some 1525 meters (5000 feet) in length (compression occurs where effective tension is negative). The compression is undesirable and may require the use of special joints that have been designed for such compression.

A reduction in the noise and compression can be achieved by decreasing the length of individual buoyed segments, and can be further reduced with weighted segments. The dynamic response for risers with and without weighted segments and having shorter buoyant segments is presented by way of example. Table 3 shows exemplary segment lengths for two risers, one with weighting and one without weighting. The only differences between the risers are that that in the second riser two of the bottom three slick pipe sections have been weighted, and the length of the top slick has been modified so as to achieve the same 60° maximum angle from the vertical for a scenario where the production vessel is offset 76 m (250 feet) toward the far location and the riser is full of the lightest density fluid. In other embodiments, at least a portion of the riser can have a minimum deviation from the vertical of 40 degrees.

TABLE 3

Segment lengths for Risers with and without Weighted Segments.

| Segment | Length (m) | (ft) |
|---|---|---|
| Riser Without Weight | | |
| Top Slick | 1681 | 5515 |
| Top Slick, cont'd | 57.6 | 189 |
| Top Slick, cont'd | 57.6 | 189 |
| Top Slick, cont'd | 57.6 | 189 |
| Variable Buoyant 1 | 19.2 | 63 |
| Variable Buoyant 2 | 19.2 | 63 |
| Variable Buoyant 3 | 19.2 | 63 |
| Variable Buoyant 4 | 19.2 | 63 |
| Variable Buoyant 5 | 19.2 | 63 |
| Variable Buoyant 6 | 19.2 | 63 |
| Variable Buoyant 7 | 19.2 | 63 |
| Variable Buoyant 8 | 19.2 | 63 |
| Variable Buoyant 9 | 19.2 | 63 |
| Variable Buoyant 10 | 19.2 | 63 |
| Variable Buoyant 11 | 19.2 | 63 |
| Variable Buoyant 12 | 19.2 | 63 |
| Variable Buoyant 13 | 57.6 | 189 |
| Variable Buoyant 14 | 57.6 | 189 |
| Max Buoyancy | 153.6 | 504 |
| Bottom Slick | 230.4 | 756 |
| Taper joint 4 (top) | 1.8 | 6 |
| Taper joint 3 | 1.8 | 6 |
| Taper joint 2 | 1.8 | 6 |
| Taper joint 1 (bottom) | 1.8 | 6 |
| Weighted Riser | | |
| Top Slick | 1687 | 5535 |
| Weighted 1 | 57.6 | 189 |
| Weighted 2 | 57.6 | 189 |
| Transition Segment | 57.6 | 189 |
| Variable Buoyant 1 | 19.2 | 63 |
| Variable Buoyant 2 | 19.2 | 63 |
| Variable Buoyant 3 | 19.2 | 63 |
| Variable Buoyant 4 | 19.2 | 63 |
| Variable Buoyant 5 | 19.2 | 63 |
| Variable Buoyant 6 | 19.2 | 63 |
| Variable Buoyant 7 | 19.2 | 63 |
| Variable Buoyant 8 | 19.2 | 63 |
| Variable Buoyant 9 | 19.2 | 63 |
| Variable Buoyant 10 | 19.2 | 63 |
| Variable Buoyant 11 | 19.2 | 63 |
| Variable Buoyant 12 | 19.2 | 63 |
| Variable Buoyant 13 | 57.6 | 189 |
| Variable Buoyant 14 | 57.6 | 189 |
| Max Buoyancy | 153.6 | 504 |
| Bottom Slick | 230.4 | 756 |
| Taper joint 4 (top) | 1.8 | 6 |
| Taper joint 3 | 1.8 | 6 |
| Taper joint 2 | 1.8 | 6 |
| Taper joint 1 (bottom) | 1.8 | 6 |

Figure 49:
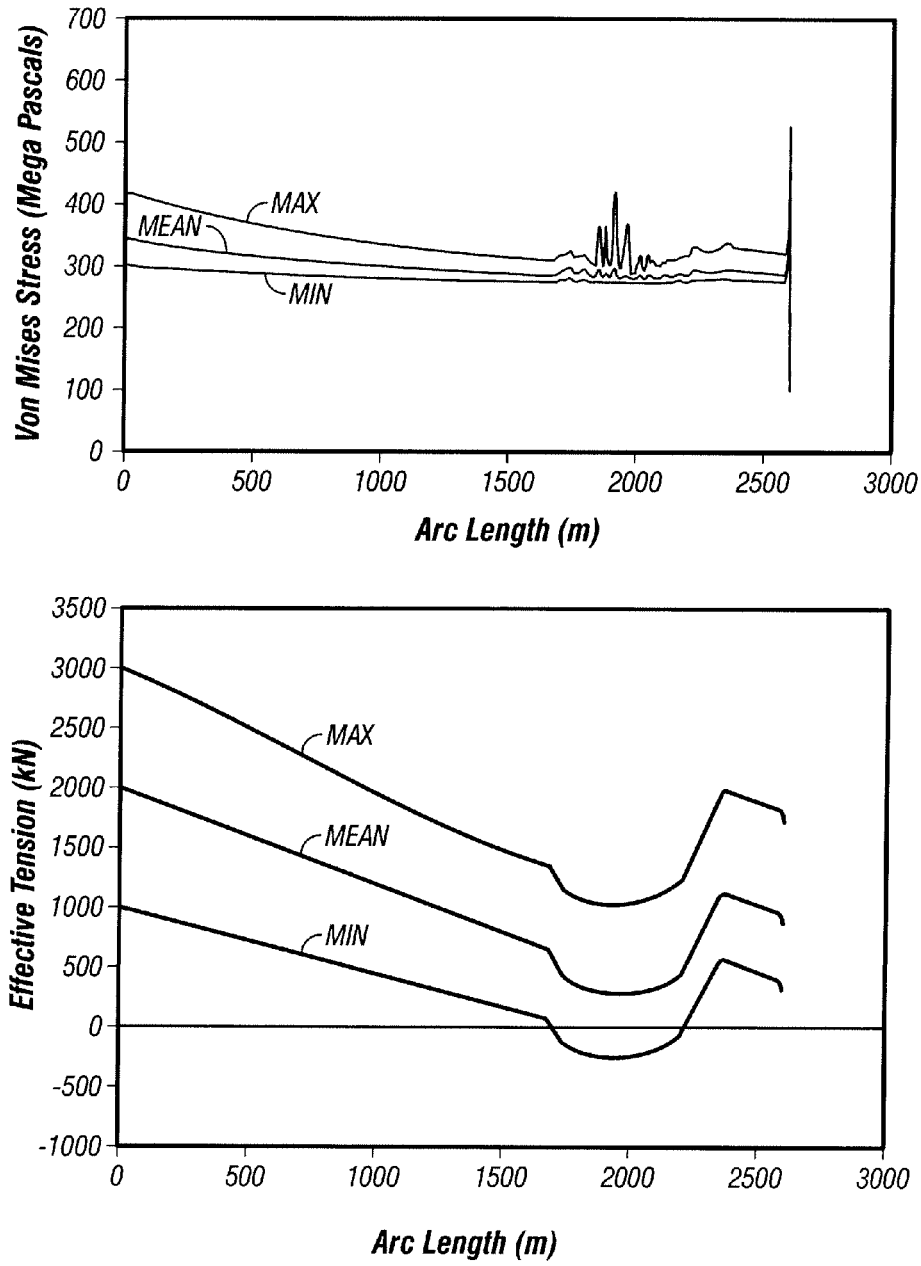
FIG. 49 is a graphical representation of von Mises stresses and effective tension as a function of length for a weighted and buoyed variable tension riser according to an embodiment of the present invention.
Figure 50:
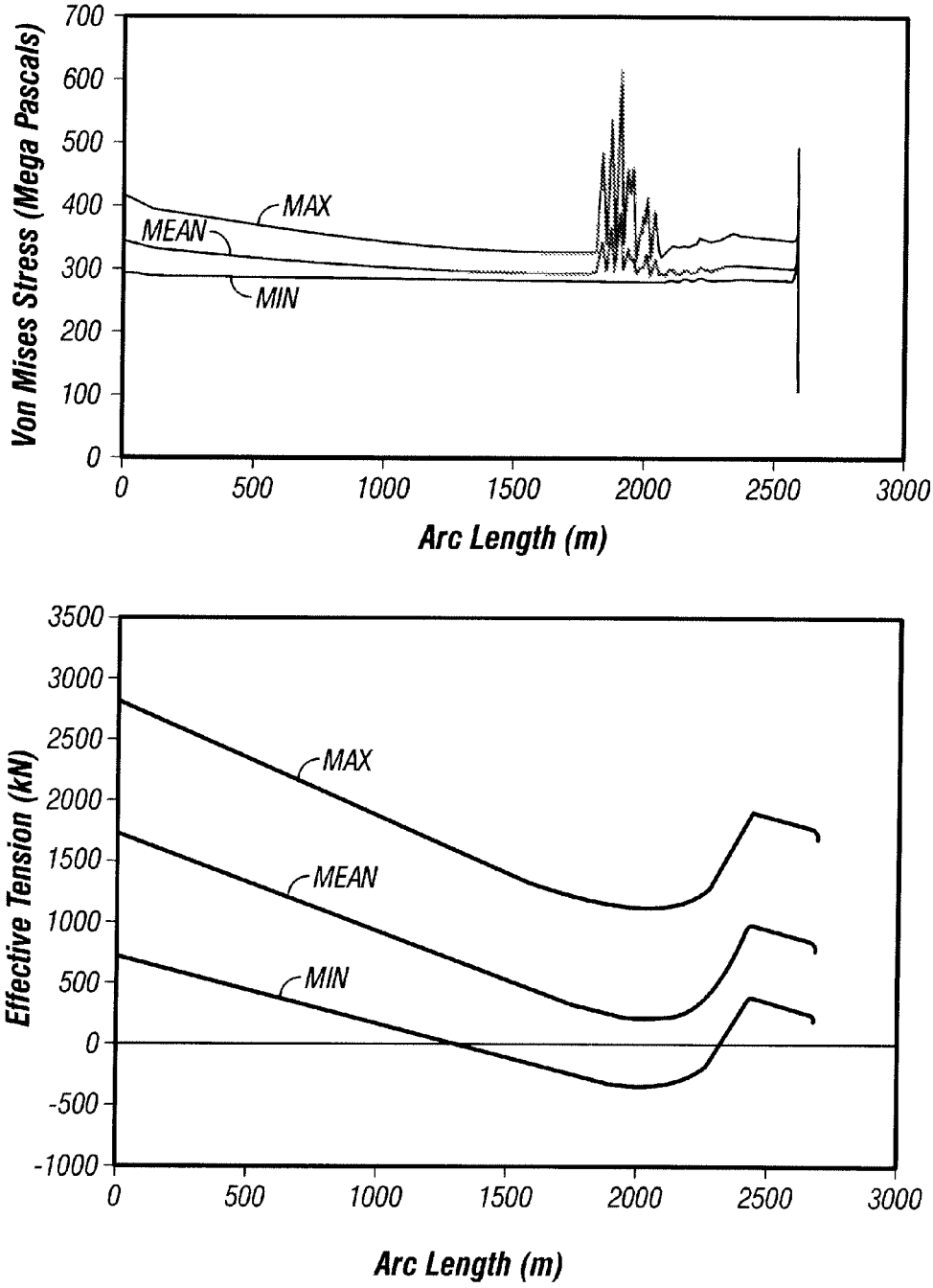
FIG. 50 is a graphical representation of von Mises stresses and effective tension as a function of length for a buoyed variable tension riser according to an embodiment of the present invention.

Using the above lengths, the variation in von Mises stress range and effective tension range were calculated. FIGS. 49 and 50 compare the von Mises stresses and effective tension for the risers with and without weighting, respectively. With weighting, the amplitude of the noise in the buoyant region is significantly reduced, and the compression region has been reduced from approximately 1525 meters (5000 feet) without weighting to approximately 600 meters (2000 feet) with weighting. The range over which the noise occurs is also reduced by a distance of about 300 meters (1000 feet).

One benefit obtained from the weighted and buoyed riser configuration can be an improvement in fatigue life. The improvement in fatigue life can be estimated, and is roughly proportional to the cube of the stress range ratio [(fatigue life "A"/fatigue life "B")≈(stress range "B"/stress range "A")$^3$]. For example, the riser of Table 1 and FIG. 48 has a stress range in the curved region of about 200 MPa (29000 psi); the weighted and buoyed riser of Table 2 and FIG. 49 has a stress range in the curved region of about 130 MPa (18850 psi). Therefore, the fatigue life of the curved region of the weighted and buoyed riser is approximately equal to $(200/130)^3$ or 3.6 times the fatigue life of the curved region of the riser configuration of Table 1. Increased tension in the weighted riser can also help reduce fatigue damage due to vortex induced motions in ocean currents.

Figure 51:
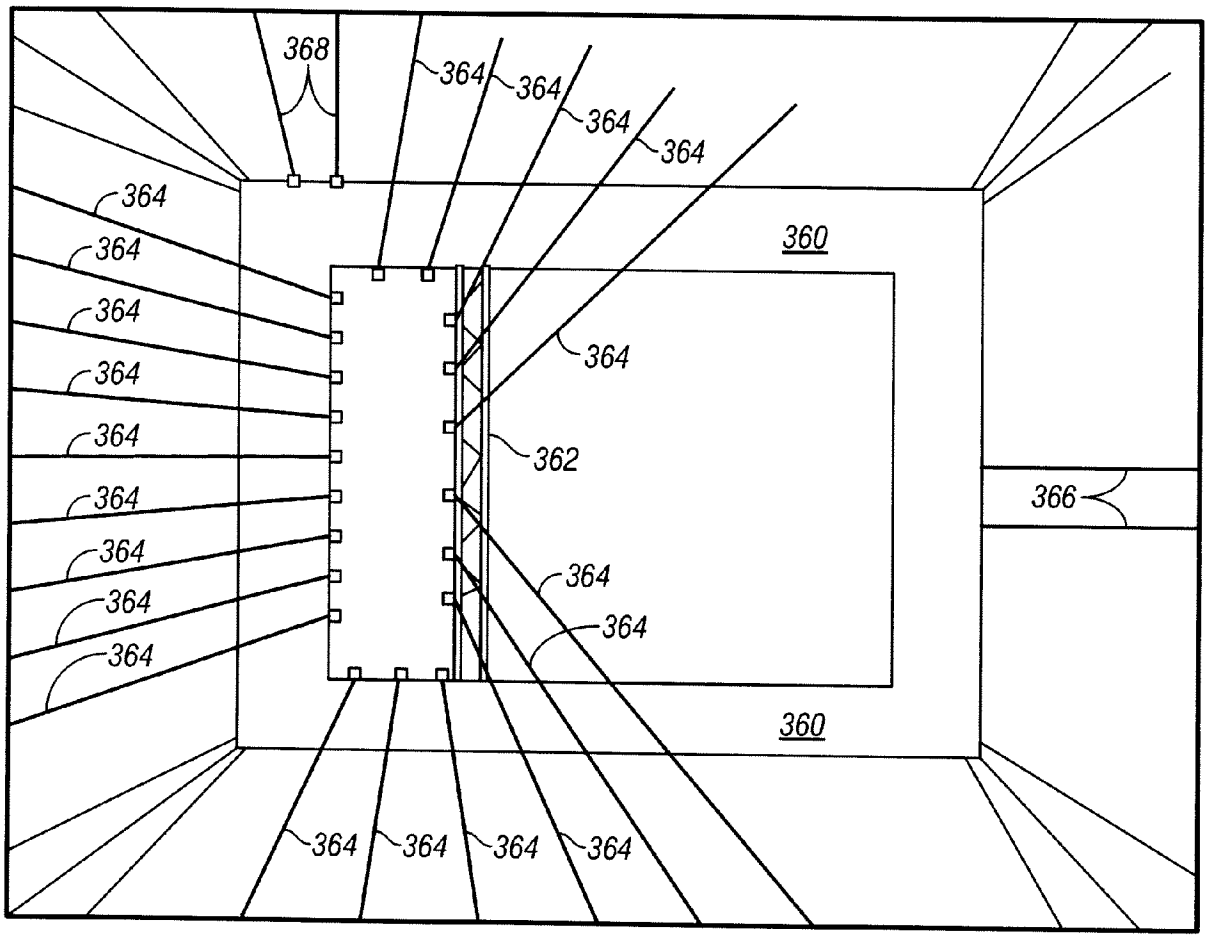
FIG. 51 is a bottom view of a pontoon ring and moon pool illustrating 15 foot center to center spacing between the variable tension risers according to an embodiment of the present invention.

Another benefit obtained from the weighted and buoyant riser can be a decrease in the required spacing between risers where they are connected to the platform or pontoon. For many production platforms, production of hydrocarbons occurs on one side of the platform, and personnel housing is located at the opposite end of the platform, thereby limiting the space available for risers to connect to the vessel, and thereby the number of wells that a single platform can process. FIG. 51 illustrates an upward-looking plan view of the pontoon ring 360 and riser guide frame 362 utilizing 4.6 meters (15 foot) center-to-center spacing between risers 364. The top 300 meters (1000 feet) of a riser 364 are typically where contact between neighboring risers can occur, usually as a result of subsea currents. The weighted segments can add downward tension to the top section of risers 364, decreasing the amount of sway caused by loop or submerged currents. Utilizing the weighted and buoyant riser as described herein, the center-to-center spacing of adjacent risers 364 can be decreased to between 2 and 12 m (7 and 40 feet). Strake fenders, especially resilient or elastomeric strakes, can be used in conjunction with the weighted and buoyant riser to prevent lateral vibrations, absorb a portion of the energy in any impact, and allow even closer spacing.

As illustrated in FIG. 51, risers 364 are connected to the pontoon ring 360 in a protected position, in the interior of the pontoon 360, thereby helping to protect the upper part of each riser 364 from undesired contact with vessels docking or traveling near the platform. Piping 366 for water import and export SCRs 368 can be located on the outer portion of the pontoon ring.

Figure 52:
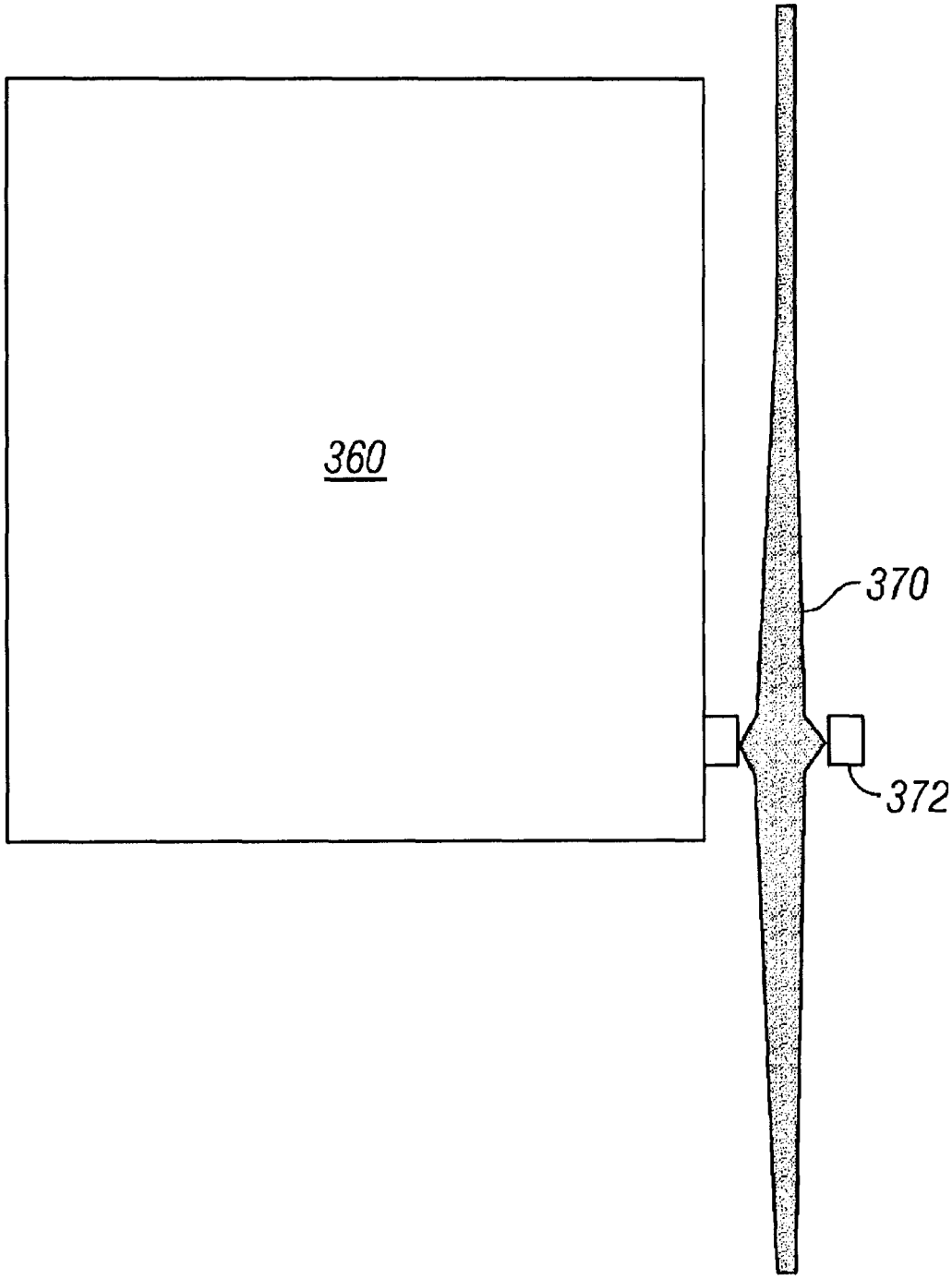
FIG. 52 illustrates a keel joint and open keel guide attached to a pontoon ring and a variable tension riser according to an embodiment of the present invention.

The manner in which risers 364 are attached to the production platform or pontoon ring 360 can also affect the dynamic stresses in the keel joint 370, keel guide 372, and riser 364. As illustrated in FIG. 52, open or hinged-closed guides 372 can be used to locate a riser 364 along the keel of the pontoon or production platform 360. An open or hinged-closed guide 372 with non-zero gap provides a simple, low cost connection, but can result in higher dynamic stresses due to the gap between riser 364 and guide 370.

Figure 53:
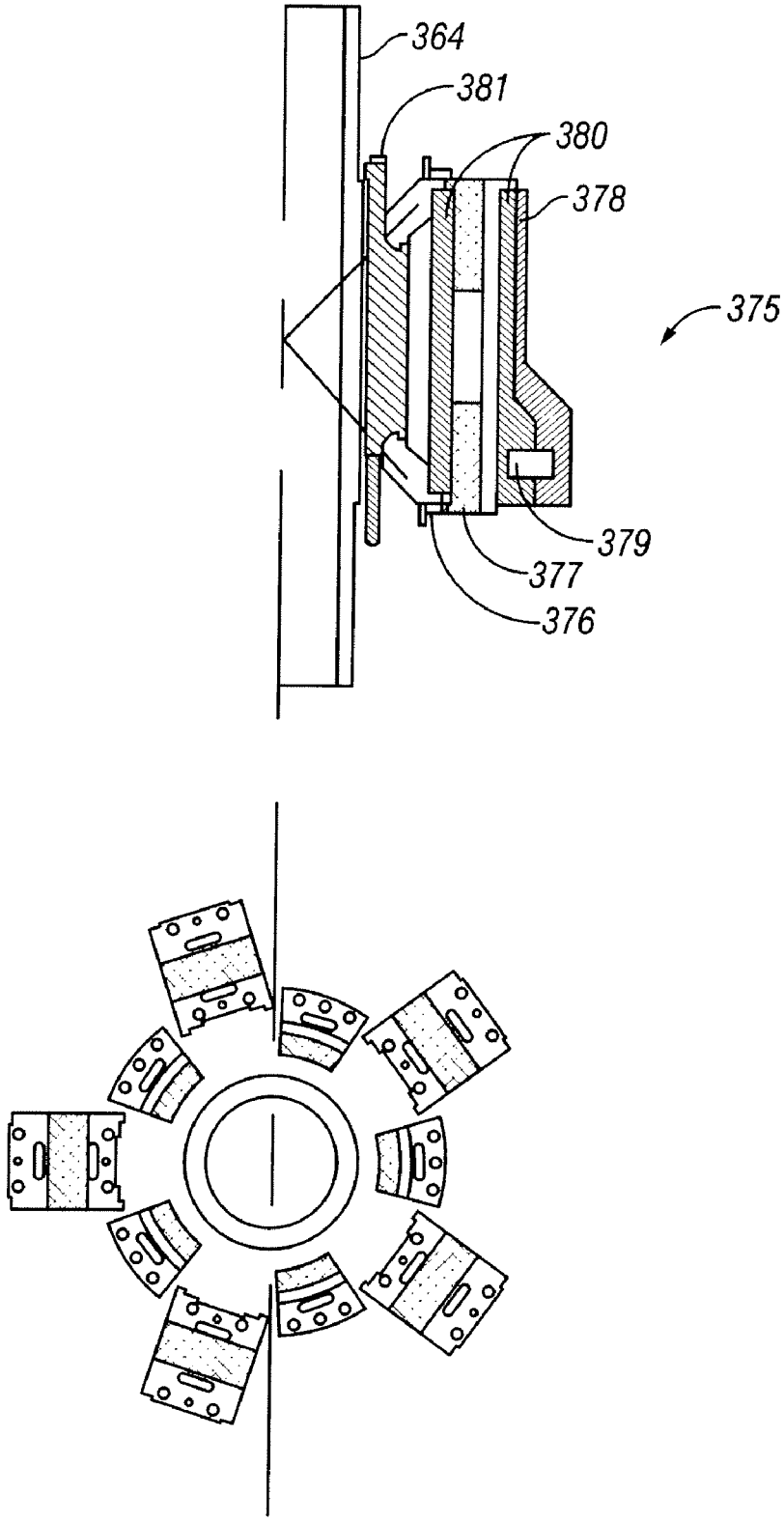
FIG. 53 is a schematic view of a zero gap keel guide.
Figure 54:
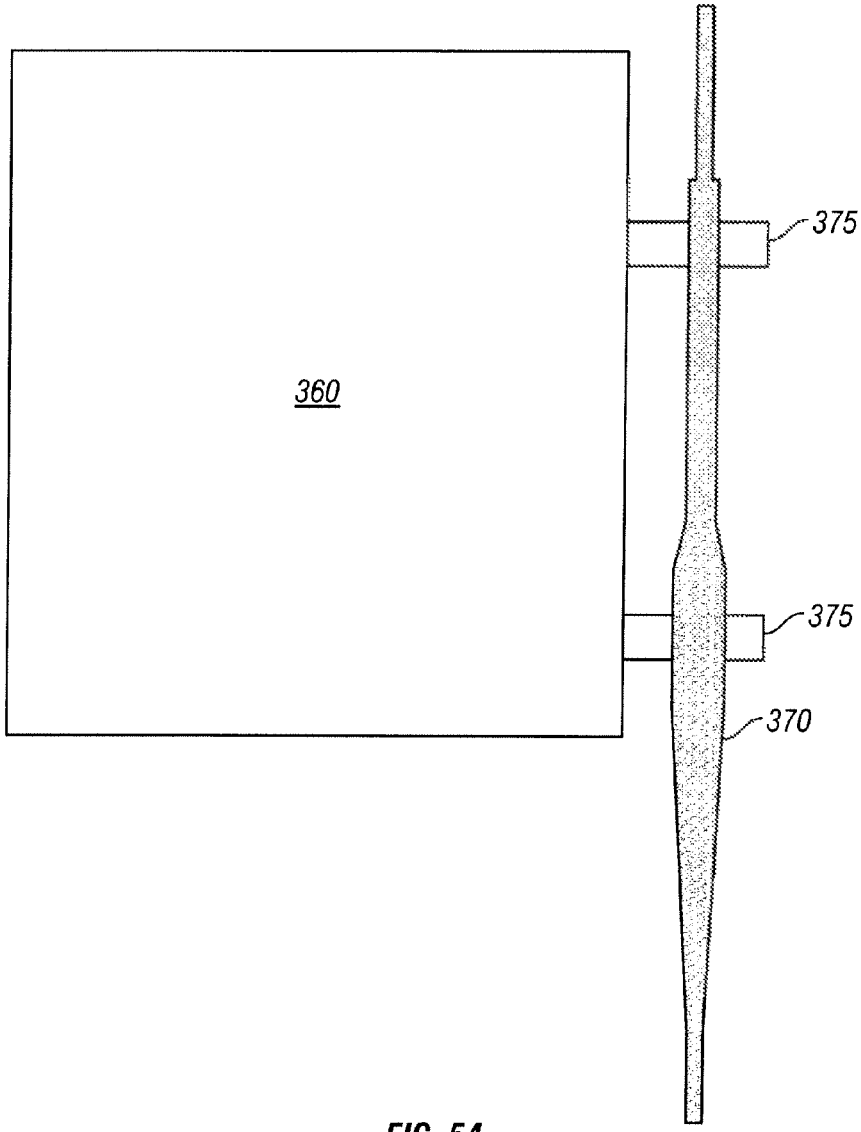
FIG. 54 is a schematic illustrating use of two keel guides.

A zero gap guide 375, as illustrated in FIG. 53, can also be used to connect riser 364 to a keel. Zero gap guides 375 can include rotational bearings 376 and linear bearings 377 to reduce dynamic stresses. Other components of a zero gap guide include keel guide 378, snap ring 379, inner and outer housings 380, and riser sleeve 381. Use of multiple guides 375 to connect riser 364 to keel 360 can also reduce the dynamic stresses (bending load) in the riser 364, as illustrated in FIG. 54. A double stress joint 370 can be used to connect the riser 364 to the guides 375.

Figure 55:
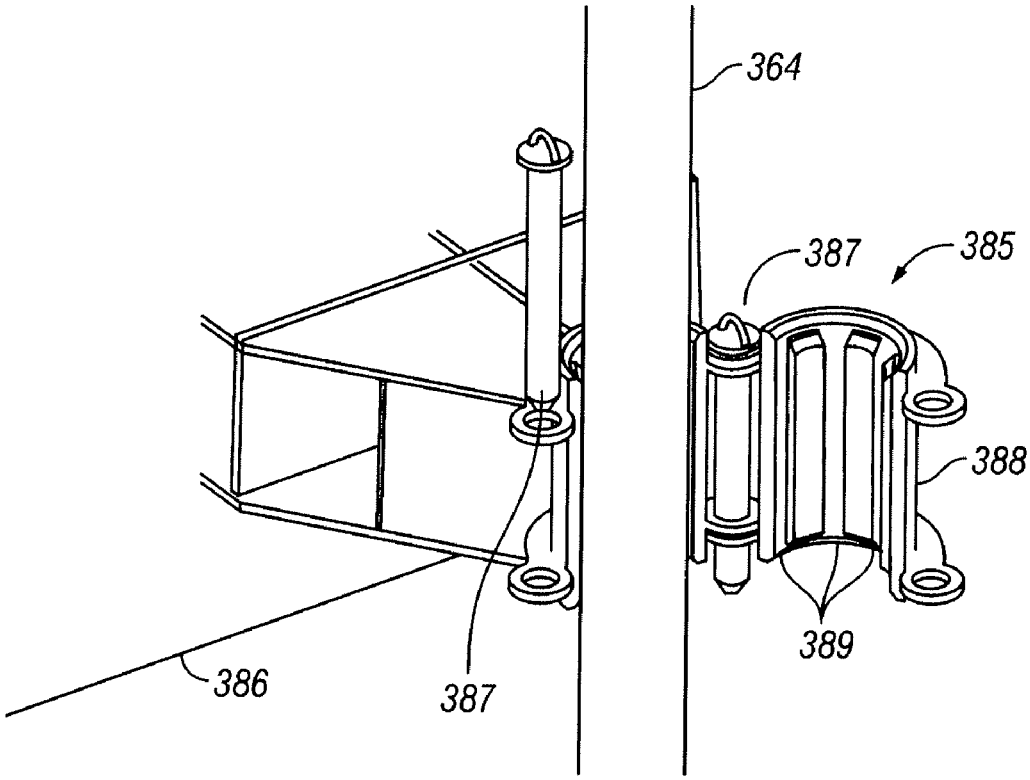
FIG. 55 illustrates a zero-gap hinged keel guide.

A further option for connecting the riser 364 to the keel or pontoon 360 is a zero gap hinged guide 385, as illustrated in FIG. 55. Zero gap open hinged guide 385 can include a keel support member 386, hinge pins 387, and gate 388. The portion of gate 388 and keel support 386 in contact with riser 364 can include elastomeric elements 389, providing some cushion, potentially decreasing wear on the riser or guide.

Figure 56:
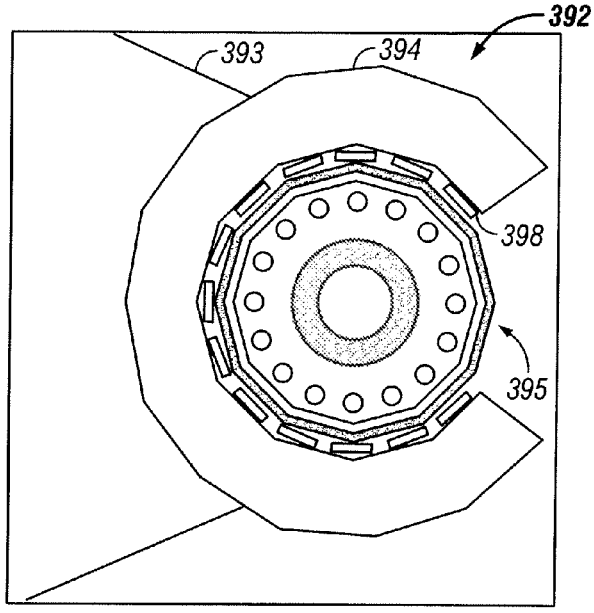
FIGS. 56-58 are schematic illustrations of a zero gap open keel guide.
Figure 57:
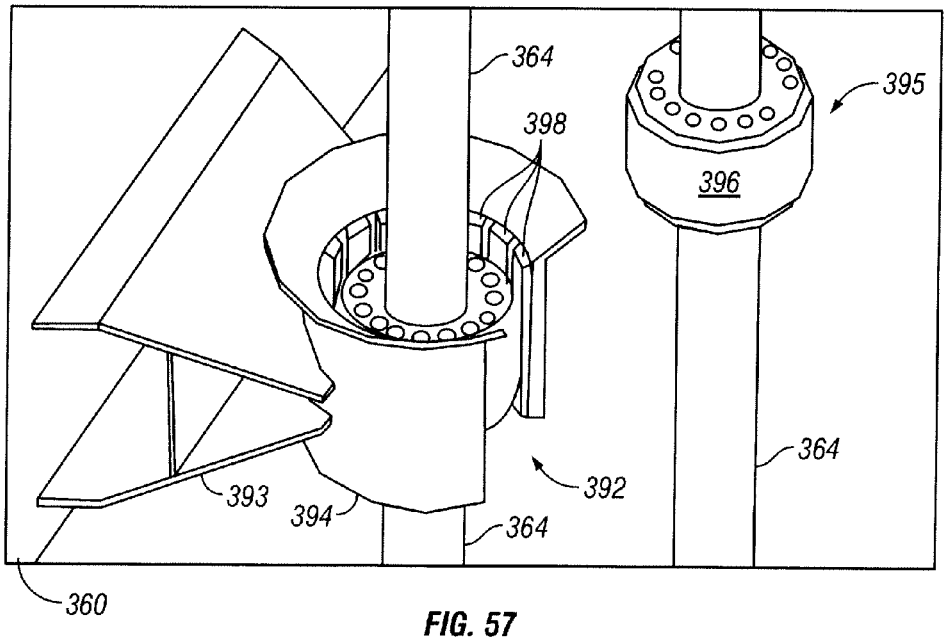
Figure 58:
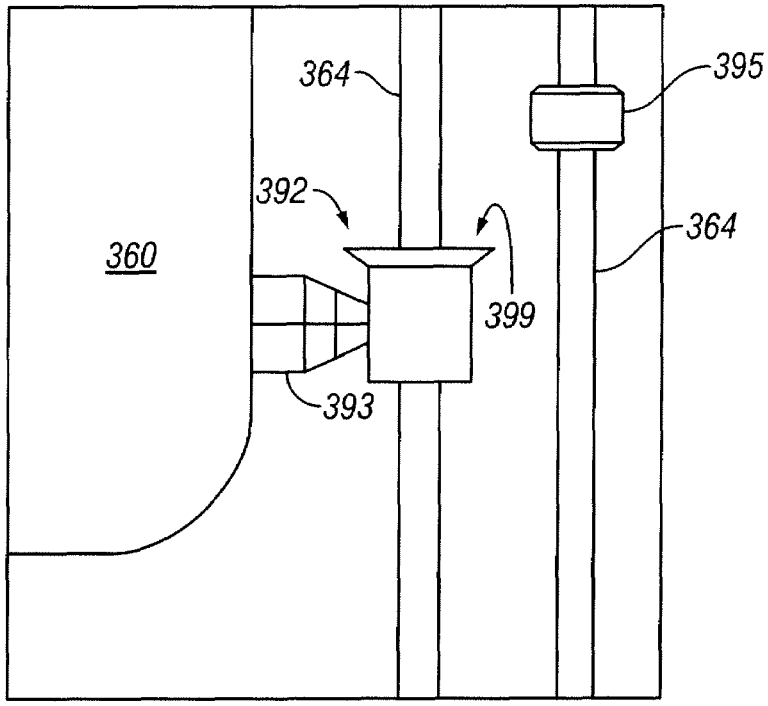

Another option for connecting the riser 364 to the keel 360 includes an open keel guide 392 as illustrated in FIGS. 56-58. Zero gap open keel guide 392 can include keel support member 393 terminating at C-ring riser support 394. Grommet 395, installed on riser 364, having an elastomeric element 396 is located at an upper end of riser 364. Grommet 395 is located along riser 364 and placed in open keel guide 392 by lifting riser 364 slightly while the grommet 395 is lowered into the open keel guide 392, as shown by directional arrow 399 in FIG. 58. Elastomeric elements 396, 398 on the grommet 395 and/or C-ring 394 can reduce the dynamic stresses at the attachment point.

Figure 59:
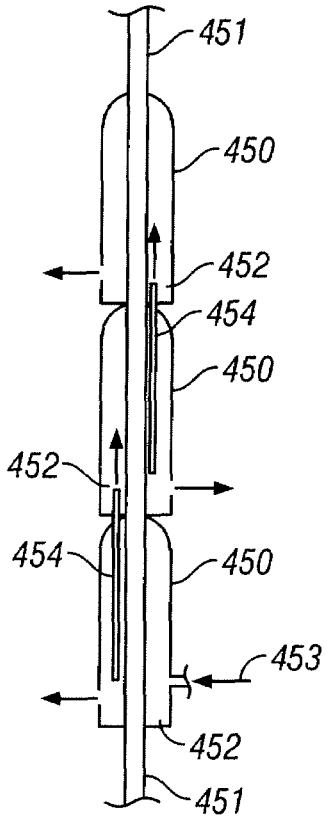
FIG. 59 is a schematic view of a series of air-cans used to add buoyancy to an embodiment of the riser of the present invention.

Throughout the above description, reference has been made to buoyant sections of pipe. Permanent buoyancy installed at the production platform can require significant ballast during the riser installation process to sink and install the riser on the wellhead. Referring to FIG. 59, an air can 450 or a series of air canisters 450 placed around or encompassing a riser 451 can reduce the needed ballast during installation. For example, a section of riser 451 can be fitted with canisters 450 at the production platform, where the canisters 450 are not pressurized, or are filled with seawater 452. Following installation of the riser as described above, pressurized gas 453 can be added to canisters 450, generating the desired buoyancy within the pipe section and displacing any added seawater 452 from the canisters. Multiple canisters 450 can be linked with dip tubes 454, allowing for a single pressurized gas 453 addition point to fill multiple canisters 450.

Figure 60:
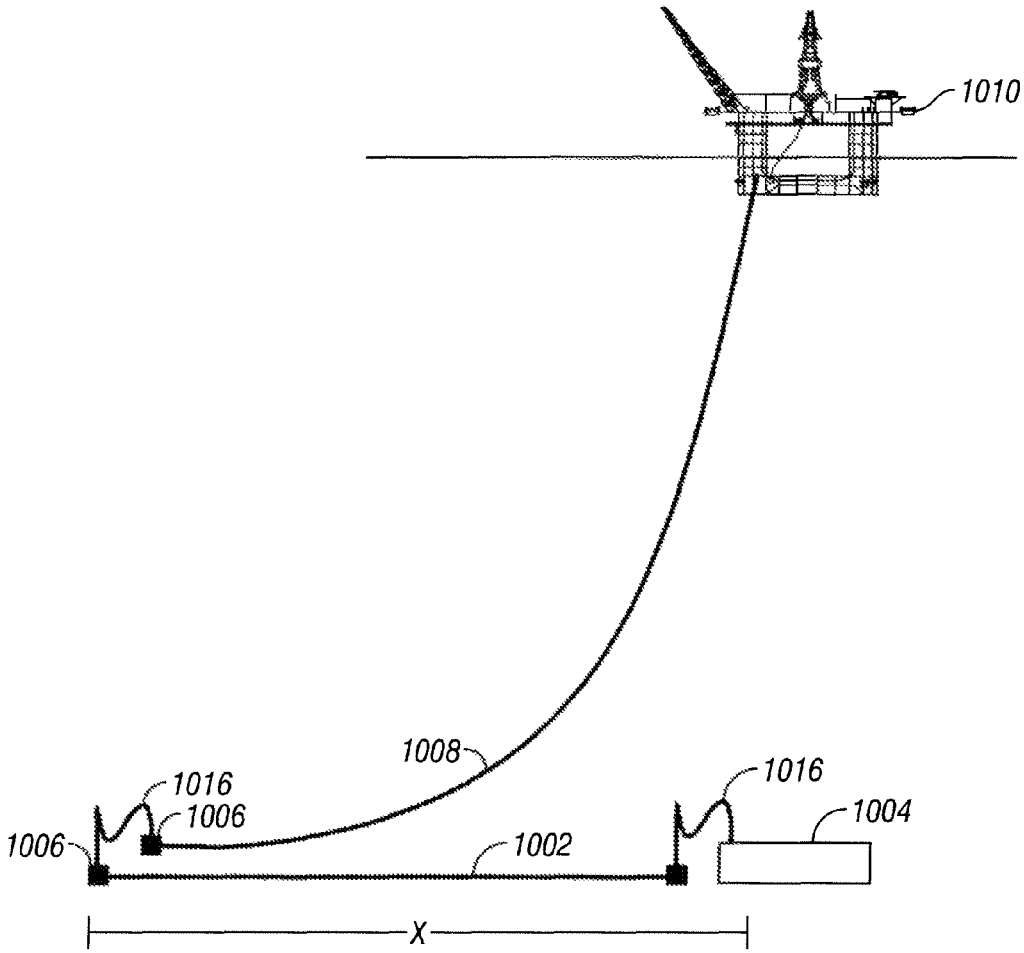
FIG. 60 (Prior Art)
FIGS. 60-61 are schematic views of typical (prior art) steel catenary risers used to connect a pipe line end termination (PLET) to a floating platform.
Figure 61:
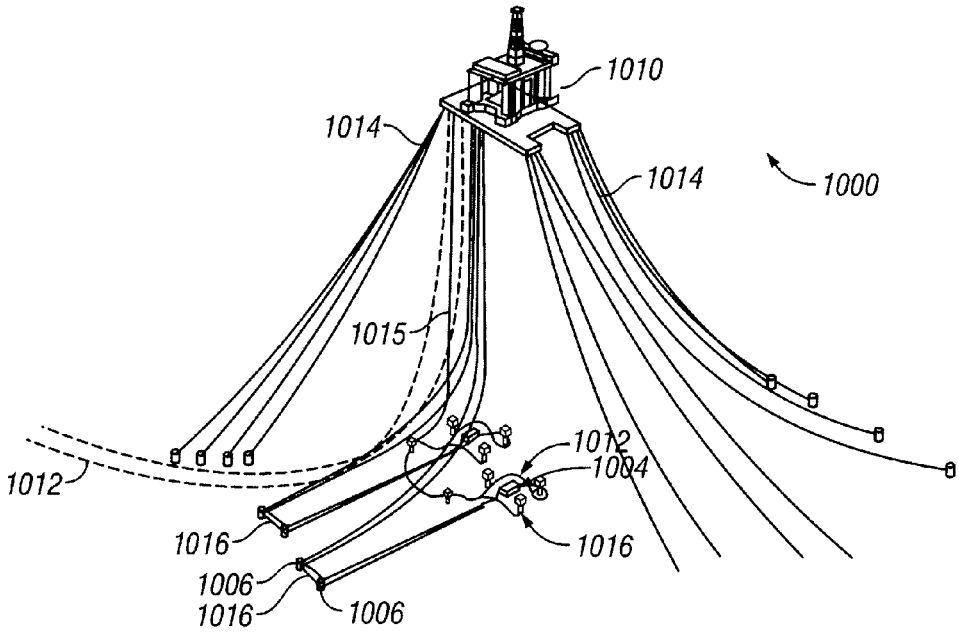
FIG. 61 (Prior Art)

A typical prior art wet tree direct access system 1000 is illustrated in FIGS. 60 and 61. A flow line 1002 can extend along the seabed away from a subsea well or manifold 1004 to flowline end terminations (FLETs) or pipe line end terminations (PLETs) 1006 with steel catenary risers (SCRs) 1008 extending from the PLETs 1006 back to the host production platform 1010. Production platform 1010 can include production lines 1012, mooring 1014, and umbilicals 1015. The tie-back distance "X" can range from several hundred meters to tens of kilometers, depending upon SCR pipe flexibility (thickness and diameter) and water depth, among others. The SCRs 1008 are typically pipe-in-pipe with insulation, adding to the cost of installation due to the distance the SCRs 1008 traverse. The manifolds 1004 are often clustered in a drill center beneath the floating production facility 1010 such that well-bore maintenance can be performed through a workover riser from the host production platform 1010. Jumpers 1012 from the pipe 1002 to the PLETs 1006 and from the wellhead wet trees 1016 to manifold 1004 can cause congestion on the seabed, as illustrated in FIG. 61. Additionally, flexible pipe is often required in a wet tree system 1000.

Figure 62:
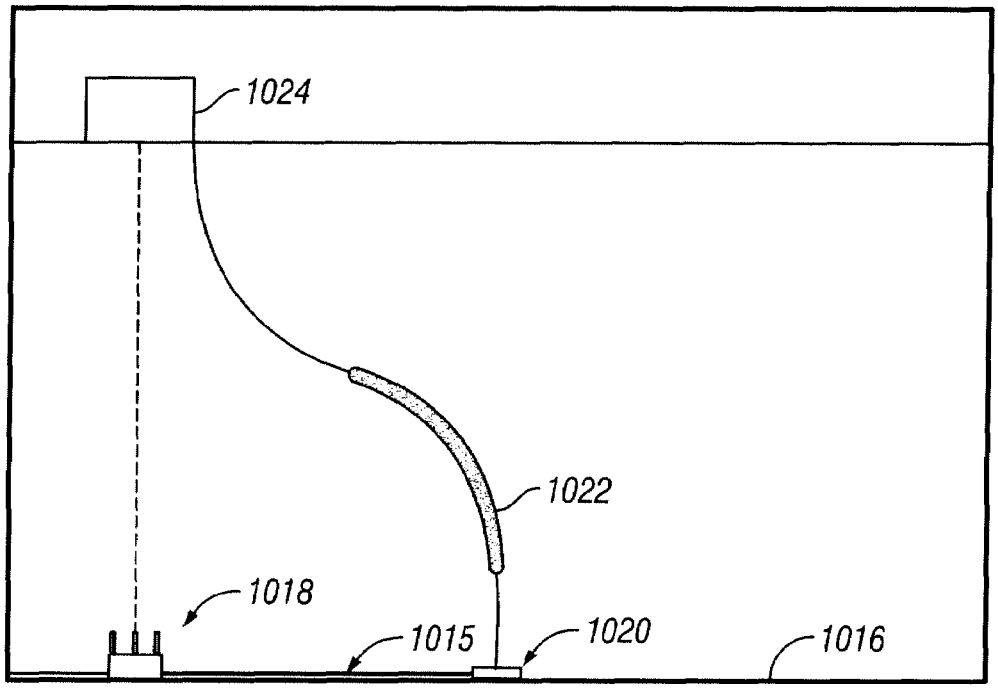
FIG. 62 is a schematic representation of an embodiment of the riser of the present invention connecting a PLET to a floating platform.

The variable tension risers of the present invention and as described above can also be advantageously adapted to wet tree systems. Referring now to FIG. 62, a pipe section 1015 along the seabed 1016 can connect manifold 1018 to PLET 1020. A compliant riser 1022 of the present invention can connect directly to PLET 1020, linking PLET 1020 to production platform 1024, and avoiding the jumpers associated when connecting the PLETs 1006 used with SCRs, as can be seen by comparing FIG. 60 with FIG. 62.

Figure 63:
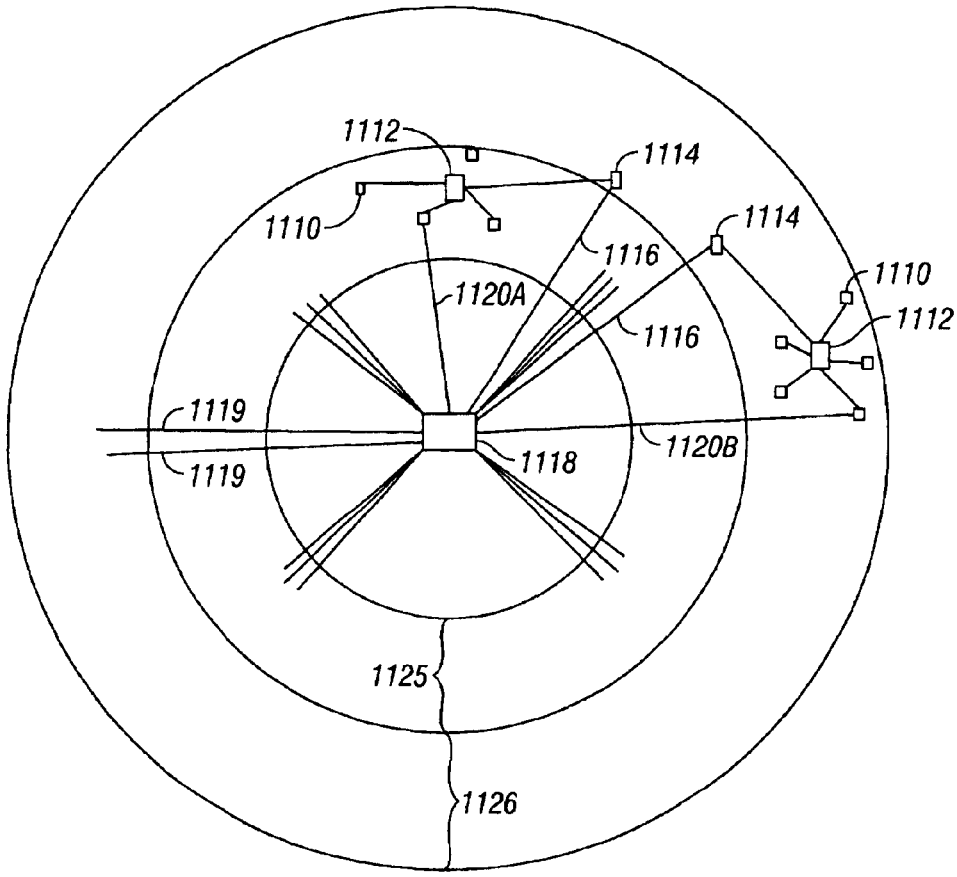
FIG. 63 is a schematic representation of a production system utilizing an embodiment of the riser of the present invention as a variable tension workover riser.
Figure 64:
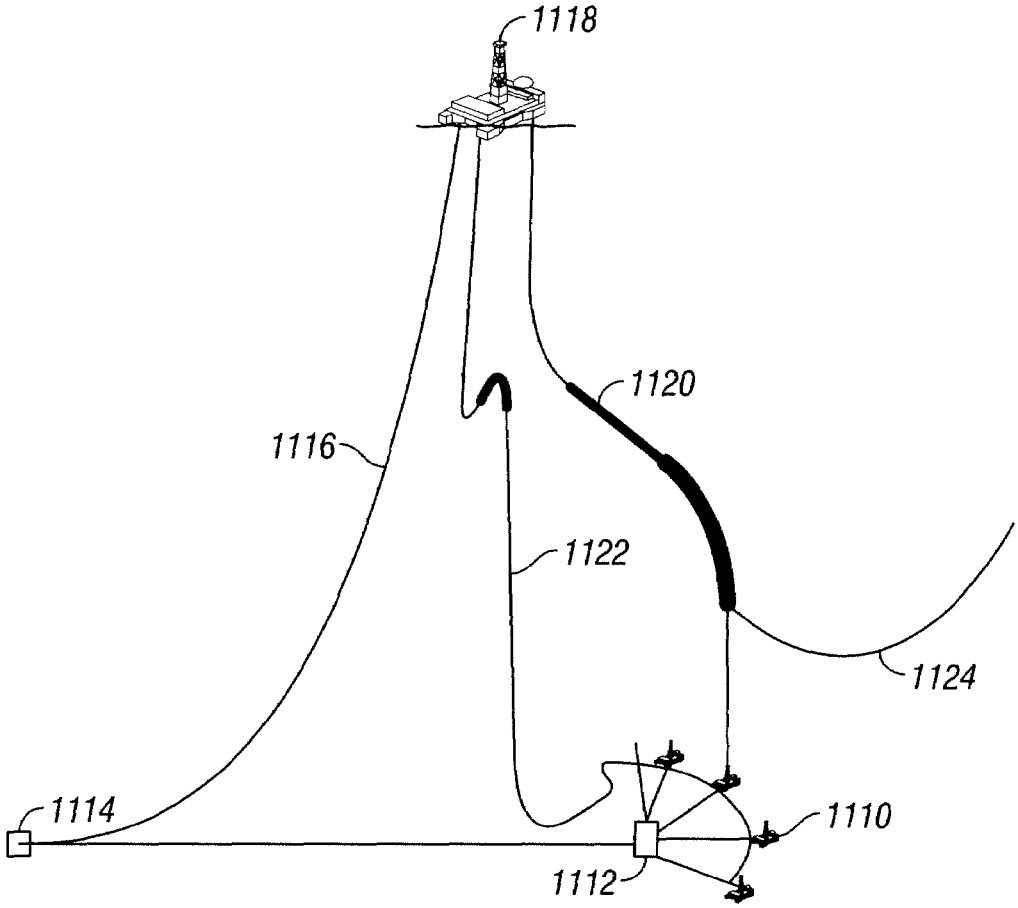
FIG. 64 is a perspective view of a production system utilizing an embodiment of the riser of the present invention as a variable tension workover riser.

As illustrated in FIGS. 63 and 64, the variable tension risers of the present invention can be advantageously used with a drilling rig, workover rig or a platform having both workover and production capabilities. Subsea wells 1110, having a wet tree allowing for production and workover access, can be connected to subsea manifolds 1112 having a flow line connected to PLETs 1114. Production risers 1116 can connect PLETs 1114 to moored platform 1118, exporting products through export lines 1119. Production risers 1116 can be SCRs, as illustrated, or can be variable tension risers of the present invention, as described above. Umbilical 1122 can communicate with wells 1110.

Variable tension workover risers 1120 can be used to access and workover a well 1110. Due to the characteristics of the variable tension riser as described above, after workover of a first well 1110, a variable tension workover riser 1120 can be relocated over additional wells 1110 for workover as needed. Repositioning of the variable tension workover riser 1120 can be carried out using a weighted line 1124 attached to a surface vessel (not shown) and to a connection point on the riser, similar to that as described above in relation to riser installation. Often, large differences in the offset of wells 1110 from platform 1118 can be encountered. If necessary, more than one variable tension workover riser 1120 can be used to service wells 1110, thus encompassing a large number of wells that can be serviced using a minimal number of variable tension workover risers 1120. In this manner, each workover riser 1120 can service wells within an offset range suitable for use with the variable tension workover riser 1120. For example, variable tension riser 1120A can work within an offset range 1125; variable tension riser 1120B can work within an offset range 1126.

Use of variable tension workover risers in conjunction with subsea manifolds and wet trees can offer significant benefits for some production fields. Most importantly, the number of risers can be minimized while maintaining workover access to wet tree wells spread over a large area. Redrilling and recompletion type work may still require a separate mobile offshore drilling unit, as is typical for current wet tree systems.

Advantages of the riser of the present invention can include minimizing extreme curvatures, stresses, and dynamic stress ranges incurred in riser construction and operation. Several advantages can be realized by utilizing the variable tension riser system of the present invention with a wet tree system. Several PLETs and jumpers can be eliminated, and the total riser length can be decreased, both decreasing material and installation costs. The sensitivity of the wet tree system to seabed soil conditions can be decreased by reduced motion at the touchdown point. Vertical loads on the hull of the production facility can be reduced, facilitating mooring by inhibiting riser imbalance loads. Heat loss can be reduced by using a shorter section of pipe, allowing a reduction in insulation requirements and lesser incidences of production problems associated with decreased gas or fluid temperatures in the riser. The use of high strength steel and threaded and coupled (T&C) connectors can be enabled, moving away from the need for flexible pipe and reducing sensitivity of the system to vessel motion that can induce fatigue damage. Other advantages obtained by utilizing the variable tension riser system of the present invention can also be realized, but are not enumerated here.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method to install a communications riser, comprising:
deploying a connector mounted on a distal end of a first slick section of a communications riser;
deploying one or more buoyed sections of the communications riser;
attaching a guide and ballast line to the communications riser intermediate the one or more buoyed sections and the connector, the guide and ballast line to be paid out and taken up from a floating vessel,
adjusting the guide and ballast line to counter any positive buoyancy of the one or more buoyed sections during installation;
deploying a weighted section of the communications riser;
deploying a second slick section of the communications riser, wherein the weighted section is intermediate the one or more buoyancy sections and the second slick section;
manipulating the guide and ballast line to deflect a lower portion of the communications riser a lateral distance relative to an upper portion of the communications riser; and
lowering the communications riser to engage a wellhead, flowline end termination (FLET), or a pipe line end termination (PLET) with the connector.

2. The method of claim 1, wherein the buoyed section comprises a segment of maximum buoyancy and one or more segments of lesser buoyancy.

3. The method of claim 2, wherein the segment of maximum buoyancy is intermediate the first slick section and the one or more segments of lesser buoyancy.

4. The method of claim 1, wherein the weighted section comprises two or more segments of varying weight per unit length.

5. The method of claim 1, wherein the connector, one or more buoyed sections, weighted section, and second slick line section are deployed from a floating platform, and the guide and ballast line is manipulated with the floating vessel.

6. The method of claim 1, wherein the guide and ballast line comprises:
a ballast attachment rope connecting a heavy ballast chain to the connector; and
an installation rope connecting the heavy ballast chain to the floating vessel.

7. The method of claim 6, comprising parking the heavy ballast chain on a seabed proximate the wellhead, FLET, or PLET.

8. The method of claim 7, wherein the parking comprises:
lowering the connector to a point intermediate the wellhead, FLET, or PLET and the distal end;

manipulating the guide and ballast line to lay at least a portion of the heavy ballast chain on the seabed without contacting the wellhead, FLET, PLET, or riser with the heavy ballast chain;

disconnecting and recovering the installation rope from the heavy ballast chain.

9. The method of claim 6, wherein the attachment point comprises a reel having excess ballast attachment rope and the parking comprises:

reeling out the excess ballast attachment rope;

manipulating the guide and ballast line to lay at least a portion of the heavy ballast chain on the seabed without contacting the wellhead or riser with the heavy ballast chain;

disconnecting and recovering the installation rope from the heavy ballast chain.

10. The method of claim 1, further comprising deploying a third slick section intermediate the weighted section and the one or more buoyed sections.

11. The method of claim 1, wherein the one or more buoyed sections provides positive tension to the first slick section.

12. The method of claim 1, further comprising connecting a distal end of the second slick section of the communications riser to a spar platform, tension leg platform, submersible platform, semi-submersible platform, well intervention platform, or drillship.

13. The method of claim 12, wherein the weighted section exhibits a positive tension on the spar platform, tension leg platform, submersible platform, semi-submersible platform, well intervention platform, or drillship.

14. The method of claim 1, further comprising operating a remotely operated vehicle to assist in deflecting the lower portion of the communications riser the lateral distance relative to the upper portion of the communications riser.

* * * * *